US008460790B2

(12) United States Patent
Ochi et al.

(10) Patent No.: US 8,460,790 B2
(45) Date of Patent: Jun. 11, 2013

(54) NANOFIBER AGGREGATE, POLYMER ALLOY FIBER, HYBRID FIBER, FIBROUS STRUCTURES, AND PROCESSES FOR PRODUCTION OF THEM

(75) Inventors: Takashi Ochi, Mishima (JP); Akira Kishiro, Mishima (JP); Shuichi Nonaka, Otsu (JP)

(73) Assignee: TORAY Industries, Inc., Tokyo (JP)

( * ) Notice: Subject to any disclaimer, the term of this patent is extended or adjusted under 35 U.S.C. 154(b) by 1328 days.

(21) Appl. No.: 10/532,082

(22) PCT Filed: Oct. 22, 2003

(86) PCT No.: PCT/JP03/13477

§ 371 (c)(1),
(2), (4) Date: Apr. 21, 2005

(87) PCT Pub. No.: WO2004/038073

PCT Pub. Date: May 6, 2004

(65) Prior Publication Data

US 2006/0057350 A1 Mar. 16, 2006

(30) Foreign Application Priority Data

Oct. 23, 2002 (JP) ..... 2002-308048
Oct. 30, 2002 (JP) ..... 2002-315726

(51) Int. Cl.
*D02G 3/00* (2006.01)
*D04H 1/00* (2006.01)
*B29D 28/00* (2006.01)

(52) U.S. Cl.
USPC ..... 428/373; 428/364; 428/376; 428/398; 428/292.1; 428/395; 442/361; 442/363; 442/347; 264/103

(58) Field of Classification Search
USPC ..... 428/292.1, 255, 260, 261, 262, 265, 428/267, 270, 272, 273, 274, 315.9, 317.9, 428/373, 374, 903, 224, 299, 284, 297, 298, 428/304.4, 423.3, 904, 160, 370; 442/201, 442/363, 340, 361, 411, 181; 427/245–246, 427/389.9, 392; 264/257, 555, 211, 211.12, 264/211.22, 349; 524/350
See application file for complete search history.

(56) References Cited

U.S. PATENT DOCUMENTS 4,686,074 A 8/1987 Okamoto ..... 264/171
4,808,367 A * 2/1989 Homma et al. ..... 264/555

(Continued)

FOREIGN PATENT DOCUMENTS

EP 0 498 672 A2 8/1992
EP 0 699 784 A2 3/1996

(Continued)

OTHER PUBLICATIONS

Theron et al. Electrostatic field-assited alignment of electrospun nanofibres. Nanotechnology, 12, 2001, 384-390.*

(Continued)

*Primary Examiner* — Elizabeth Cole
*Assistant Examiner* — Altrev Sykes
(74) *Attorney, Agent, or Firm* — Kubovcik & Kubovcik

(57) ABSTRACT

The present invention provides an aggregate of nanofibers having less spread of single fiber fineness values that can be used in wide applications without limitation to the shape and the kind of the polymer, and a method for manufacturing the same. The present invention is an aggregate of nanofibers made of a thermoplastic polymer having single fiber fineness by number average in a range from $1\times10^{-7}$ to $2\times10^{-4}$ dtex and single fibers of 60% or more in fineness ratio have single fiber fineness in a range from $1\times10^{-7}$ to $2\times10^{-4}$ dtex.

12 Claims, 17 Drawing Sheets

U.S. PATENT DOCUMENTS

| | | | | |
|---|---|---|---|---|
| 4,966,808 | A * | 10/1990 | Kawano | 442/201 |
| 5,393,600 | A * | 2/1995 | Omura et al. | 442/76 |
| 5,798,165 | A * | 8/1998 | Mizoguchi et al. | 428/160 |
| 6,284,680 | B1 * | 9/2001 | Aikawa et al. | 442/363 |
| 6,706,086 | B2 * | 3/2004 | Emig et al. | 55/486 |
| 6,740,142 | B2 * | 5/2004 | Buettner et al. | 95/273 |
| 2001/0053646 | A1 * | 12/2001 | Tanaka et al. | 442/181 |
| 2002/0009938 | A1 * | 1/2002 | Katayama et al. | 442/181 |
| 2002/0035354 | A1 * | 3/2002 | Mirle et al. | 604/385.01 |
| 2002/0046656 | A1 * | 4/2002 | Benson et al. | 95/287 |
| 2002/0173213 | A1 * | 11/2002 | Chu et al. | 442/414 |
| 2004/0116025 | A1 * | 6/2004 | Gogins et al. | 442/340 |

FOREIGN PATENT DOCUMENTS

| | | | |
|---|---|---|---|
| EP | 1 243 675 | A1 | 9/2002 |
| JP | 60-21904 | A | 2/1985 |
| JP | 1-282390 | A | 11/1989 |
| JP | 3-113082 | A | 5/1991 |
| JP | 5-71006 | A | 3/1993 |
| JP | 6-272114 | A | 9/1994 |
| JP | 07-097720 | A | 4/1995 |
| JP | 08-027626 | A | 1/1996 |
| JP | 8-113829 | A | 5/1996 |
| JP | 2001-1252 | A | 1/2001 |
| JP | 2002-172163 | A | 6/2002 |
| JP | 2002-173308 | A | 6/2002 |
| JP | 2004256983 | A * | 9/2004 |

OTHER PUBLICATIONS

Li et al. Electrospinning of Polymeric and Ceramic Nanofibers as Uniaxially Aligned Arrays. Nano Letters, vol. 3, 2003, 1167-1171.*

Deitzel et al. Controlled deposition of electrospun poly(ethylene oxide) fibers. Polymer 42, 2001, 8163-8170.*

Fong et al. Beaded nanofibers formed during electrospinning, Polymer, vol. 40, Issue 16, (1999), 4585-4592.*

Kubo et al. Ultrafine Ion Exchange Fiber and Method for Manufacturing the Same. JP 01-282390 English translation.*

Kageyama, Keisuke et al., "Extrusion Polymerization: Catalyzed Synthesis of Crystalline Linear Polyethylene Nanofibers Within a Mesoporous Silica," *Science*, vol. 285, Sep. 24, 1999, 2113-2115.

Fong, H. et al., "Beaded Nanofibers Formed During Electrospinning," *Polymer*, vol. 40, 1999, pp. 4585-4592.

Tamba, Yoshihiro, "Man-made Leather "CLARINO"", *Seikei-Kakou* vol. 14, No. 6, Jun. 14, 2002, pp. 326-330. (partial translation ("3.1 Technologies for Producing Special Fibers")).

Oya, Asao et al., "Preparation of thin carbon fibers from phenol-formaldehyde polymer micro-beads dispersed in polyethylene matrix", *Carbon* 38 (2000), pp. 1141-1144.

* cited by examiner

Polymer alloy fiber (Not treated)

Aggregate of nanofibers (After alkali treatment)

NANOFIBER AGGREGATE, POLYMER ALLOY FIBER, HYBRID FIBER, FIBROUS STRUCTURES, AND PROCESSES FOR PRODUCTION OF THEM

This application is a 371 of international application PCT/JP2003/013477, which claims priority based on Japanese patent application Nos. 2002-308048 and 2002-315726 filed Oct. 23 and Oct. 30, 2002, respectively, which are incorporated herein by reference.

TECHNICAL FIELD

The present invention relates to an aggregate of nanofibers. It also relates to a polymer alloy fiber that serves as a precursor for the aggregate of nanofibers. Further it relates to a hybrid fiber and a fibrous material that include the aggregate of nanofibers. The present invention also includes a method for manufacturing the aforementioned articles.

BACKGROUND ART

Polymers manufactured through polycondensation such as polyester typified by polyethylene terephthalate (hereinafter abbreviated as PET) and polybutylene terephthalate (hereinafter abbreviated as PBT), and polyamide typified by nylon 6 (hereinafter abbreviated as N6) and nylon 66 (hereinafter abbreviated as N66) have been preferably used in such applications as clothes and industrial materials, because of the favorable mechanical properties and heat resistance of these fibers. Polymers manufactured through addition polymerization typified by polyethylene (hereinafter abbreviated as PE) and polypropylene (hereinafter abbreviated as PP), in contrast, have been preferably used mainly in industrial applications, because of the favorable mechanical properties, resistance to chemicals and lightness of these fibers.

The polyester fiber and the polyimide fiber, in particular, have been used in the applications for clothes and therefore have been subjected to vigorous researches for not only to modify the polymer but also to improve the properties by controlling the cross sectional shape of the fiber or using an extremely fine fiber. One of such attempts resulted in ultrafine polyester fibers made by using an islands-in-sea multi-component fiber, that was used in an epoch making new product of synthetic leather having the touch of suede. These ultrafine fibers have been applied to the manufacture of ordinary clothes, and are used in the development of clothes that have excellent hands like peach skin which can never be obtained with ordinary fibers. The ultrafine fibers, those have found applications not only for clothes but also for livingwares such as wiping cloth and industrial materials, have secured a position of its own in the area of synthetic fibers today.

Recently, in particular, applications of the ultrafine fibers have been expanded to texturing cloth for the surface of a computer hard disk as described in Japanese Unexamined Patent Publication No. 2001-1252, and medical supplies such as cell adsorbing material as described in Japanese Unexamined Patent Publication No. 2002-172163.

Accordingly, there has been demand for further finer fibers in order to make a synthetic leather of higher quality and clothes of excellent feeling. In the meantime, to increase the storage capacity of a hard disk with increased recording density, it is necessary to make the surface of the hard disk smoother from the mean surface roughness of 1 nm or more at the present to 0.5 nm or less. For this purpose, nanofibers having further decreased thickness have been required to make a texturing cloth for texturing the hard disk surface.

In medical applications, too, nanofibers having the same size as the fibers that constitute living organs have been in demand in order to improve the affinity with the living cells.

However, the present islands-in-sea multi-component spinning technology has a limitation of 0.04 dtex (equivalent diameter 2 μm) for improving the single fiber fineness, which cannot fully meet the needs for the nanofibers. While methods for making ultrafine fibers from polymer blend fibers are disclosed in Japanese Unexamined Patent Publication No. 3-113082 and in Japanese Unexamined Patent Publication No. 6-272114, a single fiber fineness that can be achieved by these technologies is 0.001 dtex (equivalent diameter 0.4 μm) at the best, which also cannot fully meet the needs for the nanofibers.

A method for making an ultrafine fiber from polymer blend fibers using a static mixer is disclosed in U.S. Pat. No. 4,686,074. The ultrafine fibers manufactured by this technology were also not fine enough to meet the needs for the nanofibers.

Meanwhile a technology called the electrospinning has been in spotlight as a promising technology that can manufacture ultrafine fibers. The electrospinning is a process in which a polymer is dissolved in an electrolysis solution and is extruded through a spinneret while applying a high voltage in a range from several thousands of volts to thirty kilovolts to the polymer solution, so as to generate a high speed jet of the polymer solution that subsequently deflects and expands, thereby producing the ultrafine fibers. This technology may produce, depending on the circumstance, yarns having a single fiber fineness on the order of $10^{-5}$ dtex (equivalent single fiber diameter several tens of nanometers), that is one hundredth or less in fineness and one tenth or less in diameter of the yarn produced by the conventional polymer blending technology. While this technology is mainly applied to biopolymer such as collagen and water-soluble polymer, electrospinning may also be applied to thermoplastic polymer that is dissolved in an organic solvent. However, as is pointed out in Polymer, vol. 40, 4585 (1999), the strings that constitute the ultrafine fibers are often connected by beads (about 0.5 μm in diameter) that is formed from a stagnant polymer drop, thus resulting in a large spread of single fiber fineness values in an aggregate of ultrafine fibers. Although attempts have been made to suppress the generation of the beads so as to generate a fiber of uniform diameter, there still remains a significant spread of single fiber fineness values (Polymer, Vol. 43, 4403 (2002)). Also because the form of the aggregate of fibers obtained by the electrospinning is limited to nonwoven fabric and the aggregate of fibers obtained is not oriented and not crystallized, in many cases, having far less strength compared to ordinary fibrous articles, there has been a limitation to the application of the technology. Moreover, there have been such problems that sizes of the fibrous articles manufactured by the electrospinning process are limited to about 100 $cm^2$ at the most, and productivity is as low as several grams per hour at the best that is far lower than with the ordinary melt spinning processes. Furthermore, requirement for the application of a high voltage and the tendency of the organic solvent and the ultrafine fibers to be suspended in air were additional problems.

An atypical method for manufacturing nanofibers is disclosed in Science, Vol. 285, 2113 (1999), according to which a polymerization catalyst is supported on a meso-porous silica so as to polymerize PE thereon, thereby to produce PE nanofiber chips measuring 30 to 50 nm (equivalent to $5\times10^{-6}$ dtex to $2\times10^{-5}$ dtex) in diameter. However, what can be obtained with this method is mere wad-like aggregate of nanofibers, which makes it impossible to draw a fiber therefrom. Also the polymer that can be processed with this method is limited to PE manufactured through addition polymerization. Polymers manufactured through polycondensation such as polyester and polyamide require dehydration in the process of polymerization, and there is a fundamental difficulty for applying the method to these fibers. Thus there has been a significant hurdle for practical application of the nanofibers obtained by this method.

DISCLOSURE OF THE INVENTION

The present invention provides an aggregate of nanofibers having less spread of single fiber fineness values that can be used in wide applications without limitation to the shape and the kind of the polymer, and a method for manufacturing the same.

The present invention encompasses the following constitutions.

(1) An aggregate of nanofibers made of a thermoplastic polymer, wherein single fiber fineness by number average is in a range from $1\times10^{-7}$ to $2\times10^{-4}$ dtex and single fibers of 60%, in fineness ratio, or more of single fibers are in a range from $1\times10^{-7}$ to $2\times10^{-4}$ dtex in single fiber fineness.

(2) The aggregate of nanofibers according to (1), having a morphology like filament-yarn and/or a morphology like spun yarn.

(3) The aggregate of nanofibers according to (1) or (2), wherein the single fiber fineness by number average is in a range from $1\times10^{-7}$ to $1\times10^{-4}$ dtex and single fibers of 60%, in fineness ratio, or more of single fibers are in a range from $1\times10^{-7}$ to $1\times10^{-4}$ dtex in single fiber fineness.

(4) The aggregate of nanofibers according to any one of (1) to (3), wherein single fibers of 50%, in fineness ratio, or more of the single fibers that constitute the aggregate of nanofibers are in a section having a width of 30 nm in diameter of the single fibers.

(5) The aggregate of nanofibers according to any one of (1) to (4), wherein the thermoplastic polymer comprises a polymer made through polycondensation.

(6) The aggregate of nanofibers according to any one of (1) to (5), wherein the thermoplastic polymer has a melting point of 160° C. or higher.

(7) The aggregate of nanofibers according to any one of (1) to (6), wherein the thermoplastic polymer comprises one selected from among polyester, polyamide and polyolefin.

(8) The aggregate of nanofibers according to any one of (1) to (7), that has a strength of 1 cN/dtex or higher.

(9) The aggregate of nanofibers according to any one of (1) to (8), that has a ratio of moisture adsorption of 4% or higher.

(10) The aggregate of nanofibers according to any one of (1) to (9), that has a rate of elongation at absorbing water of 5% or higher in the longitudinal direction of the yarn.

(11) The aggregate of nanofibers according to any one of (1) to (10), that contains a functional chemical agent.

(12) A fibrous material that includes the aggregate of nanofibers according to any one of (1) to (11).

(13) The fibrous material according to (12), wherein a mass per unit area of the fiber is in a range from 20 to 2000 g/m$^2$.

(14) The fibrous material according to (12) or (13), wherein the aggregate of nanofibers is encapsulated in a hollow space of a hollow fiber.

(15) The fibrous material according to (14), wherein the hollow fiber has multitude of pores measuring 100 nm or less in diameter in the longitudinal direction.

(16) The fibrous material according to any one of (12) to (15), that contains a functional chemical agent.

(17) The fibrous material according to any one of (12) to (16), wherein the fibrous material is selected from among yarns, a wad of cut fibers, package, woven fabric, knitted fabric, felt, nonwoven fabric, synthetic leather and sheet.

(18) The fibrous material according to (17), wherein the fibrous material is a laminated nonwoven fabric made by stacking a sheet of nonwoven fabric that includes the aggregate of nanofibers and a sheet of other nonwoven fabric.

(19) The fibrous material according to any one of (12) to (18), wherein the fibrous material is a fibrous article selected from among clothing, clothing materials, products for interior, products for vehicle interior, livingwares, environment-related materials, industrial materials, IT components and medical devices.

(20) A liquid containing the aggregate of nanofibers according to any one of (1) to (11) dispersed therein.

(21) A polymer alloy fiber that has islands-in-sea structure consisting of two or more kinds of organic polymers of different levels of solubility, wherein the island component is made of a low solubility polymer and the sea component is made of a high solubility polymer, a diameter of the island domains by number average is in a range from 1 to 150 nm, 60% or more of the island domains in area ratio have sizes in a range from 1 to 150 nm in diameter, and the island components are distributed in linear configuration.

(22) The polymer alloy fiber according to (21), wherein a diameter of the island domains by number average is in a range from 1 to 100 nm and 60%, in area ratio, or more of the island domains are in a range from 1 to 100 nm in diameter of the island domains.

(23) The polymer alloy fiber according to (21) or (22), wherein, among the island domains included in the polymer alloy fiber, 60%, in area ratio, or more of the island domains are in a section having a width of 30 nm in diameter of the island domains.

(24) The polymer alloy fiber according to any one of (21) to (23), wherein the content of the island component is in a range from 10 to 30% by weight of the entire fiber.

(25) The polymer alloy fiber according to any one of (21) to (24), wherein the sea component is made of a polymer that is highly soluble to aqueous alkaline solution or hot water.

(26) The polymer alloy fiber according to any one of (21) to (25), wherein the island component has a melting point of 160° C. or higher.

(27) A polymer alloy fiber that is a conjugated fiber of the polymer alloy according to any one of (21) to (26) and another polymer that are conjugated together.

(28) The polymer alloy fiber according to any one of (21) to (27), wherein the value of CR that is a measure of crimping characteristic is 20% or more, and the number of crimps is five per 25 mm or more.

(29) The polymer alloy fiber according to any one of (21) to (28), wherein Uster unevenness is 5% or less.

(30) The polymer alloy fiber according to any one of (21) to (29), that has a strength of 1.0 cN/dtex or higher.

(31) A fibrous material that includes the polymer alloy fiber according to any one of (21) to (30).

(32) The fibrous material according to (31), wherein the fibrous material is selected from among yarns, wad of cut fibers, package, woven fabric, knitted fabric, felt, nonwoven fabric, synthetic leather and sheet.

(33) The fibrous material according to (31) or (32), that includes the polymer alloy fibers and other fibers.

(34) The fibrous material according to any one of (31) to (33), wherein the fibrous material is a fibrous article selected from among clothing, clothing materials, products for interior, products for vehicle interior, livingwares, environment-related materials, industrial materials, IT components and medical devices.

(35) A method for manufacturing a polymer alloy fiber through melt spinning of a polymer alloy that is made by melt blending of a low solubility polymer and a high solubility polymer, wherein the following conditions (1) to (3) are satisfied:

(1) the low solubility polymer and the high solubility polymer that have been weighed independently are fed separately into a kneader and are blended under molten condition;

(2) the content of the low solubility polymer in the polymer alloy is in a range from 10 to 50% by weight; and (3) the melt viscosity of the high solubility polymer is 100 Pa·s or lower, or difference in melting point between the high solubility polymer and the low solubility polymer is in a range from −20 to +20° C.

(36) The method for manufacturing a polymer alloy fiber according to (35), wherein melt blending is carried out in a twin-screw extrusion-kneader and length of the kneading section of the twin-screw extrusion-kneader is from 20 to 40% of the effective length of a screw.

(37) The method for manufacturing a polymer alloy fiber according to (35), wherein melt blending is carried out in a static mixer and the number of splits carried out in the static mixer is $1\times10^6$ or more.

(38) The method for manufacturing a polymer alloy fiber according to any one of (35) to (37), wherein shear stress generated between a spinneret orifice wall and the polymer by the melt spinning operation is 0.2 MPa or less.

(39) A polymer alloy pellet that has islands-in-sea structure comprising two kinds of organic polymers of different levels of solubility, wherein the island component is made of a low solubility polymer and the sea component is made of a high solubility polymer, while melt viscosity of the high solubility polymer is 100 Pa·s or lower, or difference in melting point between the high solubility polymer and the low solubility polymer is in a range from −20 to +20° C.

(40) An organic/inorganic hybrid fiber that includes the aggregate of nanofibers according to any one of (1) to (11) in a proportion of 5 to 95% by weight, wherein at least part of the inorganic material exists within the aggregate of nanofibers.

(41) A fibrous material that includes the organic/inorganic hybrid fiber according to (40).

(42) A method for manufacturing the organic/inorganic hybrid fiber according to (40), wherein the aggregate of nanofibers is impregnated with an inorganic monomer and subsequently the inorganic monomer is polymerized.

(43) A method for manufacturing the fibrous material according to (41), wherein the fibrous material that includes the aggregate of nanofibers is impregnated with an inorganic monomer and subsequently the inorganic monomer is polymerized.

(44) A method for manufacturing a hybrid fiber, wherein the aggregate of nanofibers according to any one of (1) to (11) is impregnated with an organic monomer and subsequently the organic monomer is polymerized.

(45) A method for manufacturing a fibrous material, wherein the fibrous material according to any one of (12) to (19) above is impregnated with an organic monomer and subsequently the organic monomer is polymerized.

(46) A porous fiber wherein 90% by weight or more of the composition consists of an inorganic material, while multitude of pores are provided in the longitudinal direction and mean pore diameter of the pores in the cross section in the minor axis direction is in a range from 1 to 100 nm.

(47) A fibrous material that includes the porous fibers according to (46).

(48) A method for manufacturing the porous fiber, wherein nanofibers are removed from the organic/inorganic hybrid fiber, that is made by impregnating the aggregate of nanofibers with an inorganic monomer and subsequently polymerizing the inorganic monomer, thereby to obtain the porous fiber according to (46).

(49) A method for manufacturing a fibrous material, wherein nanofibers are removed from a material that includes the organic/inorganic hybrid fiber, which is made by impregnating the fibrous material that includes the aggregate of nanofibers with an inorganic monomer and then polymerizing the inorganic monomer, thereby to obtain the fibrous material according to (47).

(50) A method for manufacturing a nonwoven fabric, wherein the polymer alloy fibers according to any one of (21) to (30) are cut into fiber chips 10 mm or less in length, then the high solubility polymer is dissolved and papered without drying.

(51) A method for manufacturing a nonwoven fabric, wherein, after forming a nonwoven fabric or a felt that includes the polymer alloy fibers according to any one of (21) to (30), the nonwoven fabric or the felt and a base fabric made of a low solubility polymer are bonded together, and then the high solubility polymer is dissolved.

DESCRIPTION OF REFERENCE NUMERALS

Figure 1:
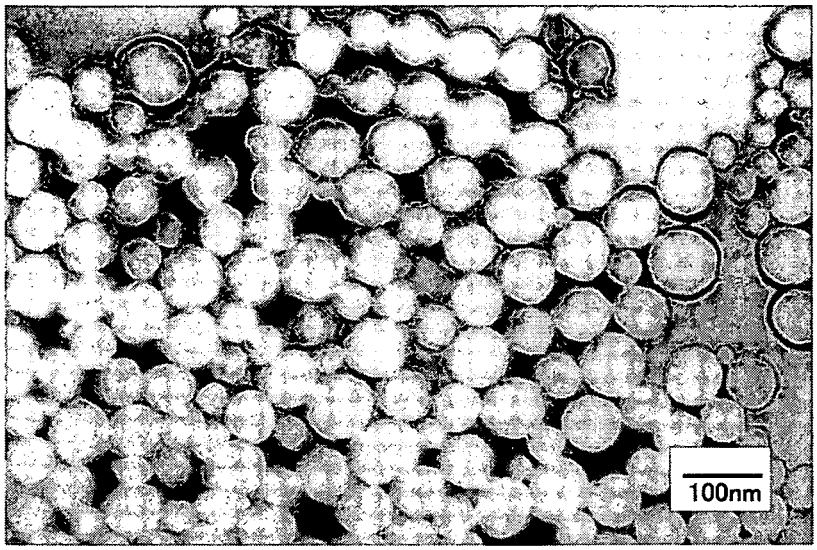
FIG. 1 is a TEM micrograph showing a cross section of fibers of an aggregate of nylon nanofibers according to Example 1 of the present invention.

1: hopper
2: melting section
3: spin block
4: spinning pack
5: spinneret
6: cooling equipment
7: line of thread
8: thread-collecting finishing guide
9: first take-up roller
10: second take-up roller
11: wound yarn
12: weighing section
13: orifice length
14: orifice diameter
15: undrawn yarn
16: feed roller
17: first hot roller
18: second hot roller
19: third roller (room temperature)
20: drawn yarn
21: single-screw extrusion-kneader
22: static mixer
23: twin-screw extrusion-kneader
24: chip weighing machine
25: blending tank
26: ejector
27: fiber separating plate
28: separated line of thread
29: collector

BEST MODE FOR CARRYING OUT THE INVENTION

Thermoplastic polymers that can be preferably used for the manufacture of the aggregate of nanofibers of the present invention include polyester, polyamide, polyolefin, polyphenylene sulfide and the like. Among these, polycondensation polymers typified by polyester and polyamide are preferable because many thereof have high melting points. The polymer has a melting point of preferably 160° C. or higher which renders the nanofiber satisfactory heat resistance. For example, the melting point of polylactic acid (hereinafter abbreviated as PLA) is 170° C., that of PET is 255° C., and that of N6 is 220° C. The polymer may include particles, flame retarding agent, antistatic agent or the like added thereto. The polymer may also be copolymerized with other component to such an extent that the property of the polymer is not compromised.

The nanofiber referred to in the present invention is a fiber having single fiber diameter in a range from 1 to 250 nm. An aggregate of such fibers is called the aggregate of nanofibers.

According to the present invention, a mean value and spread of single fiber fineness values in the aggregate of nanofibers are important factors. A single fiber diameter is measured for 300 or more single fibers that are randomly sampled in the same cross section, through observation of the cross section of the aggregate of nanofibers with a transmission electron microscope (TEM). An example of the micrograph of the cross section of the nanofiber of the present invention is shown in FIG. 1. This measurement is made in at least five places, so as to measure the diameters of 1500 or more single fibers in all, thereby to determine the mean value and spread of single fiber fineness values in the aggregate of nanofibers. Positions to make these measurements are preferably separated by a distance of 10 m or more from each other, in order to ensure the uniformity of the fibrous article to be made from the aggregate of nanofibers.

Mean value of the single fiber fineness is determined as follows. Fineness is calculated from the measured diameter of the single fiber and the density of the polymer that constitutes the single fiber, and these values are averaged. This mean value is referred to as "the single fiber fineness by number average" in the present invention. The value of density commonly used for the polymer is used in the calculation. According to the present invention, it is important that the single fiber fineness by number average is in a range from $1\times10^{-7}$ to $2\times10^{-4}$ dtex (equivalent to single fiber diameter from 1 to 150 nm). This is as thin as 1/100 to 1/100000 that of the ultrafine fiber made from the conventional islands-in-sea multi-component fiber, and enables it to make fabric for clothing that has touch feeling completely different from that of the ultrafine fibers of the prior art. When used as a texturing cloth for hard disk, it can make the hard disk surface far smoother than in the prior art. The single fiber fineness by number average is preferably in a range from $1\times10^{-7}$ to $1\times10^{-4}$ dtex (equivalent to single fiber diameter from 1 to 100 nm) and more preferably in a range from $0.8\times10^{-5}$ to $6\times10^{-5}$ dtex (equivalent to single fiber diameter from 30 to 80 nm).

Spread of single fiber fineness values of the nanofibers is evaluated as follows. Single fiber fineness $dt_i$ of each single fiber is totaled to obtain the total fineness ($dt_1+dt_2+\ldots+dt_n$). Product of a value of single fiber fineness and the number of nanofibers that have this same value of fineness divided by the total fineness is called the fineness ratio of this value of single fiber fineness. The fineness ratio corresponds to the weight proportion (volume proportion) of each single fiber fineness component to the population (aggregate of nanofibers). The larger the fineness ratio, the greater contribution the single fiber fineness component has to the property of the aggregate of nanofibers. According to the present invention, it is important that single fibers of 60%, in fineness ratio, or more of single fibers are in a range from $1\times10^{-7}$ to $2\times10^{-4}$ dtex in single fiber fineness (equivalent to single fiber diameter from 1 to 150 nm). This means that nanofibers larger than $2\times10^{-4}$ dtex (equivalent to single fiber diameter of 150 nm) are substantially nonexistent.

The aforementioned document of U.S. Pat. No. 4,686,074 discloses a method for manufacturing ultrafine fibers from polymer blend fibers using a static mixer. It is implied that a nanofiber having theoretical single fiber fineness of $1\times10^{-4}$ dtex (equivalent diameter 100 nm) would be obtained from the calculation using the number of splits of the static mixer. However, it is described that actual measurement of the ultrafine fibers showed single fiber fineness were in a range from $1\times10^{-4}$ to $1\times10^{-2}$ dtex (equivalent to diameter of about 1 μm), indicating that nanofibers of uniform single fiber diameters could not be obtained. This is supposedly because polymer islands united in the polymer blend fiber, and the polymer islands of nanometer order could not be uniformly distributed. Thus this technology resulted in only ultrafine fibers having large spread of single fiber fineness values. When the spread of single fiber fineness values is large, performance of the product is governed by the thick single fibers, and therefore the merit of the ultrafine fiber cannot be put into full play. There has also been a problem in the stability of quality due to the large spread of single fiber fineness values. When these fibers are used to make the texturing cloth for hard disk, the large spread of fineness values make it impossible to bear abrasive particles uniformly on the texturing cloth, thus resulting in such a problem that smoothness of the hard disk surface is compromised contrary to the intension.

The aggregate of nanofibers of the present invention, in contrast, can fully demonstrate the functions of the nanofiber because of small spread of single fiber fineness values, and allows it to manufacture articles having high stability of quality. When used to make the texturing cloth for hard disk surface, the small spread of fineness values of the aggregate of nanofibers enables it to bear abrasive particles uniformly on the texturing cloth, thus resulting in a dramatic improvement in the smoothness of the hard disk surface. Single fibers of 60%, in fineness ratio, or more are preferably in a range from $1\times10^{-7}$ to $1\times10^{-4}$ dtex (equivalent to single fiber diameter from 1 to 100 nm), more preferably in a range from $1\times10^{-7}$ to $6\times10^{-5}$ dtex (equivalent to single fiber diameter from 1 to 80 nm). Further more preferably, single fibers of 75%, in fineness ratio, or more are preferably in a range from $1\times10^{-7}$ to $6\times10^{-5}$ dtex (equivalent to single fiber diameter from 1 to 80 nm)

Another measure of the spread of fineness values is the fineness ratio of the single fibers that fall within a section having a width of 30 nm in diameter of the single fiber. As described above, the number of single fibers is counted for each diameter of the single fiber, and the total fineness ratio of the single fibers that fall in the section having a width of 30 nm of the highest frequency is defined as the fineness ratio of the single fibers that are in the section having a width of 30 nm. The fineness ratio represents the concentration of fineness values around the median fineness. Higher the fineness ratio in the section, the smaller the spread becomes. According to the present invention, the fineness ratio of the single fibers that fall in the section having a width of 30 nm is preferably 50% or more, more preferably 70% or more.

Figure 3:
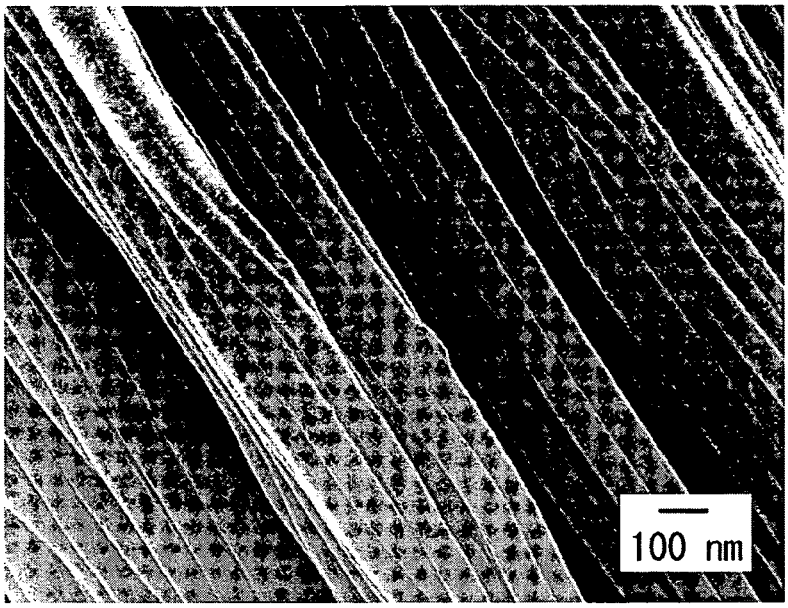
FIG. 3 is an SEM micrograph showing the state of side view of fibers of an aggregate of nanofibers according to Example 1 of the present invention.

According to the present invention, it is preferable that the aggregate of nanofibers comprises a morphology like filament-yarn and/or a morphology like spun yarn. The phrase "a morphology like filament-yarn and/or a morphology like spun yarn" means such a state of an aggregate of a plurality of nanofibers being oriented one-dimensionally that continues over a definite length, such as in multi-filament or spun yarn. A photograph of the side view of the aggregate of nanofibers of the present invention is shown in FIG. 3. An nonwoven fabric made by electrospinning has an entirely different form of two-dimensional aggregate where the nanofibers are disposed without any orientation. The present invention has novelty in that the aggregate of nanofibers has one-dimensional orientation. The length of the aggregate of nanofibers of the present invention is preferably several meters or longer, as in the case of the conventional multi-filaments. This constitution enables it to make various fibrous materials such as short fibers, nonwoven fabric and heat compression-formed article, as well as woven fabric and knitted fabric.

The aggregate of nanofibers of the present invention, because of the single fiber diameter as small as 1/10 to 1/100 that of the ultrafine fiber of the prior art, has dramatically increased the specific surface area. As a result, it demonstrates properties characteristic of the nanofiber which the conventional ultrafine fibers did not show.

For example, the aggregate of nanofibers shows greatly improved adsorbing capability. In a comparison of water vapor adsorbing capability, namely moisture adsorbing capability between the polyamide aggregate of nanofibers of the present invention and the conventional ultrafine polyamide yarn, the polyamide aggregate of nanofibers of the present invention showed the ratio of moisture adsorption as high as 6% while the conventional ultrafine polyamide yarn has the ratio of moisture adsorption of about 2%. According to the present invention, the ratio of moisture adsorption is preferably 4% or higher. Method for measuring the ratio of moisture adsorption (ΔMR) will be described later.

The aggregate of nanofibers of the present invention also has a large capacity to adsorb odorous materials such as acetic acid, ammonia and hydrogen sulfide, and is superior in both the ratio of odor adsorption and the odor adsorbing rate. Besides the odorous materials, the aggregate of nanofibers can also adsorb hazardous materials such as formaldehyde and that is one of the materials that cause sick house syndrome, hormone disrupting chemicals and heavy metal compounds.

Moreover, since the aggregate of nanofibers of the present invention has numerous voids that measure several nanometers to several hundreds of nanometers between the single fibers, the aggregate of nanofibers may demonstrate a unique property such as that of an ultra-porous material.

For example, the aggregate of nanofibers shows greatly improved liquid absorbing capability. In a comparison of water absorbing capability between the polyamide nanofibers of the present invention and the conventional polyamide fiber, while the conventional polyamide fiber has the ratio of water absorption of about 26%, the polyamide nanofibers of the present invention showed the ratio of water adsorption as high as 83% in some case, more than three times the former. Furthermore, while the conventional polyamide ultrafine fibers show a rate of elongation at absorbing water of about 3% in the longitudinal direction of yarn, the aggregate of polyamide nanofibers of the present invention can show a rate of elongation at absorbing water of 7%. Moreover, the aggregate of nanofibers returns to the original length when dried after the elongation at absorbing water, the change in size is reversible. The reversible elongation in the longitudinal direction of yarn upon absorbing water/drying is an important property in view of soil releasing capability of cloth. According to the present invention, the ratio of elongation is preferably 5% or higher. The soil releasing capability refers to the capability of the cloth to get rid of stain when laundered. Since the aggregate of nanofibers elongates in the longitudinal direction of yarn upon absorbing water with the voids between the fibers (space between the fibers) in the woven fabric or the knitted fabric being expanded, stain sticking to the fibers can be easily removed.

The aggregate of nanofibers of the present invention, when used in clothing applications, can produce fibrous articles having excellent hands such as sleekness of silk or dry feeling of rayon. Furthermore, fibrous articles that have ultra-soft feeling like peach skin, or soft and moist touch like human skin which have never been realized can be provided by separating the nanofibers from the aggregate of nanofibers by buffing or other process.

The aggregate of nanofibers of the present invention is preferably crystallized with orientational order. The degree of crystallization with orientational order can be evaluated by wide-angle X-ray diffraction (WAXD). It is preferable that the degree of crystallization is 25% or higher as measured by Rouland method, in order to suppress the heat shrinkage ratio of the fiber and improve the dimensional stability. The degree of crystallization is preferably 0.8 or higher which indicates well-oriented molecules and enables it to improve the strength of fibers.

The strength of the aggregate of nanofibers of the present invention is preferably 1 cN/dtex or higher, which makes it possible to improve the mechanical properties of the fibrous articles. The strength of the aggregate of nanofibers is more preferably 2 cN/dtex or higher. While the heat shrinkage ratio of the aggregate of nanofibers of the present invention can be varied in accordance to the application, drying heat shrinkage at 140° C. is preferably 10% or less when applied to clothing applications.

Various fibrous materials can be formed from the aggregate of nanofibers of the present invention. The term "fibrous material" refers to fibrous materials in general of one-dimensional, two-dimensional or three-dimensional structure. Examples of one-dimensional fibrous material include long fiber, short fiber, spun yarn and rod and so on. Examples of two-dimensional fibrous material include cloth such as woven or knitted fabric, nonwoven fabric and sheet and so on. Examples of three-dimensional fibrous material include clothes, net, thermally formed article and a wad of cut fibers and so on. A module or a final product made by combining any of these with other material is also included in this category.

It is preferable that the material of the present invention includes 10% by weight or more aggregate of nanofibers, which enables it to make full use of the excellent functions of the nanofiber such as the adsorption capability. The content of the aggregate of nanofibers is more preferably 50% by weight or more.

When the aggregate of nanofibers is used in such an application that requires the capability to retain the form of the article and durability after laundering, in particular, the mass per unit area of the fiber is preferably in a range from 20 to 2000 g/m$^2$. The mass per unit area of the fiber is the weight of fiber divided by the area of the fiber portion. The fabric can be lighter in weight as the mass per unit area of the fiber becomes smaller, although it results in a loose structure that is lower in dimensional stability and in durability. A larger value of the mass per unit area of the fiber means a heavier weight, although the structure becomes sturdier with higher dimensional stability and higher durability. According to the present invention, since the use of the nanofiber is likely result in lower dimensional stability and lower durability, it is preferable to set the mass per unit area of the fiber to 20 g/m$^2$ or more so as to maintain the dimensional stability and durability at satisfactory levels. A certain level of lightness can also be maintained by setting the mass per unit area of the fiber to 2000 g/m$^2$ or less. While the optimum value of the mass per unit area of the fiber varies depending on the type of the product, it is preferable that the nonwoven fabric or the like used in packaging is as light as 25 to 40 g/m$^2$, fabric for clothing is from 50 to 200 g/m$^2$, fabric for curtain or the like is from 100 to 250 g/m$^2$, fabric for car seat is from 100 to 350 g/m$^2$, and a heavy article such as carpet is from 1000 to 1500 g/m$^2$. The mass per unit area of the fiber of an article that requires laundering, in particular, is preferably 50 g/m$^2$ or more in order to prevent the article from deforming during laundering.

The fibrous material that includes the aggregate of nanofibers of the present invention may be an intermediate article such as yarn, a wad of cut fibers, package, woven fabric, knitted fabric, felt, nonwoven fabric, synthetic leather or sheet. It can also be preferably used as a fibrous article such as clothing, clothing materials, products for interior, products for vehicle interior, livingwares (wiping cloth, cosmetics and goods for beauty treatment, health-care products, toys, etc.), environment-elated and industrial materials (construction material, texturing cloth, filter, hazardous materials removing devices, etc.), IT components (sensor component, battery component, robot component, etc.) and medical devices (blood filter, extrasomatic circulation column, scaffold, wound dressing, artificial blood vessel, drug delivery device, etc.).

Most of the applications described above cannot be served by the nonwoven fabric that is made from the nanofibers manufactured by the electrospinning process due to insufficient strength, low dimensional stability, or insufficient size, but can be served only by the aggregate of nanofibers of the present invention. For example, clothing, products for interior, products for vehicle interior, texturing cloth, filter and various IT components require strength, and therefore can have the requirements thereof satisfied only by the aggregate of nanofibers of the present invention that has high strength of the yarn.

Also the requirements of most of the applications described above cannot be satisfied by the micro-fibers of the prior art due to insufficient adsorption or liquid absorbing capability, or insufficient size that leads to low texturing power or wipe-off performance.

To sum up, various problems of the micro-fibers of the prior art and the nonwoven fabric manufactured by electrospinning can be solved by the use of the aggregate of nanofibers of the present invention or articles made as derivatives thereof.

It is also preferable to encapsulate the aggregate of nanofibers of the present invention in the hollow space of a hollow fiber, which improves the shape stability of the fiber and the color developing performance of a dyed article. This is because the encapsulation prevents excessive aggregation of the nanofibers from occurring, thus suppressing the good properties that are intrinsic to the nanofiber from lowering. Furthermore, in the encapsulated structure, the nanofibers in the hollow space absorbs a force of bending the fiber and a pressure applied on the side face of the fiber like a cushion so as to develop uniquely soft hands like marshmallow. Thus the aggregate of nanofibers of the present invention is very useful for such applications as clothing, products for interior, products for vehicle interior, clothing materials and livingwares.

The density of the polymer for the hollow fiber used as the capsule is preferably 1.25 g/cm$^3$ or less, which enables the nanofibers encapsulated in the hollow space to fully demonstrate the adsorbing capability and liquid absorbing capability. This is because the low density of the hollow fiber means greater space between polymer molecule chains, which makes it easier for various liquids to pass therethrough. Polymers that are preferably used include PLA (1.25 g/cm$^3$), N6 (1.14 g/cm$^3$), N66 (1.14 g/cm$^3$), PP (0.94 g/cm$^3$), PE (0.95 g/cm$^3$) and polymethylpentene (PMP, 0.84 g/cm$^3$). The parenthesized figures are densities of the polymers. Density of the hollow fiber is more preferably 1.20 g/cm$^3$ or less. Density of the hollow fiber can be estimated by measuring the density of a sample formed by the hollow fiber only.

The hollow fiber is also preferably made of a hydrophilic polymer, which allows hydrophilic molecules such as water and alcohol molecules to pass therethrough. The polymer of the hollow fiber is deemed hydrophilic if the hollow fiber includes 2% or more water content when measured under standard conditions of 20° C. and relative humidity of 65%. The polymer of the hollow fiber is more preferably a polyamide such as N6 or N66.

It is also preferable that the hollow fiber has numerous fine pores having diameter of 100 nm or smaller disposed in the longitudinal direction, which makes it easier for various molecules to pass therethrough, and causes the nanofibers that are disposed in the hollow space to fully demonstrate the adsorbing capability and liquid absorbing capability. The diameter of the pore can be determined through observation of a cross section of the fiber under an electron microscope or through freezing point depression of water in the polymer. The diameter of the pore is preferably 50 nm or less, and more preferably 10 nm or less. The color developing capability can be restrained from decreasing when the fiber is dyed, by setting the pore size as described above. This pore size is particularly preferable since moisture adsorption is improved, in such a case as the hollow fiber is made of a hydrophilic polymer such as polyamide and has the fine pores in multitude.

While there is no restriction on the method for manufacturing the aggregate of nanofibers of the present invention, a method that uses a polymer alloy as a precursor as follows, for example, can be employed.

Two or more kinds of polymer having different levels of solubility to a solvent are alloyed, so as to form a molten polymer alloy that is spun and is cooled to solidify, thereby forming fibers. The fibers are subjected to drawing and heat treatment as required, thereby to obtain polymer alloy fibers that have an islands-in-sea structure. Then the aggregate of nanofibers of the present invention can be made by removing the high solubility polymer by means of the solvent. The polymer alloy fiber that can be preferably used as the precursor for the aggregate of nanofibers is as described below.

The polymer alloy fiber has islands-in-sea structure consisting of two or more kinds of organic polymers of different levels of solubility, wherein the island component is made of a low solubility polymer and the sea component is made of a high solubility polymer, a mean diameter of the island domains is in a range from 1 to 150 nm, 60%, in area ratio, or more of the island domains are in a range from 1 to 150 nm in diameter of the island domains, and the island components are distributed in linear configuration.

According to the present invention, it is important to form the islands-in-sea structure consisting of two kinds of organic polymers of different levels of solubility. The term "solubility" refers to the difference in the solubility to the solvent. The solvent may be an alkaline solution, an acidic solution, an organic solvent or a supercritical liquid.

Also according to the present invention, it is important to use the low solubility polymer for the island component and use the high solubility polymer for the sea component. By using a polymer that is highly soluble to an alkaline solution as the high solubility polymer, it is made unnecessary to install an explosion-proof equipment in the solving facility, which is preferable in view of cost and wider applications. The polymer that is highly soluble to an alkaline solution may be polyester, polycarbonate (hereinafter abbreviated as PC) or the like, while copolymerized PET or PLA is particularly preferable. It is also preferable to use a polymer that is soluble to hot water or a biodegradable polymer as the high solubility polymer, since it relieves the load of waste liquid treatment. As the polymer that is soluble to hot water, polyalkylene glycol, polyvinyl alcohol or a derivative thereof, copolymerized polyester having a large content of sodium-5-sulfoisophthalic acid or the like is used. Particularly preferable is a polymer that has improved heat resistance by elongating the molecular chain through ester bond of polyalkylene glycol or PET made by copolymerizing 10 mol % or more of odium-5-sulfoisophthalic acid. For the biodegradable polymer, PLA or the like may be used.

In consideration of the ease of processing the polymer alloy fiber to form a yarn, knitting or weaving and high level processing, it is preferable that the polymer that constitutes the sea component has a melting point of 160° C. or higher. In the case of an amorphous polymer of which melting point cannot be observed, however, it is preferable that a glass transition temperature ($T_g$), a Vicat softening temperature or a thermal deformation temperature is 160° C. or higher.

For the polymer that constitutes the island component, a polymer that can be suitably used for the aggregate of nanofibers described above may be used.

It is also important that the island component is formed in linear structure in view of the function as the nanofiber precursor. Since the island components distributed in linear structure support the thinning of the polymer alloy in such a manner as a reinforcing bar, it also stabilizes the thinning behavior of spinning. The term "linear structure" refers to the state of a fiber that has a length in the axial direction of the fiber at least four times the diameter of the fiber. The length of a fiber in the axial direction is usually ten times the diameter or more, and often extends beyond the scope of TEM observation.

While there is no restriction on the content of the island component in the polymer alloy fiber, the content of the island component is preferably 10% by weight or more of the polymer alloy fiber in order to form the nanofiber by dissolving the sea component. The content of the island component is more preferably 20% by weight or more. The content of the island component is preferably 50% by weight or less, since an excessive content of the island component reverses the relation between the islands and the sea, and causes the island component not to function as an island. In case a nonwoven fabric is formed by wet process of collecting fibers into a sheet, for example, satisfactory distribution can be achieved when the content of the island component is lower, and therefore the island component is preferably within 30% by weight.

Figure 2:
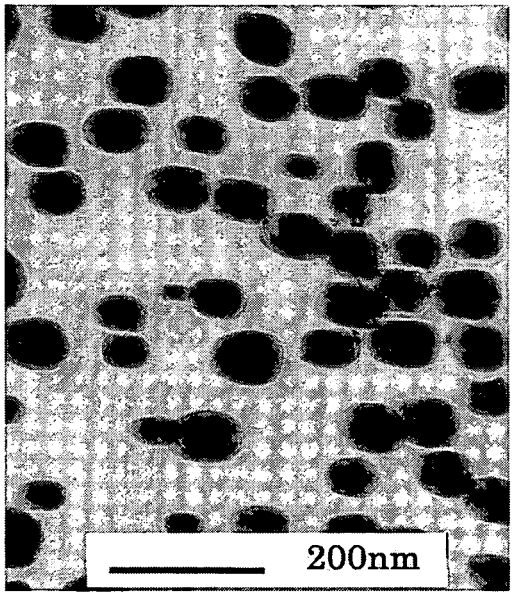
FIG. 2 is a TEM micrograph showing a cross section of polymer alloy fibers according to Example 1 of the present invention.

According to the present invention, number average and spread of diameters of the island domain in the polymer alloy fiber are important factors. These parameters can be evaluated similarly to the spread of single fiber fineness values of the nanofibers described previously. That is, a cross section of the polymer alloy fiber is observed by TEM, and diameters of 300 or more island domains that are randomly sampled in the same cross section are measured. An example of micrograph showing the cross section of the polymer alloy fiber according to the present invention is shown in FIG. 2. This measurement is made in at least five places, so as to measure the diameters of 1500 or more island domains in all. Positions to make these measurements are preferably separated by a distance of 10 m or more from each other in the longitudinal direction of yarn.

The number average of diameters is the simple mean of the diameters of the island domains that have been measured. It is important that the number average of diameters of the island domains is in a range from 1 to 150 nm. This makes it possible to obtain the nanofiber that has a level of fineness which can never been achieved in the prior art, after removing the polymer of the sea component. The number average of diameters of the island domains is preferably from 1 to 100 nm, more preferably from 20 to 80 nm.

The spread of the diameters of the island domains is evaluated as described below. The frequency (number) of the island domains is counted for each diameter. The area $S_i$ of each island domain is totaled to obtain the total area ($S_1+S_2+\ldots+S_n$). Product of the area of the frequency (number) of the same area S and the frequency is divided by the total area, to give the value of area ratio of island domains. For example, in case there are 350 island domains that have a diameter of 60 nm and the total area is $3.64\times10^6$ $nm^2$, then the area ratio becomes $(3.14\times30\ nm\times30\ nm\times350)/(3.64\times10^6\ nm^2)\times100\%=27.2\%$. The area ratio corresponds to the volume ratio of the island domains of each size to the entire island components included in the polymer alloy fiber. The island domain component that has a large value of area ratio has greater contribution to the property of the nanofiber that is formed. It is important for the island domains included in the polymer alloy fiber of the present invention, that 60%, in area ratio, or more of the island domains are in a range from 1 to 150 nm in diameter of the island domains. This means that the nanofibers having such a level of fineness can be made that can never been achieved in the prior art, as most of the single fibers are 150 nm or smaller in diameter of the island domains. It is preferable that the portions of high area ratio of island domains are concentrated in a component of the island domain having smaller diameters, and it is preferable that 60%, in area ratio, or more of the island domains are in a range from 1 to 100 nm in diameter of the island domains. The area ratio of the island domains that are in a range from 1 to 100 nm in diameter is preferably 75% or more, more preferably 90%, further more preferably 95% or more and most preferably 98% or more. Similarly, it is preferable that 60%, in area ratio, or more of the island domains are in a range from 1 to 80 nm in diameter, and it is more preferable that 75%, in area ratio, or more of the island domains are in a range from 1 to 80 nm in diameter.

Another measure of the spread of diameters of the island domains is the area ratio of island domains that are in a section having a width of 30 nm in diameter of island domains. As described above, frequency is counted for each diameter of the island domain, and the total area ratio of the island domains, and the total area ratio of the island domains that fall in the section having a width of 30 nm of the highest frequency is defined as the area ratio of the island domains that are in the section having a width of 30 nm. This means that the higher the area ratio in the section, the smaller the spread becomes. According to the present invention, area ratio of the island domains that are in the section having a width of 30 nm is preferably 60% or more, more preferably 70% or more, and further more preferably 75% or more.

While it has been described that the sizes and spread thereof of the island domains in the cross section of the polymer alloy fiber are important factors, it is also preferable that thick-fine unevenness in the longitudinal direction of yarn is smaller, in order to ensure the stability of quality of the fibrous article that is made of the nanofibers. In case the nanofibers are used in a texturing cloth, for example, thick-fine unevenness in the longitudinal direction of yarn often has a significant influence on the size and number of scratches (blemishes on the surface of the textured article). Accordingly, it is preferable to control the Uster unevenness of the polymer alloy fiber of the present invention to 15% or less, more preferably to 5% or less and most preferably to 3% or less.

It is preferable that the polymer alloy fiber of the present invention has a strength of 1.0 cN/dtex or higher and an elongation of 25% or higher, in order to minimize troubles such as the occurrence of fuzzing and yarn breakage in the process of crimping, twisting, knitting, weaving or the like. Strength is more preferably 2.5 cN/dtex or higher, and most preferably 3 cN/dtex or higher. It is preferable that the polymer alloy fiber has boiling water shrinkage of 25% or less, which suppresses the dimensional change of the cloth during dissolving of the sea component. The boiling water shrinkage is more preferably 15% or less.

The polymer alloy fiber of the present invention may also be a conjugated fiber made by combining the polymer alloy used as the nanofibers precursor and other polymer. For example, a unique fiber comprising a hollow fiber and nanofibers encapsulated in the hollow space of the former can be made by forming a core-in-sheath conjugated fiber constituted from the polymer alloy disposed at the core as the nanofibers precursor and other polymer disposed in the sheath, and then dissolving the sea component of the polymer alloy. When the relation of core and sheath is reversed, a mixed yarn constituted from an ordinary fiber surrounded by the nanofibers can be easily made. Also a mixed yarn of nanofibers and microfibers can be made easily by forming a yarn of islands-in-sea structure consisting of the polymer alloy used as the nanofibers precursor as the sea component and other polymer as the island component. In this way the mixed yarn of the nanofibers and the microfibers or ordinary fibers can be made easily. This constitution greatly improves the stability of the form of the fibrous material. In case the polymer used as the nanofibers and the other polymer have tendencies of electrification that are significantly different from each other, dispersion property of the nanofibers can be improved by means of electrostatic repulsion due to the difference in the potential of the fiber surface.

The polymer alloy fiber of the present invention can be made bulkier by the crimping process. In the case of a false-twisted yarn, the value of crimp rigidity (CR value) that is a measure of crimpability is preferably 20% or higher. In the case of mechanically crimped yarn, a yarn formed by air jet or the like, the number of crimps that is a measure of crimping is preferably five per 25 mm or more. Crimping can also be given by side-by-side constitution or forming an eccentric core-in-sheath conjugated fiber. In this case, the number of crimps is preferably ten per 25 mm or more. Value of CR can generally be controlled by means of false twisting conditions such as the method of crimping, type of crimping machine, revolutionary speed of the twister and heater temperature. The CR value of 20% or more can be achieved by setting the heater temperature to the melting point of the polymer minus 70° C. or higher. To improve the CR value further, it is effective to set the heater temperature higher.

The number of crimps of mechanically crimped yarn or a yarn formed by air jet or the like can be made five per 25 mm or more by appropriately selecting the crimping machine and setting the feed rate.

In the case of side-by-side constitution or an eccentric core-in-sheath conjugated fiber, the number of crimps of ten per 25 mm or more can be achieved by conjugated polymers having values of melt viscosity that are different twice or more, by setting the difference in the ratio of thermal shrinkage during individual spinning to 5% or more, or other means.

In order to obtain a polymer alloy fiber that hardly includes coarse island component and has the island component of nanometer order distributed uniformly, it is important to select such a combination that is based on proper consideration of the affinity and balance of viscosity between the polymers, a method that achieves high level of mixing and kneading, and a method of feeding the polymer.

The polymer alloy fiber of the present invention may be a long fiber made by melt spinning and drawing, or a short fiber made after mechanical crimping. The short fiber may either be spun or formed into a nonwoven fabric by needle punching or a wet process of forming a sheet from dispersed fibers. Moreover, an nonwoven fabric of long fibers can also be formed by spun bonding or melt blowing.

The polymer alloy fiber can be easily turned into a composite material by mixing with other fiber, mixing of cut fibers, spinning of mixed cut fibers, combined weaving, combined knitting, stacking or bonding. This enables it to greatly improve the stability of its shape when formed into nanofibers. It is also enabled to make further higher function by rendering composite functions.

When the nanofibers are formed by removing the sea component from the polymer alloy fiber that has a low content of island component, it makes a material very low in density, in which case practical levels of morphological stability and mechanical properties may not be obtained. These problems can be solved by mixing another fiber as a supporting material that is stable against the solvent used in the sea component dissolving process. While there is no restriction on the kind of supporting fiber, nylon, polyolefin or the like that is stable against the treatment with an alkaline solution may be preferably used in the case of the polymer alloy fiber consisting of nylon/polyester.

For example, when the polymer alloy fibers consisting of nylon/polyester and an ordinary nylon fibers are mixed to form a woven fabric or a knitted fabric that is then subjected to dissolving process to make a nylon nanofiber product, morphological stability and mechanical properties of this product can be greatly improved over a product made from the nylon nanofibers only, resulting in significantly improved ease of handling the nanofiber cloth.

An nonwoven fabric of the polymer alloy fibers may also be combined with an nonwoven fabric of other fibers stacked thereon to form a laminated nonwoven fabric, which is then subjected to dissolving process, thereby to obtain the laminated nonwoven fabric consisting of the nonwoven fabric of the polymer alloy fibers and the nonwoven fabric of other fibers. When an nonwoven fabric of PP is bonded onto the nonwoven fabric of polymer alloy fibers made of nylon/polyester, for example, morphological stability of the nylon nanofibers can be dramatically improved during dissolving of polyester with an alkali. When the polymer alloy fiber has a low content of nylon (island component), an article made from the polymer alloy fiber only has a very low density, that may not be practically sufficient in morphological stability and mechanical properties. Bonding the PP that is not soluble to alkali as a supporting material solves these problems. The laminated nonwoven fabric of nylon nanofiber/PP thus obtained has contradictory properties of high hydrophilicity and high bonding capability on the nylon side and hydrophobicity and low bonding capability on the PP side, that make it useful not only as an industrial material but also as a clothing material. A binder such as thermally adhesive fiber or the like may be used for lamination. Although the technique of making a nonwoven fabric by mixing cut fibers may be employed for simply improving the morphological stability and the mechanical properties, laminated nonwoven fabric is more preferable when high functionality is desired.

The polymer alloy fiber of the present invention is useful not only as the nanofibers precursor, but also as the polymer alloy fiber because the polymers having different properties are uniformly distributed therein at the order of nanometers. For example, insufficient heat resistance, that is the drawback of PLA, can be improved by dispersing nylon and/or polyester in PLA at the order of nanometers. Insufficient dimensional stability upon absorbing water, that is the drawback of nylon, can be improved by dispersing polyester in nylon at the order of nanometers. Brittleness, that is the drawback of PS, can be improved by dispersing nylon and/or polyester in polystyrene (hereinafter abbreviated as PS) at the order of nanometers. Insufficient dyeability, that is the drawback of PP, can be improved by dispersing nylon and/or polyester in PP at the order of nanometers.

The polymer alloy fiber of the present invention may be used, like the aggregate of nanofibers described previously, to form various fibrous materials. The fibrous material that includes the polymer alloy fiber of the present invention may be used as intermediate articles such as yarn, a wad of cut fibers, package, woven fabric, knitted fabric, felt, nonwoven fabric, synthetic leather and sheet. It may also be preferably used as clothing, clothing materials, products for interior, products for vehicle interior, livingwares, environment-related materials, industrial materials, IT components, medical devices and other fibrous articles.

It is important to control the island component size in the polymer alloy fiber that is the precursor for the aggregate of nanofibers. The island component size is evaluated as an equivalent diameter based on the observation of a cross section of the polymer alloy fiber under a transmission electron microscope (TEM). Since diameter of the nanofiber is substantially determined by the island size in the precursor, distribution of the island sizes is designed in accordance to the distribution of diameters of the nanofibers of the present invention. Therefore, it is very important to mix and knead the polymers to be alloyed and, according to the present invention, it is preferable to carry out high level of mixing and kneading by means of an extrusion kneader or a static mixer. In the case of the simple chip blending (dry blending) employed in the prior art examples such as that disclosed in Japanese Unexamined Patent Publication No. 6-272114, the materials are not sufficiently mixed and kneaded and therefore it is difficult to disperse the islands of several tens of nanometers as in the present invention.

For this reason, it is preferable to carry out high level of mixing and kneading using a twin-screw extrusion-kneader or a static mixer having a number of splits of $100\times10^{-4}$ or more. It is also preferable to weigh the individual polymers separately and feed the polymers separately into the mixer, in order to prevent uneven blending from occurring and prevent the blend ratio from changing with time. In this case, the polymers may be fed separately in the form of pellets, or may be charged separately in the molten state. Moreover, two or more kinds of polymers may be fed to a bottom portion of the extrusion-kneader, or one of these components may be fed midway in the extrusion kneader in a side feed operation.

In case the twin-screw extrusion-kneader is used as the kneader, it is preferred that the polymers are highly kneaded while reducing the residence time of the polymers. The screw comprises a feeding section and a kneading section. The length of the kneading section is preferably set at 20% or more of the effective length of the screw for highly kneading the polymers. The length of the kneading section is preferably set at 40% or less of the effective length of the screw. This avoids excessively high shear stress and shortens the residence time, thus preventing thermal degradation of the polymers and/or gelation of the polyamide component. The kneading section is preferably disposed at a position near the discharge port of the twin-screw extruder thereby to shorten the residence time after kneading and to prevent reaggregation of the islands-part polymer. In addition, a screw having a back-flow function to feed the polymers in a reverse direction may be arranged in the extrusion-kneader, for further higher kneading.

By using a bent-type kneader to aspirate a decomposed gas during kneading and/or to reduce the moisture in the polymers, the polymers are prevented from hydrolyzing, and the amount of terminal amino groups in a polyamide or terminal carboxylic acid groups in a polyester can be reduced.

The b* value as an indicator of coloring of the polymer alloy pellets is preferably 10 or less, since the resulting fiber can have homogenous hue. Such a polymer soluble in hot water generally has poor thermal stability and is susceptible to coloring due to its molecular structure. However, the coloring can be prevented by shortening the residence time.

The kneader may be arranged separately from a spinning machine, so that polymer alloy pellets produced in the kneader is fed to the spinning machine. Alternatively, the kneader may be directly connected to a spinning machine, so that kneaded and molten polymers are directly spun. When a static mixer is used as the kneader, it may be placed in a piping of the spinning machine or in a spinning pack.

The chip blending (dry blending) can be carried out in the following manner for reducing the cost of the spinning process.

Initially, polymer pellets to be blended are independently weighed and fed to a blending tank and are chip-blended therein. The blending tank preferably has a capacity of 5 to 20 kg for efficient blending while avoiding uneven blending. The blended pellets are fed from the blending tank to an extrusion-kneader, to obtain a molten polymer. The kneading may be carried out by using a twin-screw extrusion-kneader or by feeding the molten polymer into a static mixer arranged in a piping or a pack. Master pellets containing a larger amount of the higher soluble polymer can be used.

The residence time from formation and melting of the polymer alloy to discharge from a spinneret is a key factor for inhibiting the reaggregation of the islands-part polymer in spinning to thereby reduce coarsely aggregated polymer particles. Thus, the residence time for the polymer alloy from the tip of a melting section to the spinneret is preferably set within 30 minutes.

The combination of polymers is an important factor to disperse the islands-part polymer at the order of nanometers. Specifically, a combination of a lower soluble polymer and a higher soluble polymer with a higher affinity allows the higher soluble polymer to disperse as nano-sized islands more easily. In order to form the island domains having substantially circular cross sections, the island component and the sea component are preferably incompatible to each other. However, it is difficult to disperse the nano-sized islands by simply using a combination of mutually incompatible polymers. Thus it is preferable to optimize the compatibility of the polymers to be combined, which can be indicated by the solubility parameter (SP value). The SP value is a parameter that represents the cohesion force of a material and is defined as (vaporizing energy/molar volume)$^{1/2}$. Materials having proximate values of SP are likely to make polymer alloy of good compatibility. SP values of various polymers have been known, and are given in, for example, "Plastic Data Book", coedited by Asahi Kasei AMIDAS Co., Ltd. and the editorial staff of the Plastics, p189. It is preferable that the difference in the SP value between two polymers is in a range from 1 to 9 $(MJ/m^3)^{1/2}$, which makes it easier to achieve both circular cross section of the island domain and the dispersion of nano-sized islands through the use of incompatible polymers. A preferable example of combination is N6 and PET, of which SP values have a difference of about 6 $(MJ/m^3)^{1/2}$. An example of combination that is not preferable is N6 and PE of which SP values have a difference of about 11 $(MJ/m^3)^{1/2}$. It needs not to say that affinity between different polymers can be controlled to some extent by combining various methods of copolymerization and compatibility agent.

In order to mix and knead with high efficiency, it is preferable that melting points of the island component polymer and the sea component polymer have a difference not larger than 20° C., in which case there occurs no significant difference in the melting of the polymers in the extrusion kneader. While it is necessary to control the mixing temperature and the spinning temperature to low levels when a polymer that is susceptible to thermal decomposition and/or thermal degradation is used as one of the polymers, use of polymers having smaller difference in the melting point is advantageous also for solving this problem.

The melt viscosity is also an important factor. The island component tends to disperse on the order of nanometers due to a higher tendency of the island component to deform under a shear force, when the low solubility polymer that makes the island component has lower melt viscosity, which is undesirable for making nanofibers. However, an excessively low viscosity may turn the island component into sea component, making it difficult to achieve a high blending ratio of the entire fiber. Therefore, it is preferable that the melt viscosity of the polymer that makes the island component is 0.1 times the melt viscosity of the polymer that makes the sea component, and this ratio is more preferably in a range from 0.5 to 1.5.

An absolute value of the melt viscosity of the high solubility polymer that makes the sea component is also an important factor. The high solubility polymer preferably has a low viscosity of 100 Pa·s or less. This not only makes it easier to disperse the island polymer but also allows the polymer alloy to deform smoothly during the spinning process, thus significantly improving the spinnability compared to the case of using a polymer of ordinary value of viscosity. The melt viscosity of the polymer mentioned here is the value as measured at the spinneret surface temperature with shear rate of 1216 $sec^{-1}$.

Since the island component and the sea component are incompatible to each other in the polymer alloy, the island components are more thermodynamically stable when cohered. However, in order to forcibly disperse the polymer as nano-sized islands, the polymer alloy has more polymer interfaces that are more unstable than a conventional polymer blend having larger dispersion sizes. As a result, when this polymer alloy is simply spun, the existence of a number of polymer interfaces leads to such problems as "Barus phenomenon" in which the polymer flow swells immediately after the polymer is discharged through the spinneret, and insufficient stringiness due to destabilization of the polymer alloy surface. This not only causes excessive thick-thin unevenness of the yarn but also makes it impossible to spin. In order to avoid such problems, it is preferable to control the shear stress between the spinneret orifice wall and the polymer being discharged through the spinneret to 0.2 MPa or less. The shear stress between the spinneret orifice wall and the polymer is calculated by Hagen-Poiseuille's law that dictates that the shear stress (dyne/$cm^2$) is given as $R \times P/2L$, where R is the radius of the spinneret orifice (cm), P is the pressure loss at the spinneret orifice (MPa) and L is the length of the spinneret orifice (cm). Pressure loss is calculated as $P=8L\eta Q/\pi R^4$, where $\eta$ is the viscosity of the polymer (poise), Q is the discharge flow rate ($cm^3$/sec) and $\pi$ is the circular constant. 1 dyne/$cm^2$ in the CGS unit system corresponds to 0.1 Pa in the SI unit system.

In the melt spinning of a single component of the ordinary polyester, weighability and stringiness can be maintained even when the shear stress between the spinneret orifice wall and the polymer is 1 MPa or higher. However, unlike the ordinary polyester, the polymer alloy of the present invention tends to lose the balance of viscoelasticity with the polymer alloy when the shear stress between the spinneret orifice wall and the polymer is high, and therefore requires a lower shear stress than in the case of melt spinning of the ordinary polyester. The shear stress is preferably 0.2 MPa or less, since this makes the flow on the spinneret orifice side and the polymer flow speed at the center of the spinneret orifice uniform, so that a decreased shear strain leads to the mitigation of the Barus phenomenon, thus resulting in satisfactory stringiness. The shear stress is more preferably 0.1 MPa or less. The shear stress can be decreased generally by increasing the diameter of the spinneret orifice and/or decreasing the length of the spinneret orifice. However, when the diameter is increased and/or the length is decreased excessively, weighability of the polymer at the spinneret orifice decreases and fineness unevenness tends to appear between the orifices. Therefore, it is preferable to use such a spinneret that has a polymer weighing section having an orifice of diameter smaller than that of the spinneret orifice, provided above the spinneret orifice. It is preferable to control the shear stress between the spinneret orifice wall and the polymer to 0.01 MPa or higher, since this enables stable melt spinning of the polymer alloy fiber and decreases the Uster unevenness (U %) that represents the thick-thin unevenness of the yarn to 15% or less.

As described above, it is important to decrease the shear stress during discharge from the spinneret orifice when melt-spinning the polymer alloy of uniformly dispersed constitution of nanometer sizes used in the present invention, while it is also preferable to properly set the yarn cooling conditions. In the melt sinning of the ordinary polyester, it is a common practice to gradually cool in order to avoid elastic vibration. According to the present invention, however, since the polymer alloy of uniformly dispersed constitution of nanometer sizes is a very unstable molten fluid, it is preferably cooled and solidified immediately after being discharged from the spinneret. Distance between the bottom of the spinneret and the point where cooling begins is preferably in a range from 1 to 15 cm. By setting the distance between the bottom of the spinneret and the point where cooling begins at 1 cm or more, temperature unevenness over the spinneret surface is suppressed so that a yarn with suppressed thick-thin unevenness is obtained. By setting the distance to 15 cm or less so that the polymer alloy quickly solidifies, the yarn can be suppressed from being thinned randomly in an unstable manner and stringiness is improved, so that a yarn with suppressed thick-thin unevenness is obtained. The point where cooling begins is the position where positive cooling of the yarn begins, and it is located at the top end of the cooling equipment in an actual melt spinning machine.

In order to ensure stringiness and stability of spinning during the melt spinning operation, temperature at the spinneret surface (surface temperature at the center of the spinneret discharge face) is preferably the melting point (Tm) of the majority component polymer plus 20° C. or higher. It is more preferable to set the temperature at the spinneret surface to the melting point (Tm) of the majority component polymer plus 80° C. or lower, in which case thermal decomposition of the polymer is suppressed.

In order to decrease the number average diameter of the island domains in the polymer alloy fiber, draft during the spinning process should be as high as possible, preferably 100 or higher. For this reason, it is preferable to carry out high-speed spinning.

The polymer alloy fiber that has been spun is preferably subjected to drawing and heat treatment processes. Preheating temperature during drawing is preferably set to the glass transition temperature (Tg) of the polymer that constitutes the island component for suppressing the occurrence of yarn unevenness. A yarn processing treatment such as crimping may also be applied to the polymer alloy fiber. It is preferable to set the heat treatment temperature during the crimping process so as not to exceed the melting point of the polymer that constitutes the sea component minus 30° C., in order to suppress fusing, yarn breakage and napping.

The preferable method of melt spinning the polymer alloy fiber according to the present invention can be summarized as follows.

A method for manufacturing a polymer alloy fiber through melt spinning of the polymer alloy that is made by melt blending of low solubility polymer and high solubility polymer, wherein the following conditions (1) to (3) are satisfied:

(1) the low solubility polymer and the high solubility polymer that have been weighed independently are fed separately into a kneader and are blended in the molten condition;

(2) the content of the low solubility polymer in the polymer alloy is in a range from 10 to 50% by weight; and (3) the melt viscosity of the high solubility polymer is 100 Pa·s or lower, or difference in the melting point between the high solubility polymer and the low solubility polymer is in a range from −20 to +20° C.

When the melt blending is carried out in a twin-screw extrusion-kneader, the length of the kneader portion of the twin-screw extrusion-kneader is preferably from 20 to 40% of the effective length of a screw.

When the melt blending is carried out in a static mixer, the number of splits carried out in the static mixer is preferably $100\times10^{-4}$ or more.

A method for melt-spinning the polymer alloy fiber wherein, in case chip blending is employed when blending and melt-spinning the low solubility polymer and the high solubility polymer, a blending tank is provided prior to melting of the pellets so as to temporarily store two or more kinds of pellets and carry out dry blending, then the dry-blended pellets are fed to the melting section, wherein the following conditions (4) to (6) are satisfied:

(4) the blending ratio of the low solubility polymer in the fiber is from 10 to 50% by weight;

(5) the melt viscosity of the high solubility polymer is 100 Pa·s or lower, or difference in melting point between the high solubility polymer and the low solubility polymer is in a range from −20 to +20° C.

(6) the capacity of the pellet blending tank is from 5 to 20 kg.

The manufacturing method of the present invention enables it to manufacture the polymer alloy fiber wherein the island component is uniformly distributed in sizes of several tens of nanometers in diameter and the yarn unevenness is insignificant, by optimizing the combination of the polymers and the conditions of spinning and drawing. By using the polymer alloy fiber, that has less unevenness in the longitudinal direction of yarn, as the precursor as described above, it is made possible to provide the aggregate of nanofibers that has small spread of single fiber fineness values in any of the sections in the longitudinal direction. Also according to the method for manufacturing the aggregate of nanofibers of the present invention, unlike the nanofibers manufactured by the electrospinning, it is made possible for the first time to apply drawing and heat treatment processes to the nanofibers by applying drawing and heat treatment processes to the polymer alloy fiber that is the precursor. This has made possible to control the tensile strength and the shrinkage ratio at will. As a result, it is made possible to obtain the nanofibers that have good mechanical properties and the shrinkage performance as described above.

The aggregate of nanofibers is obtained by dissolving the high solubility polymer that is the sea component by means of a solvent from the polymer alloy fiber obtained as described above. In this process, it is preferable to use a water-soluble solvent in order to mitigate the load on the environment. Specifically, an aqueous alkaline solution or hot water is preferably used as the solvent. Accordingly, the high solubility polymer is preferably a polymer such as polyester that is hydrolyzed by alkali, or a polymer that is soluble to hot water such as polyalkylene glycol, polyvinyl alcohol or a derivative thereof.

Dissolving of the high solubility polymer may be carried out at the stage of yarn or a wad of cut fibers, at the stage of cloth such as woven fabric, knitted fabric or nonwoven fabric, or at the stage of thermally formed article. The aggregate of nanofibers can be manufactured with a high productivity by setting the dissolving rate of the polymer alloy fiber at 20% by weight per hour.

The aggregate of nanofibers can be divided into morphology like filament-yarn and/or morphology like spun yarn and further dispersed in the form of individual nanofibers by means of a nonwoven fabric formed by the wet process of forming sheet from dispersed fibers as described below. After cutting the polymer alloy fibers to length of 10 mm or less, the high solubility polymer is dissolved and the nanofibers thus obtained are assembled into a sheet without drying, thereby to manufacture the nonwoven fabric. With this method, the aggregate of nanofibers having diameters down to 1 μm and less can be fully dispersed. Furthermore, the aggregate of nanofibers having diameters down to 300 nm and less can be dispersed when a dispersion solution that has high affinity with the polymer of the nanofiber is used.

The aggregate of nanofibers of the present invention has high adsorption/absorption capability, and therefore can support various functional chemicals. The term "functional chemical" refers to a material that is capable of improving the function of the fiber, such as moisture adsorbent, moisturizing agent, flame retarding agent, water repellant agent, cold insulator, lagging material and smoothing agent. The functional chemical is not limited to the form of particulate, and may be a health or beauty promoting agent such as polyphenol, amino acids, protein, capsaicin, vitamins, or medicine for skin disease such as athlete's foot. Disinfectant, anti-inflammatory medicine, analgesic or other medicine may also be used. Moreover, a chemical that adsorbs or decomposes a hazardous material may also be used such as polyamide and photocatalyst nano-particles.

There is also no restriction on the method of supporting the functional chemical. For example, the functional chemical may be supported on the nanofibers by post-treatment process such as bath treatment or coating, or may be included in the polymer alloy fiber that is the precursor of the nanofiber. The functional chemical may also be supported directly on the aggregate of nanofibers, or the precursor of the functional chemical may be supported on the nanofibers and then transformed into a desired functional chemical.

In a specific example of the latter method, the aggregate of nanofibers may be impregnated with an organic monomer that is thereafter polymerized, or the aggregate of nanofibers may be impregnated with a high solubility material in bath treatment with the high solubility material being thereafter turned to low solubility by oxidation-reduction reaction, ligand substitution, counter ion exchange reaction or the like. For the organic monomer, various organic monomers and metal alkoxide that is partially substituted with hydrocarbon may be used. When a precursor of the functional chemical is supported during the spinning process, such a method may also be employed as the precursor having a molecular structure of high heat resistance is used during the spinning process and is changed into a molecular structure that demonstrates the function in a subsequent process.

A cloth, that is made of the conventional polyester fibers with a moisture adsorbent based on polyethylene glycol (hereinafter abbreviated as PEG) having a molecular weight of 1000 or more added thereto so as to attain hygroscopicity, can hardly show exhaustive absorption capability. A cloth, made of the nanofibers of the present invention with the same moisture adsorbent added, in contrast, can exhaustively absorb a large amount of moisture.

In recent years, squalene, natural oil that can be extracted from shark liver is attracting much attention as a material that has skin-care function by keeping the skin moist. Squalene can also be hardly absorbed exhaustively by the cloth made of the conventional polyester fibers. Although the cloth made of the nanofibers of the present invention can exhaustively absorb a large amount of squalene. Moreover, durability against laundering can be greatly improved. This is a surprising fact for one who has been dealing with the conventional polyester fibers.

The aggregate of nanofibers impregnated with alkyl-substituted metal alkoxide and is then polymerized may support silicone polymer or silicone oil, which shows satisfactory durability against laundering. Supporting silicone on fibers with high durability, that has been very difficult with the prior art technology, is made possible for the first time by the aggregate of nanofibers of the present invention. Similarly, hybrid constitution with other organic material such as polyurethane is made possible.

The aggregate of nanofibers of the present invention is not only capable of incorporating various functional chemicals, but also has high releasing capability. By using the various functional chemicals described above, the aggregate of nanofibers can be applied to a good matrix for releasing or a drug delivery system.

When a monomer or an oligomer that has inorganic polymer forming capability is absorbed by the aggregate of nanofibers of the present invention and is then polymerized, the inorganic material is incorporated within the aggregate of nanofibers. That is, an organic/inorganic hybrid fiber having the inorganic material dispersed in the aggregate of nanofibers is obtained. The content of the nanofibers in the hybrid fibers can be controlled so as to obtain the desired performance by changing the amount of the inorganic monomer absorbed therein. For the monomer or the oligomer that has inorganic polymer forming capability, metal alkoxide, oligomer thereof, metal salt solution or the like may be used. While the monomer or the oligomer is preferably of such a type that proceeds polymerization upon heating, in view of productivity, such a type may also be employed that is made insoluble by oxidation-reduction reaction, counter ion exchange or ligand exchange in a solution. Examples of the former include silicate, and examples of the latter include platinum chloride and silver nitrate etc.

Thus the organic/inorganic hybrid fiber that includes 5 to 95% by weight of the aggregate of nanofibers and includes, at least in part thereof, portions where the inorganic material is dispersed in the aggregate of nanofibers is obtained. Detailed state of the organic/inorganic hybrid fiber is such that the inorganic material infiltrates into the space between the nanofibers in such a manner as if the inorganic matter bound the nanofibers together, or the nanofibers are dispersed in the matrix of the inorganic material. In this constitution, the inorganic material penetrates continuously from the surface to the inside of the organic/inorganic hybrid fiber so as to fully demonstrate the function thereof. In the case of the hybrid fibers comprising the nanofibers and hygroscopic silica, for example, high moisture adsorbing capability and high moisture adsorbing rate of the silica can be utilized.

The content of the nanofibers in the organic/inorganic hybrid fiber of the present invention is preferably in a range from 5 to 95% by weight. In this range, properties of the inorganic material and flexibility of the organic fibers can be maintained at the same time. Content of the nanofibers is more preferably from 20 to 90% by weight, and most preferably from 25 to 80% by weight.

The organic/inorganic hybrid fiber of the present invention can be used, not only as a one-dimensional fiber, but also in a two-dimensional fibrous material such as woven/knitted fabric or nonwoven fabric, and sheet. It needs not to say that the organic/inorganic hybrid fiber can be used to form a three-dimensional material such as plaited cord, thermally formed material or a wad of cut fibers.

Impregnation of the aggregate of nanofibers with the inorganic monomer may be carried out by such a method as a monomer solution is prepared and the aggregate of nanofibers is dipped therein, and a facility for high level of processing such as dying or coating of ordinary fibrous materials can be used. The solution may be an aqueous solution, an organic solvent or a supercritical fluid.

The monomer that impregnates the aggregate of nanofibers is polymerized preferably by low temperature polymerization such as sol-gel method so as not to raise the temperature beyond the melting point of the nanofibers, in order to prevent the nanofibers from melting or cohering due to fluidity. When reducing the metal chloride, too, it is preferable to carry out the reduction at a temperature below the melting point of the nanofibers under mild conditions by avoiding the use of a strong acid or a strong alkali so that the nanofiber would not be changed. Detailed description of the sol-gel method can be found, for example, in "The Science of Sol-gel Method" (written by Sumio SAKIBANA, Agne Shofu Publishing Inc.).

While the organic/inorganic hybrid fiber of the present invention can be used as it is, it may also be processed to remove the nanofiber component therefrom and form a porous fiber of the inorganic material.

It is important that 90% by weight or more of the inorganic porous fiber is an inorganic material such as a metal, a metal oxide, a metal halide or a metal complex, in order to improve the heat resistance. Mean diameter of the pores is preferably in a range from 1 to 5000 nm in the direction of the minor axis in the cross section, in order to increase the specific surface area, improve the adsorbing capability and/or decrease the weight. Mean diameter of the pores is more preferably in a range from 1 to 100 nm. The term "direction of the minor axis in the cross section" means the radial direction of the nanofiber used as the template.

The length of the inorganic porous fiber is preferably 1 mm or more, for maintaining the shape of the fibrous material. Fiber length is more preferably 10 cm or more.

The nanofiber component may be removed by calcination so as to gasify the nanofiber, or extracting by means of a solvent. Calcination temperature may be in a range from 500 to 1000° C., although it depends on the organic polymer component. Since calcination generally causes the material to shrink, size of the pore left after removing the nanofibers can by controlled by means of the calcination temperature. Calcination can be carried out in a known facility that is used for processing silica or metal oxide such as titania, or for processing carbon fibers. In the case of removal by extraction, a solvent that highly dissolves an organic polymer may be used. For example, an acid such as formic acid may be used in case the organic polymer is nylon, an alkaline solution or a halogen-based organic solvent such as orthochlorophenol may be used in the case of polyester, and an organic solvent such as toluene may be used in the case of PP. For the extracting equipment, a facility for high level processing of woven material that is known in the prior art may be used.

The organic/inorganic hybrid fiber or the inorganic porous fiber of the present invention can take various forms of fibrous material such as woven/knitted fabric, unwove fabric or other cloth, or thermally formed material, similarly to the aggregate of nanofibers described previously, and therefore can be used in various applications such as cloth, module or lamination with other material. The adsorbing capability and the moisture adsorbing capability of the material can be utilized in the form of interior products such as curtains, wall paper, carpets, mats and furniture, or chemical filters for removing chemical contaminants in a clean room. Deodorant sheets used in toilets or living rooms, vehicle interior materials for improving the environment in the vehicle, specifically upholstery of seats and lining for the ceiling may also be made from the material. Moreover, clothes, cups, pads and other clothing materials that are comfortable and have deodorant property can also be made. Moreover, an electromagnetic radiation shielding material that utilizes the electrical conductivity of the metal, industrial materials such as filter or sensor and medical devices such as cell adsorbing material can be made.

The present invention will now be described in detail by way of the following examples. The physical properties in the examples were determined by the following methods.

A. Melt Viscosity of Polymer:

The melt viscosity of a sample polymer was determined using Capillograph 1B available from Toyo Seiki Seisaku-Sho, Ltd. The residence time of the sample polymer from charging of the sample to the beginning of determination was set at 10 minutes.

B. Melting Point:

The melting point was defined as the peak top temperature at which a sample polymer melted in a second run as determined using Perkin Elmaer DSC-7 at a temperature scanning rate of 16° C. per minute, with an amount of the sample of 10 mg.

C. Shear Stress at the Spinneret Orifice

The shear stress between the spinneret orifice wall and the polymer was calculated by Hagen-Poiseuille's law that dictates that the shear stress (dyne/cm$^2$) is given as $R \times P/2L$, where R is the radius of the spinneret orifice (cm), P is the pressure loss at the spinneret orifice (dyne/cm$^2$) and L is the length of the spinneret orifice (cm). Pressure loss is calculated as $P=8L\eta Q/\pi R^4$, where $\eta$ is the viscosity of the polymer (poise), Q is the discharge flow rate (cm$^3$/sec) and $\pi$ is the circular constant. The value of polymer viscosity at the temperature (° C.) of the spinneret orifice and shear rate (sec$^{-1}$) is used.

1 dyne/cm$^2$ in the CGS unit system corresponds to 0.1 Pa in the SI unit system. In case kneading and spinning were continuously carried out (Examples 8 to 16, Comparative Examples 2 to 4), the melt viscosity of the polymer alloy was measured by the Capillograph 1B after sampling guts made by quickly cooling, at a position 10 cm below the spinneret, and solidifying the spun yarn without taking it up.

D. Uster Unevenness (U %) of Polymer Alloy Fiber:

The Uster unevenness was determined using USTER TESTER 4 available from Zellweger Uster in a normal mode at a yarn feed speed of 200 meters per minute.

E. TEM Observation of Cross Section of Fiber:

Ultrathin peaces of a sample fiber in a cross-sectional direction were prepared, and the cross sections of the fiber were observed using a transmission electron microscope (TEM). Where necessary, the sections were subjected to metal staining.

TEM device: Model H-7100FA available from Hitachi, Ltd.

F. Single fiber Fineness and Single fiber diameter of Nanofibers by Number-average The mean value of single fiber fineness was determined in the following manner. The diameters of single fibers and single fiber fineness were determined from TEM photographs of the cross section of the fiber using an image processing software (WINROOF), and the values were averaged. The mean values are defined as the diameters of single fibers and single fiber fineness by number average. Single fiber diameters of 300 or more nanofibers that are randomly sampled in the same cross section were measured. This measurement was made in at least five places separated by a distance of 10 m or more from each other, so as to measure the diameters of 1500 or more single fibers in all.

G. Spread of Single fiber Fineness Values of Nanofibers

Spread of single fiber fineness values of the nanofibers is evaluated in the following manner. Single fiber fineness $dt_i$ of each single fiber is totaled to obtain the total fineness ($dt_1+dt_2+\ldots+dt_n$), using the data used in determining the single fiber fineness by number average. By counting the frequency (number) of nanofibers that have the same value of fineness, product of the value of single fiber fineness and the frequency divided by the total fineness is taken as the fineness ratio of this value of single fiber fineness.

H. Spread of Diameters of Nanofibers

Spread of diameters of the nanofibers is determined in the following manner. That is, the spread of diameters of the nanofibers is evaluated by the fineness ratio of the single fibers having a diameter within a section having a width of 30 nm near the median of the single fiber diameter. This represents the concentration of the diameters around the median, and larger value thereof means less spread. This value of spread is also determined by using the data that were used to determine the single fiber fineness by number average. That is, frequency is counted for each diameter of the single fiber, and the summation of fineness ratio of the single fibers that fall in the section having a width of 30 nm of the highest frequency is defined as the fineness ratio of the single fibers that are in the section having a width of 30 nm in diameter of the single fibers.

I. Number-Average of Diameters of Island Domains

The number average of island domains is determined in the following manner. The diameters of the island domains in terms of equivalent circle were determined from TEM photographs of the cross section of the fiber using the image processing software (WINROOF), and the values were averaged. Diameters of 300 or more island domains that were randomly sampled in the same cross section were measured. This measurement was made at five points separated by a distance of 10 m or more from each other in the longitudinal direction of the polymer alloy yarn, so as to measure the diameters of 1500 or more island domains in all.

J. Spread of Diameters of Island Domains

Spread of diameters of the island domains is determined in the following manner. By using the data used in determining the number average diameter described above, cross sectional area $S_i$ of each island component is totaled to obtain the total area ($S_1+S_2+\ldots+S_n$). Product of the frequency (number) of the island domains having the same diameter (area) and the area is divided by the total fineness ratio, to give the area ratio of the island domain.

K. Spread of Diameters of Island Domains

Spread of diameters of the island domains is determined in the following manner. The area ratio of the island domains that fall within a zone of 30 nm in the island domain diameter near the median of the number average of diameters of the island domains or in the portion of high area ratio is determined. This value of spread is also determined by using the data that were used to determine the single fiber diameter by number average. That is, frequency is counted for each diameter of the island domains, and the total area ratio of the island domains that fall in the section having a width of 30 nm of the highest frequency is defined as the area ratio of the island domains that fall in the section having a width of 30 nm. For example, a section from 55 to 84 nm is a section having a width of 30 nm in the spread of diameters of the island domains not smaller than 55 nm and not larger than 84 nm. The area ratio represents the area ratio of the island domains that fall in the section of diameters.

L. SEM Observation

Side surface of the fiber coated with platinum-palladium alloy by vapor deposition was observed under a scanning electron microscope.

SEM device: Model S-4000 available from Hitachi, Ltd.

M. Mechanical Properties

Weight of 10 m segment of the aggregate of nanofibers was measured for five segments, and mean value thereof was used to determine the fineness (dtex) of the aggregate of nanofibers. For the polymer alloy fiber, yarn skeins 100 m long were sampled and five skeins are weighed so as to determine the fineness (dtex) from the mean value. Then at the room temperature (25° C.), load-elongation curve was determined under the conditions specified in JIS L1013 with the initial sample length of 200 mm and drawing speed of 200 mm per minute. Then the load at rupture was divided by the initial fineness to give the strength. Elongation at break was divided by the initial sample length to give the elongation ratio, and accordingly the strength-elongation curve was determined.

N. Wide Angle X-ray Diffraction Pattern

WAXD plate photograph was taken under the following conditions by using an X-ray diffraction apparatus model 4036A2 available from Rigaku Denki Co., Ltd.

X-ray source: Cu—Kα line (Ni filter)
Output power: 40 kV×20 mA
Slit: 1 mmϕ pin hole collimator
Camera radius: 40 mm
Exposure time: 8 minutes
Film: Kodak DEF-5

O. Crystalline Size

Diffraction intensity along the equator line was measured under the following conditions by using an X-ray diffraction apparatus model 4036A2 available from Rigaku Denki Co., Ltd.

X-ray source: Cu—K line (Ni filter)
Output power: 40 kV×20 mA
Slit: 2 mmϕ−1°−1°
Detector: Scintillation counter
Count recorder: Model RAD-C of Rigaku Denki Co., Ltd.
Scanning step: 0.05°
Integration time: 2 seconds Crystalline size L in the orientation of (200) plane was calculated by the Scherrer's equation described below.

$$L=K\lambda/(\beta_0 \cos \theta_B)$$

L: Crystalline size (nm)
K: Constant (=1.0)
λ: Wavelength of X-ray (0.15418 nm)
$\theta_B$: Bragg angle $$\beta_O=(\beta_E^2-\beta_I^2)^{1/2}$$

$\beta_E$: Apparent half width (measured value)
$\beta_I$: Instrument constant ($1.046\times10^{-2}$ rad)

P. Crystalline Orientation

Crystalline orientation in the direction of (200) plane was determined in the following manner.

Using the same apparatus as that used in the measurement of crystalline size described above, the peak corresponding to the (200) plane was scanned along the circumference to determine the intensity distribution, from the half value of which the crystalline orientation was calculated by the following equation.

$$\text{Crystalline orientation}(\pi)=(180-H)/180$$

H: Half width (degs.)

Measurement range: 0-180°

Scanning step: 0.5°

Integration time: 2 seconds

Q. Degree of Crystallization (χ) Measured by Rouland Method

<Preparation of Sample>

The sample was cut into pieces using a thin knife blade and pulverized by freeze grinding into fine powder. The powder was put into a sample holder (20 mm×18 mm×1.5 mm) made of aluminum, and was measured.

<Measuring Instrument>

X-ray generator: Model RU-200 (Opposing rotary cathode type) of Rigaku Denki Co., Ltd.

X-ray source: CuKα line (w/curved graphite crystal monochromator)

Output power: 50 kV, 200 mA

Goniometer: Model 2155D of Rigaku Denki Co., Ltd.

Slit: 1°-0.15 mm-1°-0.45 mm

Detector: Scintillation counter

Count recorder: Model RAD-B of Rigaku Denki Co., Ltd.

2q/q: Continuous scan

Measurement range: 2q=5-145°

Sampling: 0.02°

Scanning speed: 2°/min.

<Analysis>

Degree of crystallization was determined by the Rouland method. Degree of crystallization (χ) was calculated by the following equation.

$$x=\frac{\int_0^\infty s^2 Ic(s)\,ds}{\int_0^\infty s^2 I(s)\,ds}\cdot\frac{\int_0^\infty s^2 \overline{f}^2\,ds}{\int_0^\infty s^2 \overline{f}^2 D\,ds}$$

$$D=\exp(-ks^2)$$

s: Wave number (=2 sin θ/λ)

λ: Wavelength of X-ray (Cu: 1.5418 Å)

I(s): X-ray intensity of coherent scatter from the sample

Ic(s): X-ray intensity of coherent scatter from the crystal $\overline{f}^2$: Square mean atomic scattering factor Analysis was carried out using data obtained by correcting the measured data with polarization factor, absorption factor and scatter by air. Then the effect of Compton scatter was removed and amorphous curve was separated, thereby to determine the degree of crystallization from the intensity ratio of the crystalline diffraction peak to the non-crystalline scatter.

R. Boiling Water Shrinkage Ratio

Ten-turn skein is made by winding the sample around a wrap reel having peripheral length of 1 m. With a load of one tenth the total fineness suspended from the skein, the initial length (L0) is measured. Then the skein with the load removed therefrom is immersed in a water bath boiling at 98° C. for 15 minutes. Then after drying the skein in air, length of the skein (L1) after treatment is measured under the load of one tenth the total fineness. Boiling water shrinkage ratio is calculated by the following equation.

$$\text{Boiling water shrinkage ratio}(\%)=((L0-L1)/L0)\times 100\%$$

S. 140° C. Dry Heat Shrinkage Ratio

A sample having markings at a distance of 10 cm from each other is heated without load in an oven at 140° C. for 15 minutes. Then the distance between the markings (L2) is measured and the shrinkage ratio is calculated by the following equation.

$$140^\circ\text{ C. dry heat shrinkage ratio}(\%)=((L0-L2)/L0)\times 100\%$$

T. Ratio of Moisture Adsorption (ΔMR):

About one to two grams of a sample is weighed in a weighing bottle, dried at 110° C. for 2 hours, and the weight of the dried sample (W0) is determined. Next, the sample substance is held at 20° C. with relative humidity of 65% for 24 hours, and its weight is then measured (W65), and the sample substance is then held at 30° C. with relative humidity of 90% for 24 hours, and its weight is then measured (W90). The ratio of moisture adsorption ΔMR is calculated according to the following equations.

$$MR65=[(W65-W0)/W0]\times 100\% \quad (1)$$

$$MR90=[(W90-W0)/W0]\times 100\% \quad (2)$$

$$\Delta MR=MR90-MR65 \quad (3)$$

U. Reversible Elongation at Absorbing Water and Percentage of Elongation in Longitudinal Direction of Yarn:

The original length (L3) of a sample fiber is determined after drying the fiber at 60° C. for 4 hours. The fiber is immersed in water at 25° C. for 10 minutes and is taken out, and the length of the fiber after treatment (L4) is determined immediately thereafter. The length of the fiber after drying (L5) is then determined after drying the fiber at 60° C. for 4 hours. The procedure of drying and immersion in water is repeated a total of three times. The sample is evaluated to have reversible elongation at absorbing water when it shows a percentage of elongation in the longitudinal direction of the yarn in the third procedure of 50% or more of that in the first procedure. The percentage of elongation in a longitudinal direction of the yarn is determined by calculation according to the following equation. The length of the fiber is determined by binding the sample fiber with two colored yarns at an interval of about 100 mm, and measuring the length between the two yarns.

Percentage of elongation (%) in longitudinal direction of the yarn=((L4−L3)/L3)×100(%)

V. Number of Crimps:

A sample fiber 50 mm long was sampled, the number of crimps (peaks) per 25 mm was counted, and the number of crimps was defined as one half of the above-determined value.

W. Color Tone (b*):

The color tone b* was determined using a MINOLTA SPECTROPHOTOMETER CM-3700d with a light source of $D_{65}$ (color temperature of 6504 K.) in a visual field of 10 degrees.

Example 1

A N6 (20% by weight) and a copolymerized PET (80% by weight) were melted and kneaded in a twin-screw extrusion-kneader at 260° C. to obtain polymer alloy chips having a b* value of 4. The N6 had a melt viscosity of 53 Pa·s (262° C. at a shear rate of 121.6 $sec^{-1}$), a melting point of 220° C., and an amount of terminal amino groups of $5.0\times10^{-5}$ molar equivalent per gram as a result of blocking amine terminals with acetic acid. The copolymerized PET had a melt viscosity of 310 Pa·s (262° C. at a shear rate of 121.6 $sec^{-1}$) and a melting point of 225° C., had been copolymerized with 8% by mole of isophthalic acid and 4% by mole of bisphenol A. The copolymerized PET had a melt viscosity of 180 Pa·s at 262° C. and a shear rate of 1216 $sec^{-1}$. The kneading conditions were as follows.

Screw type: one-direction fully interlocking double shred

Screw: diameter of 37 mm, effective length of 1670 mm, L/D=45.1

The length of the kneading section was 28% of the effective length of the screw.

The kneading section was arranged on the discharge side of a point one third of the effective length of the screw.

Three back flow sections in the midway

Feed of polymer: N6 and the copolymerized PET were independently weighed and were separately fed to the kneader.

Temperature: 260° C.

Vent: 2 points

Figure 12:
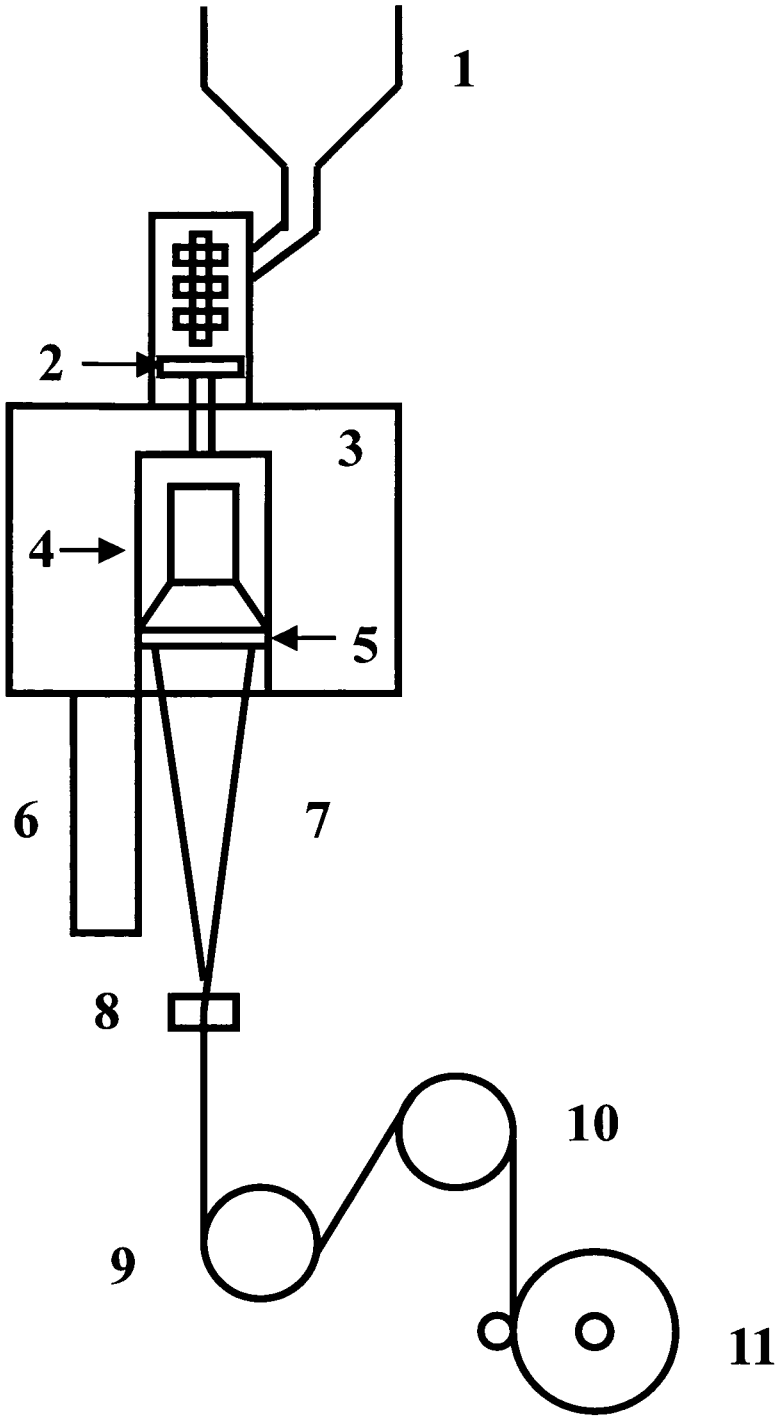
FIG. 12 is a diagram showing a spinning machine.
Figure 13:
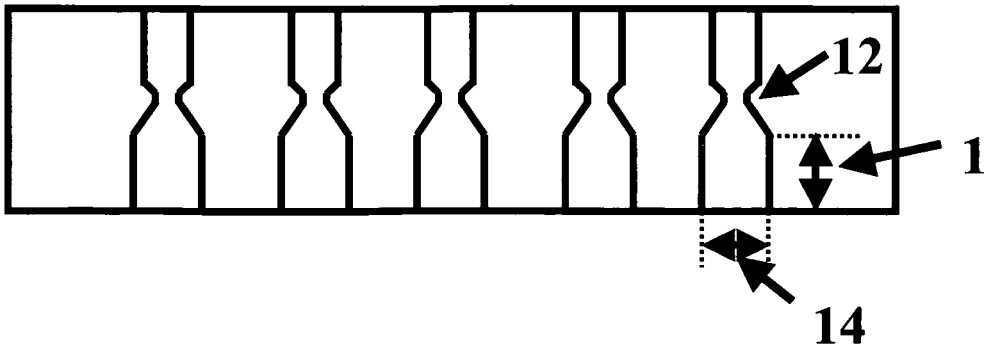
FIG. 13 is a diagram showing a spinneret.
Figure 14:
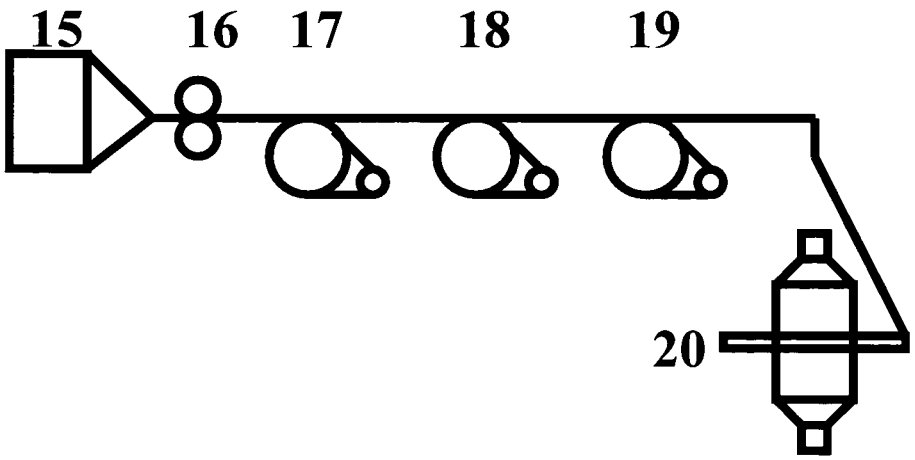
FIG. 14 is a diagram showing a drawing machine.

The polymer alloy chips were spun by a spinning machine shown in FIG. 12, thereby to obtain polymer alloy fibers. The polymer alloy chips from a hopper 1 were melted in a melting section 2 at 275° C. and introduced to a spin block 3 that included a spinning pack 4 at a spinning temperature of 280° C. The molten polymer alloy was filtrated through a metallic nonwoven fabric having a max hole diameter of 15 μm and subjected to melt spinning through a spinneret 5 of which surface temperature was set to 262° C. The spinneret 5 had a weighing section 12, 0.3 mm in diameter, located above an orifice, with orifice diameter 14 of 0.7 mm and an orifice length 13 of 1.75 mm, as shown in FIG. 13. A discharge rate per orifice was set to 1.0 g per minute. A shear stress between the spinneret orifice and the polymer was sufficiently low at 0.058 MPa (viscosity of the polymer alloy was 140 Pa·s at 262° C. and shear rate of 416 $sec^{-1}$). The distance from the bottom surface of the spinneret to the cooling start point (top end of the cooling equipment 6) was 9 cm. The discharged thread 7 was cooled and solidified by a cooling air at 20° C. over one meter, fed with an oil by an finishing guide 8 arranged 1.8 meter down the spinneret 5 and was wound through a first take-up roller 9 and a second take-up roller 10, that were not heated, at a rate of 900 meters per minute, thereby to obtain an undrawn yarn package 11 weighing 6 kg. In this procedure, the fiber showed good spinnability and was broken only once during the spinning of 1*t*. The undrawn yarn of the polymer alloy fibers were subjected to heat drawing treatment by a drawing machine shown in FIG. 14. The undrawn yarn 15 was fed by a feed roller 16 and was drawn and annealed by a first hot roller 17, a second hot roller 18 and a third roller 19, thereby to obtain a drawn yarn 20. The temperatures were set to 90° C. for the first hot roller 17 and 130° C. for the second hot roller 18. Drawing ratio between the first hot roller 17 and the second hot roller 18 was set to 3.2. The polymer alloy fibers thus obtained showed good properties of 120 dtex, 36-filament, 4.0 cN/dtex in strength, 35% in elongation, U %=1.7% and 11% in boiling water shrinkage. Observation of a cross section of the polymer alloy fiber under a TEM showed an islands-in-sea structure where the copolymerized PET (light portion) formed the sea and the N6 (dark portion) formed the islands (FIG. 2). The diameter of the N6 island domain by number average was 53 nm, indicating that the N6 was uniformly dispersed on the nanometer order in the polymer alloy fiber.

The polymer alloy fibers thus obtained were formed into a round braid that was immersed in a 3% aqueous solution of sodium hydroxide (90° C., bath ratio 1:100) for two hours, thereby to remove 99% or more of the copolymerized PET from the polymer alloy fibers by hydrolysis. The round braid comprising solely of N6 yarn showed a macroscopic appearance of continuous long fiber and maintained the form of round braid, despite the fact that the copolymerized PET constituting the sea component was removed. Moreover, quite unlike a round braid formed from an ordinary N6 fiber, this round braid did not show the slimy touch of nylon but showed the sleekness of silk or dry feeling of rayon.

Figure 4:
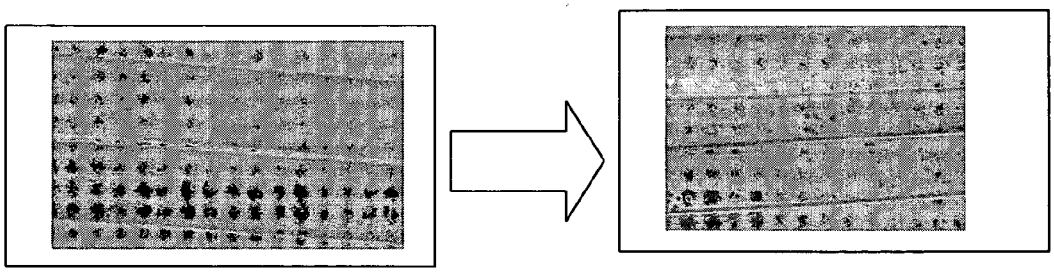
FIG. 4 is an optical micrograph showing the state of side view of fibers of the aggregate of nanofibers according to Example 1 of the present invention.
Figure 5:
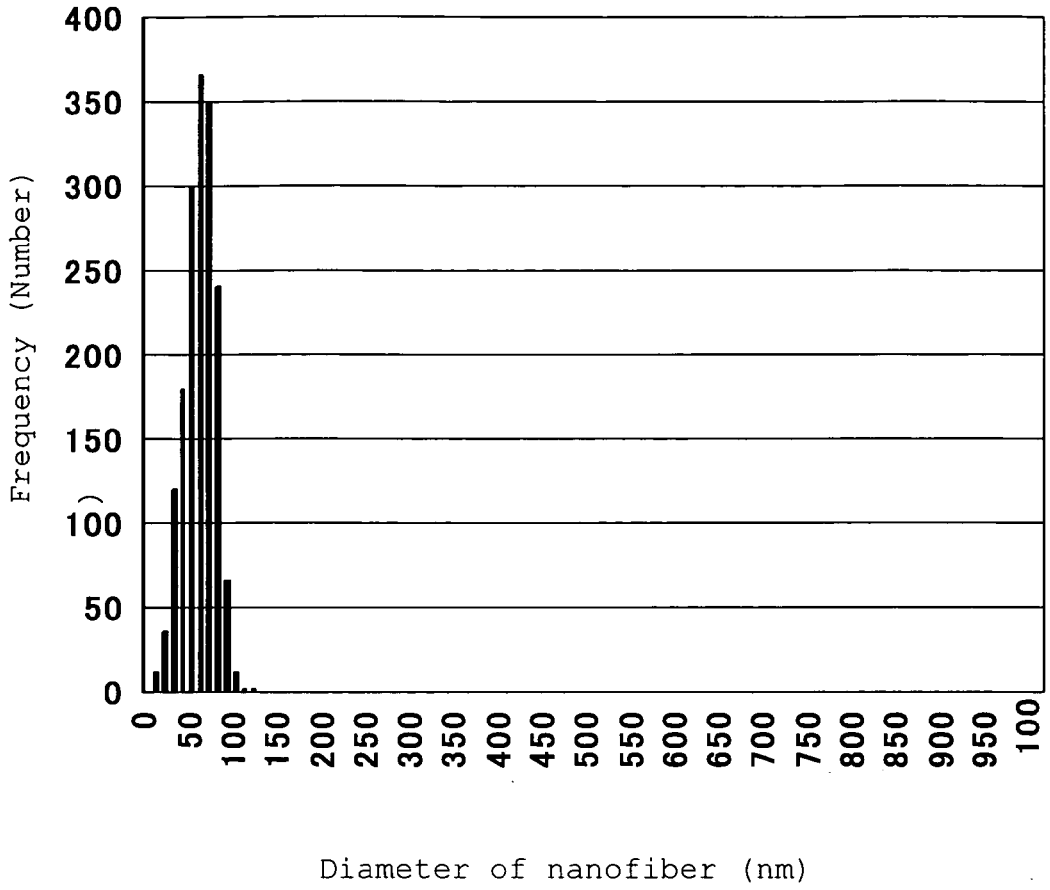
FIG. 5 is a graph showing the spread of single fiber fineness values of the nanofibers according to Example 1 of the present invention.
Figure 6:
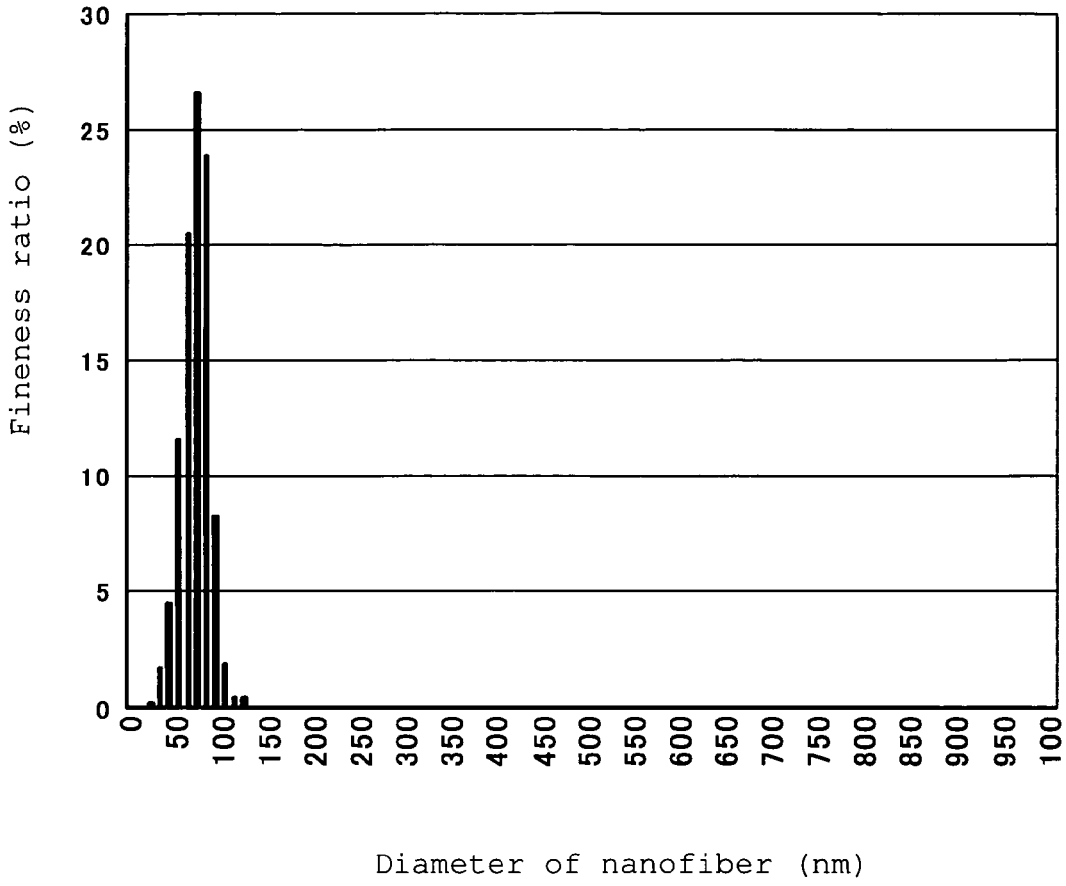
FIG. 6 is a graph showing the spread of single fiber fineness values of the nanofibers according to Example 1 of the present invention.

A yarn was drawn out of the round braid comprising solely of N6 yarn, and was observed on the side surface of the fiber under an optical microscope. The diameter of the fiber had been reduced to about two thirds that of the state before alkali treatment, showing that the fiber shrank in the radial direction when the sea component was removed (FIG. 4). Then observation of the side surface of the fiber under an SEM showed that the yarn was not a single yarn, but an aggregate of nanofibers having morphology like spun yarn that was constituted from numerous coagulated nanofibers (FIG. 3). Spacing between the nanofibers in the N6 aggregate of nanofibers was from about several nanometers to several hundreds of nanometers, with extremely small voids existing between the nanofibers. Picture of a cross section of the fiber under a TEM shown in FIG. 1 indicates that single fiber diameter of the N6 nanofiber is about several tens of nanometers. The nanofiber had such an unprecedented fineness as the single fiber diameter by number average was 56 nm ($3\times10^{-5}$ dtex). The fineness ratio of single fibers having single fiber fineness by number average was in a range from $1\times10^{-7}$ to $1\times10^{-4}$ dtex (equivalent to single fiber diameter from 1 to 105 nm) was 99%. Particularly, fineness ratio of single fibers having diameter in a range from 55 to 84 nm was 71%, with very small spread of single fiber fineness values. Histograms of the single fiber diameters and single fiber fineness of the nanofibers determined from the TEM photograph are shown in FIG. 5 and FIG. 6. Number (frequency) and fineness ratio were determined for each section having a width of 10 nm in diameter of the single fiber. That is, single fibers having diameters in a range from 55 to 64 nm were counted as single fiber having diameter of 60 nm, and single fibers having diameters in a range from 75 to 84 nm were counted as single fiber having diameter of 80 nm.

Figure 11:
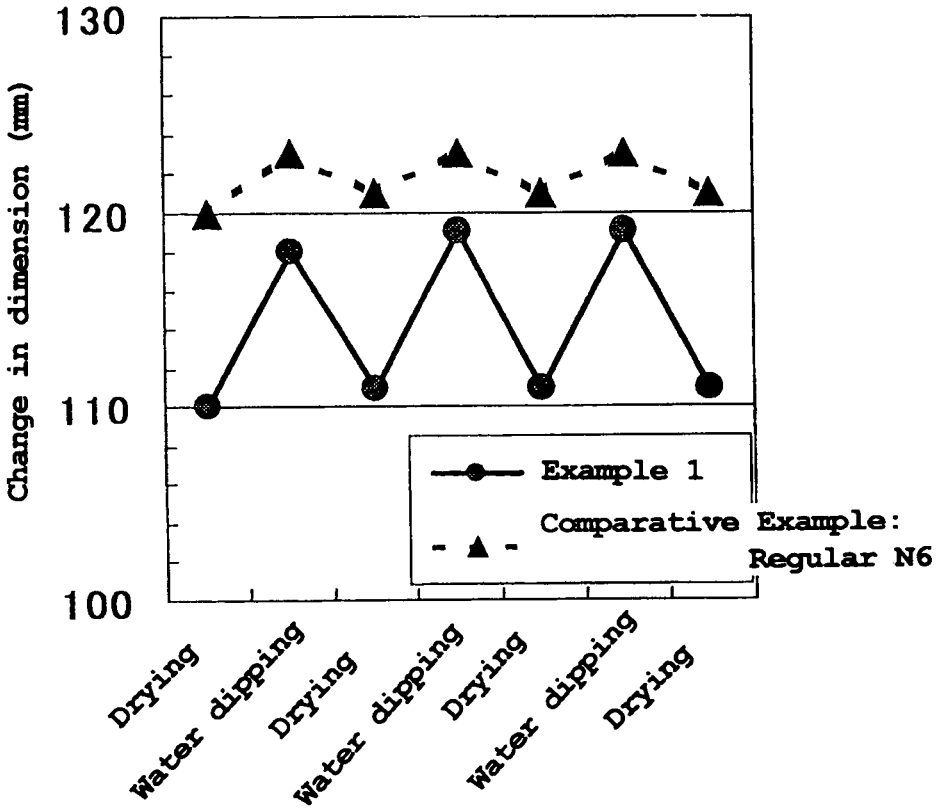
FIG. 11 is a graph showing reversible elongation/contraction at absorbing water in Example 1 of the present invention.

The measurement of the ratio of moisture adsorption (ΔMR) of the round braid consisting solely of the N6 showed a high moisture adsorbing capability of 6%, surpassing that of cotton. Further, a yarn comprising the aggregate of N6 nanofibers was drawn out of the round braid, and various physical properties were measured. The yarn showed such a rate of elongation in the longitudinal direction of yarn at absorbing water, that indicated a reversible repetition of swelling upon absorbing water and shrinkage upon drying (FIG. 11). The rate of elongation in the longitudinal direction of yarn at absorbing water was 7%, far higher than 3% in the case of the ordinary N6 fiber. Measurement of mechanical properties of the yarn comprising the aggregate of N6 nanofibers showed a strength of 2.0 cN/dtex and an elongation of 50%. 140° C. dry heat shrinkage ratio was 3%. Wide angle X-ray diffraction photograph of this yarn showed that the polymer was crystallized with ordered orientation, and a sufficiently high ratio of crystalline orientation of 0.85. However, as the yarn comprising the aggregate of nanofibers drawn out of the round braid was crimped as a whole, the measured value includes an influence of disorientation caused by the crimping, and the actual ratio of crystalline orientation would be higher. The degree of crystallization measured by Rouland method was 55%, a little higher than that of the ordinary N6 fiber.

When the round braid was buffed, it showed excellent hands providing ultra-soft feeling like peach skin, or soft and moist touch like human skin which have never been realized by the ultrafine fibers of the prior art.

Example 2

Polymer alloy chips having a b* value of 4 were obtained using a twin-screw extrusion-kneader similarly to Example 1, except for using a N6 (20% by weight) having a melt viscosity of 212 Pa·s (262° C. at a shear rate of 121.6 $sec^{-1}$) and an amount of terminal amino groups of $5.0\times10^{-5}$ molar equivalent per gram as a result of blocking amine terminals of a melting point of 220° C. with acetic acid. The polymer chips were subjected to the melt spinning process similarly to Example 1, except for setting the discharge rate per orifice to 1.0 gram per minute and shear stress between the spinneret orifice and the polymer at 0.071 MPa (viscosity of the polymer alloy was 170 Pa s at 262° C. and at a shear rate of 416 $sec^{-1}$). In this procedure, the fiber showed good spinnability and was broken only once during the spinning of 1*t*. The undrawn yarn of the polymer alloy was drawn similarly to Example 1, except for setting the drawing ratio to 3.0, thereby to obtain polymer alloy fibers having good properties of 128 dtex, 36-filament, 4.1 cN/dtex in strength, 37% in elongation, U %=1.2% and 11% in boiling water shrinkage. Observation of a cross section of the polymer alloy fiber thus obtained under a TEM showed islands-in-sea structure where the copolymerized PET formed the sea and the N6 formed the islands similarly to Example 1. The diameter of the N6 island domain by number average was 40 nm, indicating that the N6 was uniformly dispersed on the nanometer order in the polymer alloy fiber.

The polymer alloy fibers thus obtained were subjected to alkali treatment similarly to Example 1, and an aggregate of nanofibers of morphology like spun yarn was obtained. Spread of single fiber fineness values of the nanofibers was analyzed similarly to Example 1, showing that the nanofiber had such an unprecedented fineness as the single fiber diameter by number average was 43 nm ($2\times10^{-5}$ dtex), with very small spread of single fiber fineness values.

The ratio of moisture adsorption (ΔMR) of a round braid formed from the aggregate of nanofibers was 6%, and the rate of elongation in the longitudinal direction of yarn at absorbing water was 7%. A yarn comprising the aggregate of N6 nanofibers showed a strength of 2.2 cN/dtex and an elongation of 50%. 140° C. dry heat shrinkage ratio was 3%.

When the round braid was buffed, it showed excellent hands providing ultra-soft feeling like peach skin, or soft and moist touch like human skin which have never been realized by the ultrafine fibers of the prior art.

Example 3

Melt spinning was carried out similarly to Example 2, except for using a N6 (20% by weight) having a melt viscosity of 500 Pa·s (262° C. at a shear rate of 121.6 $sec^{-1}$) and a melting point of 220° C. Then melt spinning was carried out similarly to Example 1, except for setting the shear stress between the spinneret orifice and the polymer at 0.083 MPa (viscosity of the polymer alloy was 200 Pa·s at 262° C. and at a shear rate of 416 $sec^{-1}$), thereby to obtain an undrawn yarn of polymer alloy. In this procedure, the fiber showed good spinnability and was broken only once during the spinning of 1*t*. The undrawn yarn was drawn and subjected to annealing similarly to Example 2, thereby to obtain polymer alloy fibers having good properties of 128 dtex, 36-filament, 4.5 cN/dtex in strength, 37% in elongation, U %=1.9% and 12% in boiling water shrinkage. Observation of a cross section of the polymer alloy fiber under a TEM showed islands-in-sea structure where the copolymerized PET formed the sea and the N6 formed the islands similarly to Example 1. The diameter of the N6 island domain by number average was 60 nm, indicating that the N6 was uniformly dispersed on the nanometer order in the polymer alloy fiber.

The polymer alloy fibers thus obtained were subjected to alkali treatment similarly to Example 1, and an aggregate of nanofibers having morphology like spun yarn was obtained. The spread of single fiber fineness values of the nanofibers was analyzed similarly to Example 1, showing that the nanofiber had such an unprecedented fineness as the single fiber diameter by number average was 65 nm ($4\times10^{-5}$ dtex), with very small spread of single fiber fineness values.

The ratio of moisture adsorption (ΔMR) of a round braid formed from the aggregate of nanofibers was 6%, and the rate of elongation in the longitudinal direction of yarn at absorbing water was 7%. A yarn comprising the aggregate of N6 nanofibers showed a strength of 2.4 cN/dtex and an elongation of 50%. 140° C. dry heat shrinkage ratio was 3%.

When the round braid was buffed, it showed excellent hands providing ultra-soft feeling like peach skin, or soft and moist touch like human skin which have never been realized by the ultrafine fibers of the prior art.

Example 4

Melt spinning was carried out similarly to Example 3, except for setting the content of N6 to 50% by weight of the entire polymer alloy. Then melt spinning was carried out similarly to Example 3, except for setting the shear stress between the spinneret orifice wall and the polymer at 0.042 MPa, thereby to obtain an undrawn yarn of polymer alloy. In this procedure, the fiber showed good spinnability and was broken only once during the spinning of 1*t*. The undrawn yarn was drawn and subjected to annealing similarly to Example 3, thereby to obtain polymer alloy fibers having good properties of 128 dtex, 36-filament, 4.3 cN/dtex in strength, 37% in elongation, U %=2.5% and 13% in boiling water shrinkage. Observation of a cross section of the polymer alloy fiber under a TEM showed islands-in-sea structure where the copolymerized PET formed the sea and the N6 formed the islands similarly to Example 1. The diameter of the N6 island domain by number average was 80 nm, indicating that the N6 was uniformly dispersed on the nanometer order in the polymer alloy fiber.

The polymer alloy fibers thus obtained were subjected to alkali treatment similarly to Example 1, and an aggregate of nanofibers having morphology like spun yarn was obtained. Spread of single fiber fineness values of the nanofibers was analyzed similarly to Example 1, showing that the nanofiber had such an unprecedented fineness as the single fiber diameter by number average was 84 nm ($6\times10^{-5}$ dtex), with very small spread of single fiber fineness values.

A yarn comprising the aggregate of N6 nanofibers showed a strength of 2.6 cN/dtex and an elongation of 50%.

Comparative Example 1

An islands-in-sea composite yarn was made according to a method described in Example 1 of Japanese Unexamined Patent Publication No. 53-106872, using a PET having a melt viscosity of 180 Pa·s (290° C. at a shear rate of 121.6 $sec^{-1}$) and a melting point of 255° C. as the island component, and a polystyrene (PS) having a melt viscosity of 100 Pa·s (290° C.

at a shear rate of 121.6 $sec^{-1}$) and a Vicat softening temperature of 107° C. as the sea component. This yarn was treated with trichloroethylene so as to remove 99% or more of the PS according to a method described in Example of Japanese Unexamined Patent Publication No. 53-106872, thereby to obtain an ultrafine yarn. TEM observation of a cross section of the fiber showed a large single fiber diameter of 2.0 μm (0.04 dtex).

Comparative Example 2

A N6 having a melt viscosity of 50 Pa s (280° C. at a shear rate of 121.6 $sec^{-1}$) and a melting point of 220° C. and a PET having a melt viscosity of 210 Pa·s (280° C. at a shear rate of 121.6 $sec^{-1}$) and a melting point of 255° C. were blended in chips with the content of the N6 set to 20% by weight. Then melt spinning was carried out similarly to Example 1, except for melting at 290° C., setting the spinning temperature to 296° C. and the surface temperature of the spinneret to 280° C. and using a straight spinneret having 36 orifices, an orifice diameter of 0.30 mm and an orifice length of 50 mm. An undrawn yarn was wound at a spinning rate of 1000 m/min. Because of the simple chip blending operation and a large difference in the melting point between the polymers, a significant blending unevenness of the N6 and the PET and a significant Barus under the spinneret were observed. While the yarn could not be wound stably due to low stringiness, a small quantity of undrawn yarn was obtained and was drawn similarly to Example 1 with temperature of the first hot roller 17 set to 85° C. and the drawing ratio set to 3 times, thereby to obtain a drawn yarn of 100 dtex and 36-filament.

This yarn was formed into a round braid similarly to Example 1, and was also subjected to alkali treatment to remove 99% or more of the PET component. A yarn comprising solely of N6 was drawn out of the round braid. TEM observation of a cross section of the fiber showed that an ultrafine yarn having single fiber diameter of 400 nm to 4 μm (single fiber fineness from $1\times10^{-3}$ to $1\times10^{-1}$ dtex) was formed. However, it showed single fiber fineness by number average of a large value of $9\times10^{-3}$ dtex (single fiber diameter of 1.0 μm). The N6 ultrafine yarn also showed a large spread of single fiber fineness values.

Comparative Example 3

Figure 15:
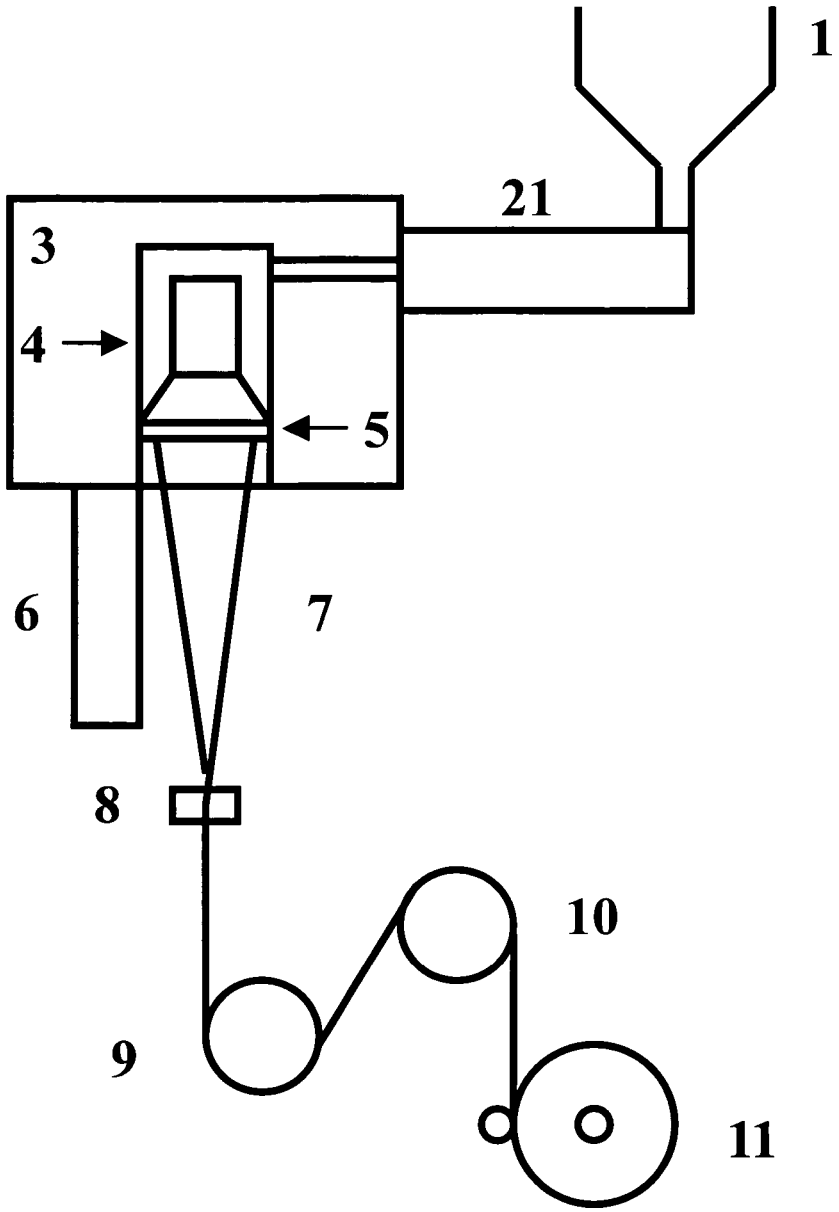
FIG. 15 is a diagram showing a spinning machine.

A N6 having a melt viscosity of 395 Pa·s (262° C. at a shear rate of 121.6 $sec^{-1}$) and a melting point of 220° C. and a PE having a melt viscosity of 56 Pa·s (262° C. at a shear rate of 121.6 $sec^{-1}$) and a melting point of 105° C. were blended in chips with the content of the N6 set to 65% by weight. Then after melting by using an apparatus shown in FIG. 15, setting the temperature of a single-screw extrusion kneader 21 at 260° C., melt spinning was carried out similarly to Example 1, except for using a straight spinneret having 12 orifices, an orifice diameter of 0.30 mm and an orifice length of 50 mm. A significant blending unevenness of the N6 and the PE and a significant Barus under the spinneret were observed. While the yarn could not be wound stably due to low stringiness, a small quantity of undrawn yarn was obtained and was drawn and was subjected to annealing similarly to Example 1, thereby to obtain a drawn yarn of 82 dtex and 12-filament. The drawing ratio was set to 2.0.

This yarn was formed into a round braid similarly to Example 1, and was subjected to dissolving treatment with toluene at 85° C. for one hour or more to remove 99% or more of the PE component. A yarn comprising solely of N6 was drawn out of the round braid. TEM observation of a cross section of the fiber showed that an ultrafine yarn having single fiber diameter of 500 nm to 3 μm (single fiber fineness $2\times10^{-3}$ to $8\times10^{-2}$ dtex) was formed. However, it showed single fiber fineness by number average of a large value of $9\times10^{-3}$ dtex (single fiber diameter of 1.0 μm). The N6 ultrafine yarn also showed a large spread of single fiber fineness values.

Comparative Example 4

Figure 17:
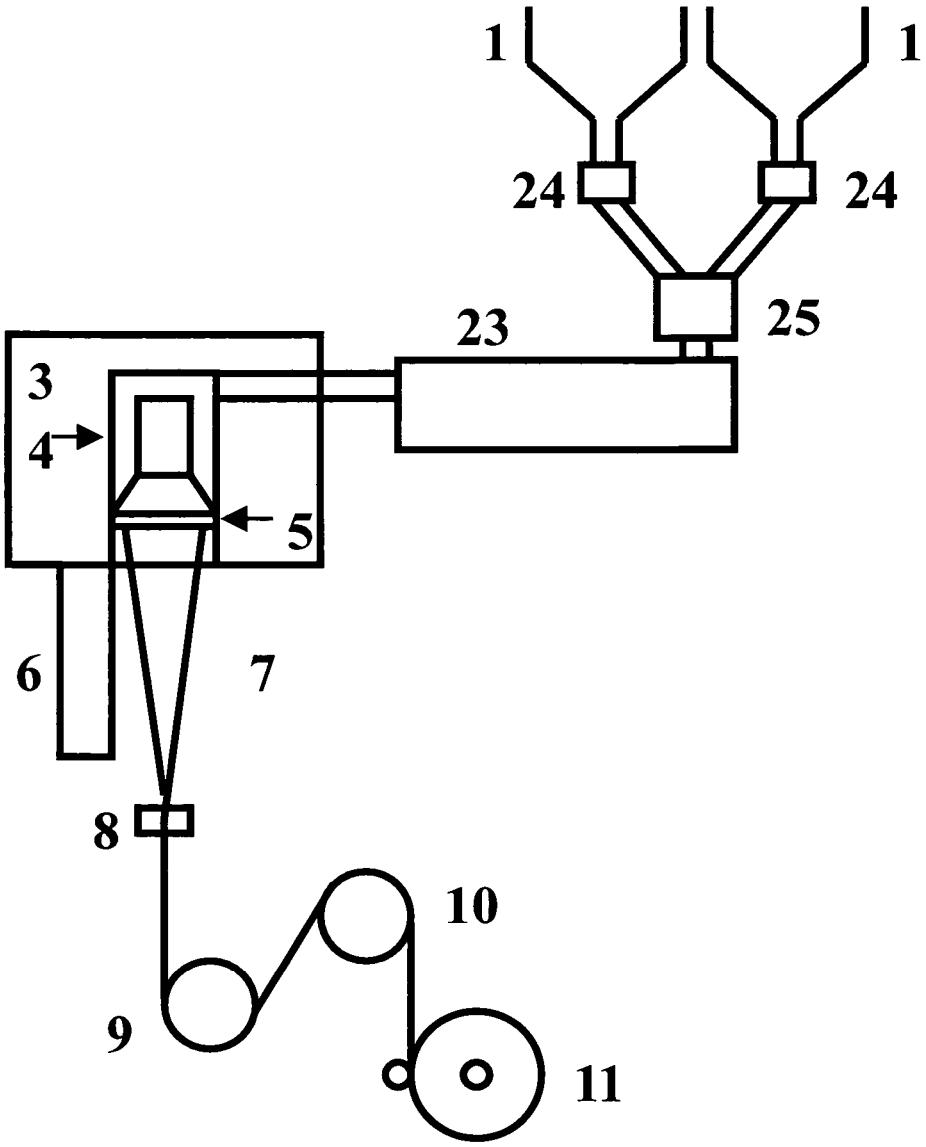
FIG. 17 is a diagram showing a spinning machine.

A melt spinning operation was carried out similarly to Comparative Example 3 using an apparatus shown in FIG. 17 wherein a N6 having a melt viscosity of 150 Pa·s (262° C. at a shear rate of 121.6 $sec^{-1}$) and a melting point of 220° C. and a PE having a melt viscosity of 145 Pa·s (262° C. at a shear rate of 121.6 $sec^{-1}$) and a melting point of 105° C. were introduced into a twin-screw extrusion-kneader while weighing the polymers separately with the content of the N6 set to 20% by weight. A significant blending unevenness of the N6 and the PE and a significant Barus under the spinneret were observed. While the yarn could not be wound stably due to low stringiness, a small quantity of undrawn yarn was obtained and was drawn and subjected to heat treatment similarly to Example 1, thereby to obtain a drawn yarn of 82 dtex and 12-filament. The drawing ratio was set to 2.0.

Figure 7:
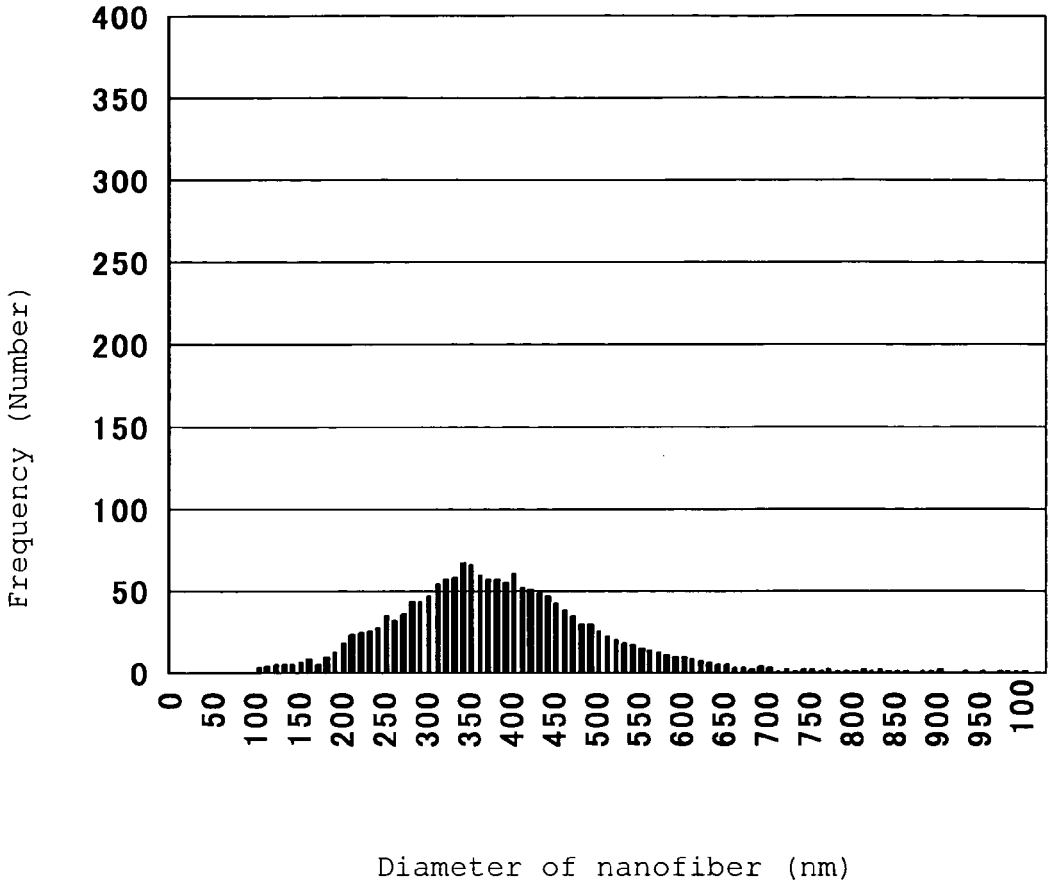
FIG. 7 is a graph showing the spread of single fiber fineness values of ultrafine fibers according to Comparative Example 4.
Figure 8:
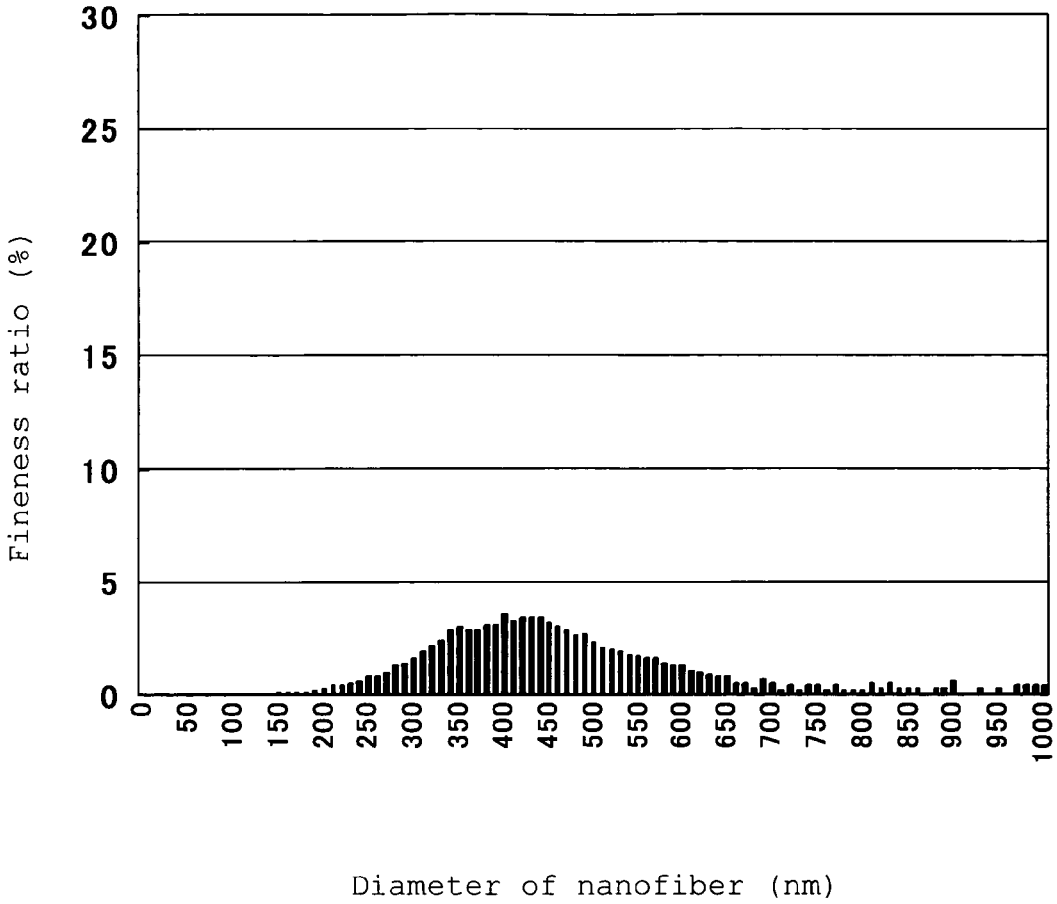
FIG. 8 is a graph showing the spread of single fiber fineness values of the ultrafine fibers according to Comparative Example 4.

This yarn was formed into a round braid similarly to Example 1, and was subjected to dissolving treatment with toluene at 85° C. for one hour or more to remove 99% or more of the PE component. A yarn comprising solely of N6 was drawn out of the round braid. TEM observation of a cross section of the fiber showed that an ultrafine yarn having single fiber diameter of 100 nm to 1 μm (single fiber fineness $9\times10^{-5}$ to $9\times10^{-3}$ dtex) was formed. However, it showed single fiber fineness by number average of a large value of $1\times10^{--3}$ dtex (single fiber diameter of 384 nm). The ultrafine yarn also showed a large spread of single fiber fineness values (FIG. 7, FIG. 8).

Comparative Example 5

Figure 9:
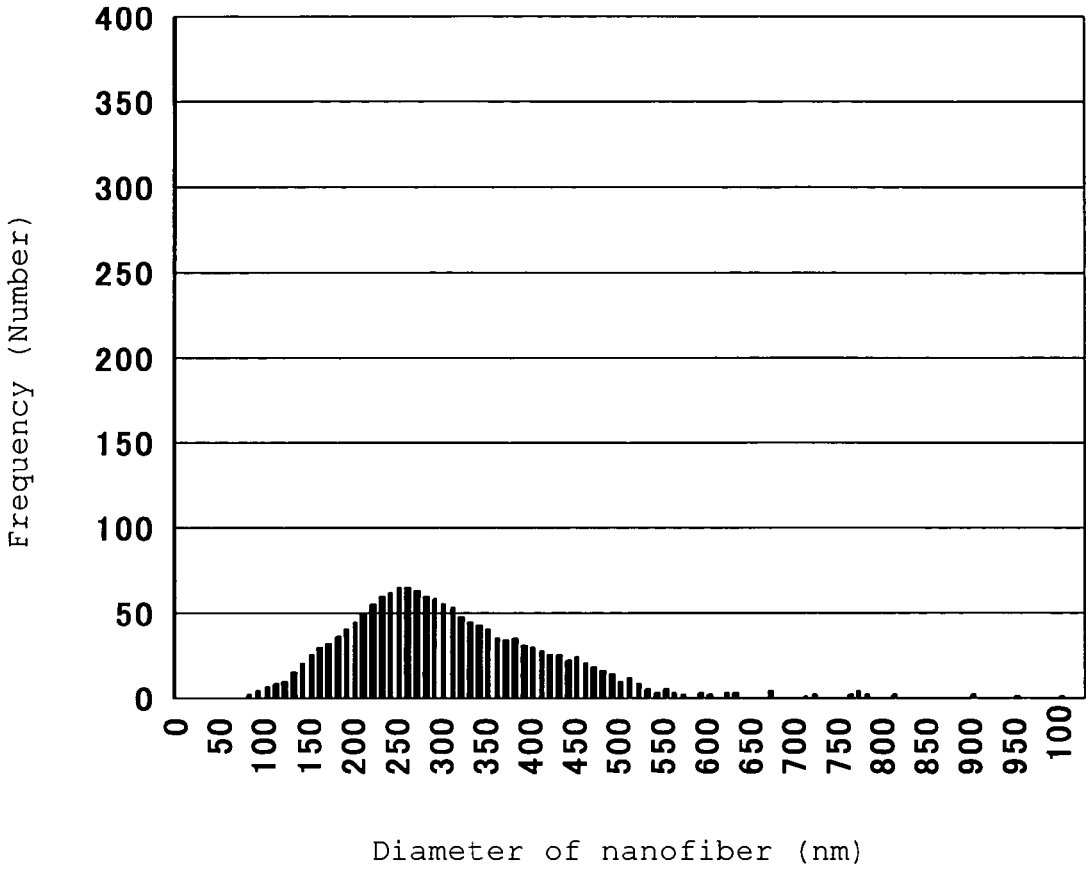
FIG. 9 is a graph showing the spread of single fiber fineness values of ultrafine fibers according to Comparative Example 5.
Figure 10:
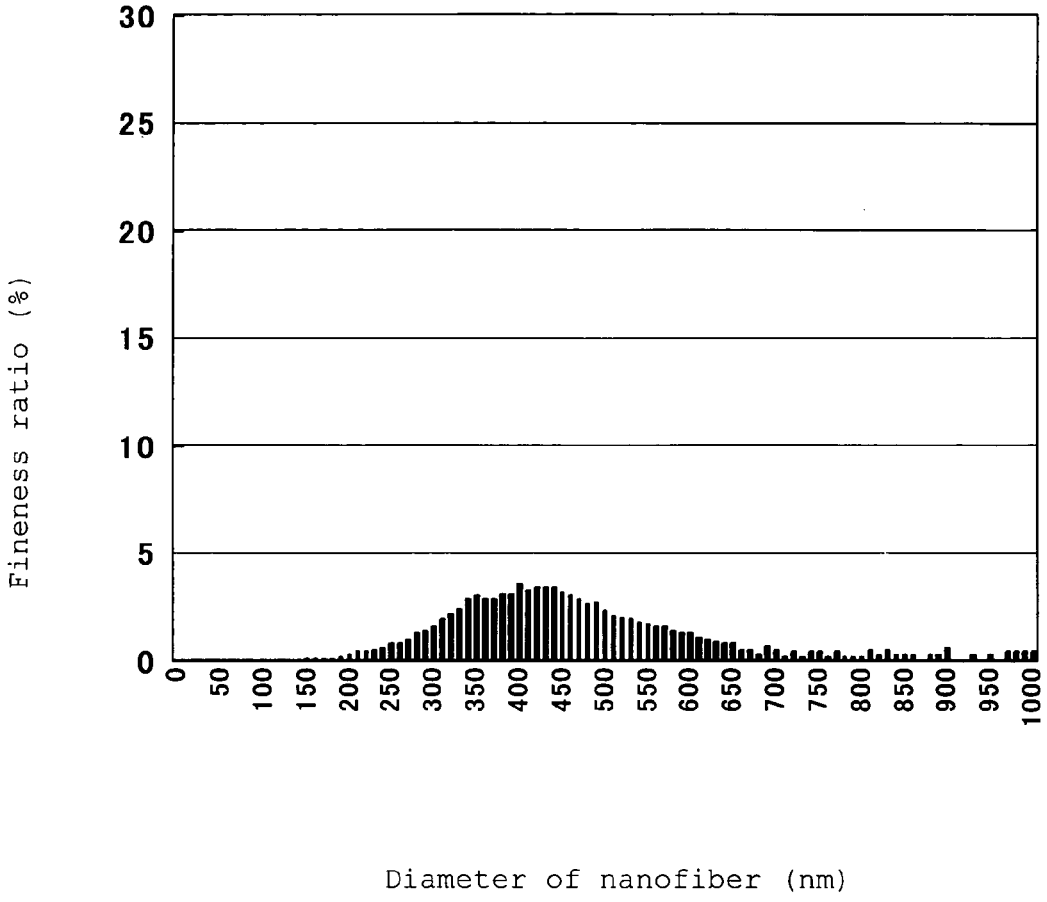
FIG. 10 is a graph showing the spread of single fiber fineness values of the ultrafine fibers according to Comparative Example 5

An islands-in-sea composite yarn was made according to a method described in Comparative Example 1 of Japanese Examined Patent Publication No. 60-28922, using a spinning pack and a spinneret shown in FIG. 11 of the aforementioned Publication and using a PS and a PET described in Comparative Example 1 of the Publication. A blended polymer of PS and PET in weight proportion of 2:1 was used as the island component and PS was used as the sea component of the islands-in-sea composite yarn. The islands-in-sea proportion was 1:1 in a weight proportion. Specifically, PET was used as component A, and PS was used as components B and C in FIG. 11 of the aforementioned Publication. This yarn was treated with trichloroethylene similarly to in Comparative Example 1 of the Publication described above, so as to remove 99% or more of the PS, thereby to obtain an ultrafine yarn. An observation of a cross section of the fiber showed the existence of a trace of single fibers having diameter of about 100 nm at the minimum. However, since the PET was not dispersed satisfactorily in the PS, it showed single fiber fineness by number average of a large value of $9\times10^{-4}$ dtex (single fiber diameter of 326 nm). The ultrafine yarn also showed a large spread of single fiber fineness values (FIG. 9, FIG. 10).

TABLE 1

| | Island polymer | | | Sea polymer | | | |
|---|---|---|---|---|---|---|---|
| | Polymer | Melt viscosity (Pa · s) | Proportion (% by weight) | Polymer | Melt viscosity (Pa · s) | Proportion (% by weight) | Shear stress at orifice (MPa) |
| Example 1 | N6 | 53 | 20 | Copolymerized PET | 310 | 80 | 0.058 |
| Example 2 | N6 | 212 | 20 | Copolymerized PET | 310 | 80 | 0.071 |
| Example 3 | N6 | 500 | 20 | Copolymerized PET | 310 | 80 | 0.083 |
| Example 4 | N6 | 500 | 50 | Copolymerized PET | 310 | 50 | 0.042 |
| Comparative Example 1 | PET | 180 | 96 | PS | 100 | 4 | — |
| Comparative Example 2 | N6 | 50 | 20 | PET | 210 | 80 | 0.41 |
| Comparative Example 3 | N6 | 395 | 65 | PE | 56 | 35 | 0.64 |
| Comparative Example 4 | N6 | 150 | 20 | PE | 145 | 80 | 0.40 |
| Comparative Example 5 | PS/PET | — | 50 | PS | — | 50 | — |

TABLE 2

| | Number-average diameter of island domains (nm) | Spread of island domains: Area ratio (%) | Spread of island domains: Range (Range of diameters:Area ratio) | Strength (cN/dtex) | U % (%) |
|---|---|---|---|---|---|
| Example 1 | 53 | 100 | 45-74 nm:72% | 4.0 | 1.7 |
| Example 2 | 40 | 100 | 35-64 nm:75% | 4.1 | 1.2 |
| Example 3 | 60 | 99 | 55-84 nm:70% | 4.5 | 1.9 |
| Example 4 | 80 | 85 | 65-94 nm:66% | 4.3 | 2.5 |
| Comparative Example 1 | 2000 | 0 | — | — | — |
| Comparative Example 2 | 1000 | 0 | 974-1005 nm:10% | — | 23.5 |
| Comparative Example 3 | 1000 | 0 | 974-1005 nm:10% | — | 22.7 |
| Comparative Example 4 | 374 | 0 | 395-424 nm:10% | — | 20.3 |
| Comparative Example 5 | 316 | 0 | 395-424 nm:10% | — | 17.3 |

Area ratio: Area ratio of island domains having diameters in a range from 1 to 100 nm.
Range: Area ratio in a section 30 nm wide in diameters.

TABLE 3

| | Number-average of nanofibers: Diameter (nm) | Number-average of nanofibers: Fineness (dtex) | Spread of nanofibers: Fineness ratio (%) | Spread of nanofibers: Range (Range of diameters:Fineness ratio) | Strength of aggregate of nanofibers (cN/dtex) |
|---|---|---|---|---|---|
| Example 1 | 56 | $3 \times 10^{-5}$ | 99 | 55-84 nm:71% | 2.0 |
| Example 2 | 43 | $2 \times 10^{-5}$ | 100 | 45-74 nm:75% | 2.2 |
| Example 3 | 65 | $4 \times 10^{-5}$ | 98 | 65-94 nm:70% | 2.4 |
| Example 4 | 84 | $6 \times 10^{-5}$ | 78 | 75-104 nm:64% | 2.6 |
| Comparative Example 1 | 2000 | $4 \times 10^{-2}$ | 0 | — | — |
| Comparative Example 2 | 1000 | $9 \times 10^{-3}$ | 0 | 974-1005 nm:10% | — |
| Comparative Example 3 | 1000 | $9 \times 10^{-3}$ | 0 | 974-1005 nm:10% | — |
| Comparative Example 4 | 384 | $1 \times 10^{-3}$ | 0 | 395-424 nm:10% | — |
| Comparative Example 5 | 326 | $9 \times 10^{-4}$ | 0 | 395-424 nm:10% | — |

Fineness ratio: Fineness ratio of single fiber fineness in a range from $1 \times 10^{-7}$ to $1 \times 10^{-4}$ dtex
Range: Area ratio in a section 30 nm wide in diameters.

Example 5

Figure 16:
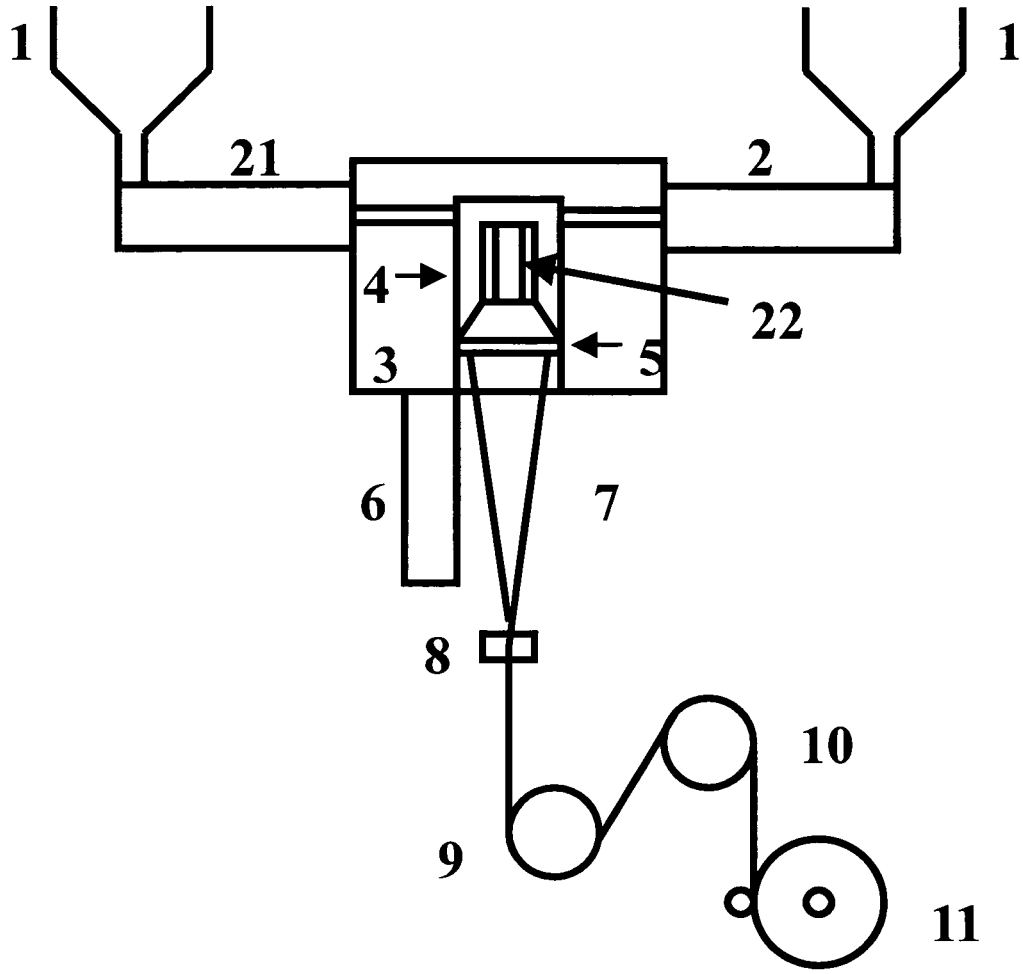
FIG. 16 is a diagram showing a spinning machine.

The N6 and the copolymerized PET used in Example 1 were separately melted at 270° C. in an apparatus shown in FIG. 16, and the molten polymer was introduced into a spin block 3 having a spinning temperature of 280° C. The two polymers were carefully mixed through $104\times10^{-4}$ splits in a static mixer 22 ("Hi-Mixer", available from TORAY Engineering Co., Ltd.) installed in a spinning pack 4, and melt spinning operation was carried out similarly to Example 1. The polymer consisted of 20% by weight of the N6 and 80% by weight of the copolymerized PET. Shear stress at the spinneret was 0.060 MPa. In this procedure, the fiber showed good spinnability and was broken only once during the spinning of 1*t*. The undrawn yarn was drawn and subjected to annealing similarly to Example 1. Polymer alloy fibers thus obtained showed good properties of 120 dtex, 36-filament, 3.9 cN/dtex in strength, 38% in elongation, U %=1.7% and 11% in boiling water shrinkage. Observation of a cross section of the polymer alloy fiber under a TEM showed islands-in-sea structure where the copolymerized PET formed the sea and the N6 formed the islands similarly to Example 1. The diameter of the N6 island domain by number average was 52 nm, indicating that the N6 was uniformly dispersed on the nanometer order in the polymer alloy fiber.

The polymer alloy fibers thus obtained were subjected to alkali treatment similarly to Example 1, and an aggregate of nanofibers having morphology like spun yarn was obtained. Spread of single fiber fineness values of the nanofibers was analyzed similarly to Example 1, showing that the nanofiber had such an unprecedented fineness as the single fiber diameter by number average was 54 nm ($3\times10^{-5}$ dtex), with very small spread of single fiber fineness values.

The ratio of moisture adsorption (ΔMR) of a round braid formed from the aggregate of nanofibers was 6%, and the rate of elongation in the longitudinal direction of yarn at absorbing water was 7%. A yarn comprising the aggregate of N6 nanofibers showed a strength of 2.0 cN/dtex and an elongation of 50%. 140° C. dry heat shrinkage ratio was 3%.

When the round braid was buffed, it showed excellent hands providing ultra-soft feeling like peach skin, or soft and moist touch like human skin which have never been realized by the ultrafine fibers of the prior art.

Example 6

Master pellets were made by melting and kneading similarly to Example 1, except for using the N6 and the copolymerized PET used in Example 4 and blending the N6 and the copolymerized PET in proportion of 80%/20% by weight. The master pellets and virgin pellets of N6 used in the melt kneading operation were fed to separate hoppers 1 using an apparatus shown in FIG. 17, weighed separately by a weighing section 24 and were fed to a blending tank 25 (capacity 7 kg). The master pellets and virgin pellets of N6 were blended in a weight proportion of 1:1, to which an antistatic agent (EMULMIN® 40 available from Sanyo Chemical Industries, Ltd.) was added to a concentration of 20 ppm, in order to prevent the pellets from sticking onto the wall surface of the blending tank. The pellets mixed in this blending tank were fed to a twin-screw extrusion-kneader 23 to be melt-kneaded so as to turn into a polymer alloy including 40% by weight of the N6. The length of the kneading section was set to 33% of the effective length of the screw, and the kneading temperature was set to 270° C. Then the molten polymer was introduced into a spin block 3 having a spinning temperature of 280° C. The two polymers were subjected to melt spinning operation similarly to Example 4. The undrawn yarn was drawn and subjected to annealing similarly to Example 4. The polymer alloy fibers thus obtained showed good properties of 120 dtex, 36-filament, 3.0 cN/dtex in strength, 30% in elongation and U %=3.7%. Observation of a cross section of the polymer alloy fiber under a TEM showed islands-in-sea structure where the copolymerized PET formed the sea and the N6 formed the islands similarly to Example 1. The diameter of the N6 island domain by number average was 110 nm, indicating rather large single fiber fineness, and spread was also large.

The polymer alloy fibers thus obtained were subjected to alkali treatment similarly to Example 4, and an aggregate of nanofibers having morphology like spun yarn was obtained. Spread of single fiber fineness values of the nanofibers was analyzed similarly to Example 1, showing that the nanofiber had a single fiber diameter by number average of 120 nm ($1.3\times10^{-4}$ dtex), larger than that obtained in Example 4 with a large spread of single fiber fineness values.

The ratio of moisture adsorption (ΔMR) of a round braid formed from the aggregate of nanofibers was 5%, and the rate of elongation in the longitudinal direction of yarn at absorbing water was 7%. A yarn comprising the aggregate of N6 nanofibers showed a strength of 1.2 cN/dtex and an elongation of 50%. 140° C. dry heat shrinkage ratio was 3%.

TABLE 4

| | Island polymer | | | Sea polymer | | | | |
|---|---|---|---|---|---|---|---|---|
| | Polymer | Melt viscosity (Pa · s) | Proportion (% by weight) | Polymer | Melt viscosity (Pa · s) | Proportion (% by weight) | Order of kneading | Shear stress at orifice (MPa) |
| Example 5 | N6 | 53 | 20 | Copolymerized PET | 310 | 80 | In the spinning pack | 0.060 |
| Example 6 | N6 | 500 | 40 | Copolymerized PET | 310 | 60 | Before the spinning pack | 0.20 |

TABLE 5

| | Number-average diameter of island domains (nm) | Spread of island domains: Area ratio (%) | Spread of island domains: Range (Range of diameters:Area ratio) | Strength (cN/dtex) | U % (%) |
|---|---|---|---|---|---|
| Example 5 | 52 | 100 | 45-74 nm: 72% | 3.9 | 1.7 |
| Example 6 | 110 | 60* | 95-124 nm: 50% | 3.0 | 3.7 |

Area ratio: Area ratio of island domains having diameters in a range from 1 to 100 nm.
*Area ratio of island domains having diameters in a range from 1 to 150 nm.
Range: Area ratio in a section 30 nm wide in diameters.

TABLE 6

| | Number-average of nanofibers: Diameter (nm) | Number-average of nanofibers: Fineness (dtex) | Spread of nanofibers: Fineness ratio (%) | Spread of nanofibers: Range (Range of diameters:Fineness ratio) | Strength of aggregate of nanofibers (cN/dtex) |
|---|---|---|---|---|---|
| Example 5 | 54 | $3 \times 10^{-5}$ | 99 | 55-84 nm:72% | 2.0 |
| Example 6 | 120 | $1.3 \times 10^{-4}$ | 95* | 105-134 nm:50% | 1.2 |

Fineness ratio: Fineness ratio of single fiber fineness in a range from $1 \times 10^{-7}$ to $1 \times 10^{-4}$ dtex
*Fineness ratio of single fiber fineness in a range from $1 \times 10^{-7}$ to $2 \times 10^{-4}$ dtex
Range: Area ratio in a section 30 nm wide in diameters.

Example 7

Kneading and melt spinning operations were carried out in a spinning pack using a static mixer similarly to Example 5, except for using "Paogen PP-15" (melt viscosity of 350 Pa·s at 262° C. at a shear rate of 121.6 $sec^{-1}$, melting point of 55° C.) available from Daiichi Kogyo Seiyaku Co., Ltd., that is a polymer soluble to hot water, instead of copolymerized PET, and setting the spinning rate to 5000 m/min. The Paogen PP-15 had a melt viscosity of 180 Pa·s at 262° C. and at a shear rate of 1216 $sec^{-1}$. The polymer alloy fibers thus obtained showed good properties of 70 dtex, 12-filament, 3.8 cN/dtex in strength, 50% in elongation and U %=1.7%. Observation of a cross section of the polymer alloy fiber under a TEM showed islands-in-sea structure where the copolymerized PET formed the sea and the N6 formed the islands. The diameter of the N6 island domain by number average was 53 nm, indicating that the N6 was uniformly dispersed on the nanometer order in the polymer alloy fiber.

The polymer alloy fibers thus obtained were subjected to alkali treatment similarly to Example 1, and an aggregate of nanofibers having morphology like spun yarn was obtained. Spread of single fiber fineness values of the nanofibers was analyzed similarly to Example 1, showing that the nanofiber had such an unprecedented fineness as the single fiber diameter by number average was 56 nm ($3\times10^{-5}$ dtex), with very small spread of single fiber fineness values.

The ratio of moisture adsorption (ΔMR) of a round braid formed from the aggregate of nanofibers was 6%, and the rate of elongation in the longitudinal direction of yarn at absorbing water was 7%. A yarn comprising the aggregate of N6 nanofibers showed a strength of 2.0 cN/dtex and an elongation of 60%.

When the round braid was buffed, it showed excellent hands providing ultra-soft feeling like peach skin, or soft and moist touch like human skin which have never been realized by the ultrafine fibers of the prior art.

Example 8

By using a N66 having a melt viscosity of 100 Pa·s (280° C. at a shear rate of 121.6 $sec^{-1}$) and a melting point of 250° C. instead of the N6, using the polymer soluble to hot water used in Example 7 instead of the copolymerized PET, and using an apparatus shown in FIG. 16, the N66 was melted at 270° C. and the polymer soluble to hot water was melted at 80° C. The molten polymers were introduced into the spin block 3 having a spinning temperature of 280° C. The two polymers were subjected to melt spinning operation similarly to Example 5. Proportions of the polymers were 20% by weight for the N66 and 80% by weight for the polymer soluble to hot water, and discharge per orifice was set to 1.0 g per minute. Spinning rate was set to 5000 meters per minute. The polymer alloy fibers having 70 dtex, 12-filament, 4.5 cN/dtex in strength and 45% in elongation were obtained. Observation of a cross section of the polymer alloy fiber under a TEM showed islands-in-sea structure where the polymer soluble to hot water formed the sea and the N66 formed the islands. The diameter of the N66 island domain by number average was 58 nm, indicating that the N66 was uniformly dispersed on the nanometer order in the polymer alloy fiber.

The polymer alloy fibers thus obtained were subjected to alkali treatment similarly to Example 1, and an aggregate of nanofibers having morphology like spun yarn was obtained. Spread of single fiber fineness values of the nanofibers was analyzed similarly to Example 1, showing that the nanofiber had such an unprecedented fineness as the single fiber diameter by number average was 62 nm ($3\times10^{-5}$ dtex), with very small spread of single fiber fineness values.

The ratio of moisture adsorption (ΔMR) of a round braid formed from the aggregate of nanofibers was 6%, and the rate of elongation in the longitudinal direction of yarn at absorbing water was 7%. A yarn comprising the aggregate of N66 nanofibers showed a strength of 2.5 cN/dtex and an elongation of 60%.

When the round braid was buffed, it showed excellent hands providing ultra-soft feeling like peach skin, or soft and moist touch like human skin which have never been realized by the ultrafine fibers of the prior art.

Example 9

A copolymerized PET and a polymer soluble to hot water were mixed, kneaded and melt-spun similarly to Example 8, except for using the copolymerized PET (8% by weight of PEG 1000 and 7% by mole of isophthalic acid were copolymerized) having a melt viscosity of 300 Pa·s (262° C. at a shear rate of 121.6 $sec^{-1}$) and a melting point of 235° C. instead of the N66. Proportions of the polymers were 20% by weight for the copolymerized PET and 80% by weight for the polymer soluble to hot water, and discharge per orifice was set to 1.0 gram per minute. Spinning rate was set to 6000 meters per minute. Shear stress between the spinneret orifice and the polymer showed a sufficiently low value of 0.11 MPa. The polymer alloy fibers having 60 dtex, 36-filament, 3.0 cN/dtex in strength and 55% in elongation were obtained. Observation of a cross section of the polymer alloy fiber under a TEM showed islands-in-sea structure where the polymer soluble to hot water formed the sea and the copolymerized PET formed the islands. The diameter of the copolymerized PET island domain by number average was 52 nm, indicating that the copolymerized PET was uniformly dispersed on the nanometer order in the polymer alloy fiber.

The polymer alloy fibers thus obtained were formed into a round braid similarly to Example 1, and was treated with hot water at 100° C. so as to dissolve the polymer soluble to hot water. The round braid thus formed from the polymer alloy fibers had sleekness of silk or dry feeling of rayon. Spread of single fiber fineness values of the nanofibers was analyzed similarly to Example 1, showing that the nanofiber had such an unprecedented fineness as the single fiber diameter by number average was 54 nm ($3\times10^{-5}$ dtex), with very small spread of single fiber fineness values.

The ratio of moisture adsorption (ΔMR) of a round braid formed from the aggregate of nanofibers was 2%. A yarn comprising the aggregate of nanofibers of the copolymerized PET showed a strength of 2.0 cN/dtex and an elongation of 70%.

Example 10

Kneading and melt spinning operations were carried out similarly to Example 9, except for using a PET having a melt viscosity of 190 Pa·s (280° C., at a shear rate of 121.6 $sec^{-1}$) and a melting point of 255° C. instead of the copolymerized PET. Proportions of the polymers were 20% by weight for the PET and 80% by weight for the polymer soluble to hot water. Melting temperature of the PET was set at 285° C., melting temperature of the polymer soluble to hot water was set at 80° C., and discharge per orifice was set to 1.0 gram per minute. Shear stress between the spinneret orifice and the polymer showed a sufficiently low value of 0.12 MPa. The polymer alloy fibers having 60 dtex, 36-filament, 3.0 cN/dtex in strength and 45% in elongation were obtained. Observation of a cross section of the polymer alloy fiber under a TEM showed islands-in-sea structure where the polymer soluble to hot water formed the sea and the PET formed the islands. The diameter of the PET island domain by number average was 62 nm, indicating that the PET was uniformly dispersed on the nanometer order in the polymer alloy fiber.

An aggregate of nanofibers was formed in a process similar to that of Example 9 using the polymer alloy fibers thus obtained. The nanofiber had such an unprecedented fineness as the single fiber diameter by number average was 65 nm ($3\times10^{-5}$ dtex), with very small spread of single fiber fineness values.

Example 11

Kneading and melt spinning operations were carried out similarly to Example 9, except for using a PBT having a melt viscosity of 120 Pa·s (262° C. at a shear rate of 121.6 $sec^{-1}$) and a melting point of 225° C. instead of the copolymerized PET. Proportions of the polymers were 20% by weight for the PBT and 80% by weight for the polymer soluble to hot water. Melting temperature of the PBT was set at 255° C., melting temperature of the polymer soluble to hot water was set at 80° C., spinning temperature was 265° C., and discharge per orifice was set to 1.0 gram per minute. Shear stress between the spinneret orifice and the polymer showed a sufficiently low value of 0.12 MPa. The polymer alloy fibers having 60 dtex, 36-filament, 3.0 cN/dtex in strength and 45% in elongation were obtained. Observation of a cross section of the polymer alloy fiber under a TEM showed islands-in-sea structure where the polymer soluble to hot water formed the sea and the PBT formed the islands. The diameter of the PBT island domain by number average was 62 nm, indicating that the PBT was uniformly dispersed on the nanometer order in the polymer alloy fiber.

An aggregate of nanofibers was formed in a process similar to that of Example 9 using the polymer alloy fibers thus obtained. The nanofiber had such an unprecedented fineness as the single fiber diameter by number average was 65 nm ($4\times10^{-5}$ dtex), with very small spread of single fiber fineness values.

Example 12

Kneading and melt spinning operations were carried out similarly to Example 9, except for using a PTT having a melt viscosity of 220 Pa·s (262° C. at a shear rate of 121.6 $sec^{-1}$) and a melting point of 225° C. instead of the copolymerized PET. Shear stress between the spinneret orifice and the polymer showed a sufficiently low value of 0.13 MPa. The polymer alloy fibers having 60 dtex, 36-filament, 3.0 cN/dtex in strength and 45% in elongation were obtained. Observation of a cross section of the polymer alloy fiber under a TEM showed islands-in-sea structure where the polymer soluble to hot water formed the sea and the PTT formed the islands. The diameter of the PTT island domain by number average was 62 nm, indicating that the PTT was uniformly dispersed on the nanometer order in the polymer alloy fiber.

An aggregate of nanofibers was formed in a process similar to that of Example 9 using the polymer alloy fibers thus obtained. The nanofiber had such an unprecedented fineness as the single fiber diameter by number average was 65 nm ($4\times10^{-5}$ dtex), with very small spread of single fiber fineness values.

Example 13

Kneading and melt spinning operations were carried out similarly to Example 9, except for using a PLA having a melt viscosity of 350 Pa·s (220° C. at a rate of shear of 121.6 $sec^{-1}$) and a melting point of 170° C. instead of the copolymerized PET. Proportions of the polymers were 20% by weight for the PLA and 80% by weight for the polymer soluble to hot water. Spinning temperature was 235° C., surface temperature of the spinneret was 220° C., and discharge per orifice was set to 1.0 gram per minute. The polymer alloy fibers having 60 dtex, 36-filament, 2.5 cN/dtex in strength and 35% in elongation were obtained. Observation of a cross section of the polymer alloy fiber thus obtained under a TEM showed islands-in-sea structure where the polymer soluble to hot water formed the sea and the PLA formed the islands. The diameter of the PLA island domain by number average was 48 nm, indicating that the PLA was uniformly dispersed on the nanometer order in the polymer alloy fiber.

An aggregate of nanofibers was formed in a process similar to that of Example 9 using the polymer alloy fibers thus obtained. The nanofiber had such an unprecedented fineness as the single fiber diameter by number average was 50 nm ($2\times10^{-5}$ dtex), with very small spread of single fiber fineness values.

TABLE 7

| | Island polymer | | | Sea polymer | | | |
|---|---|---|---|---|---|---|---|
| | Polymer | Melt viscocity (Pa · s) | Proportion (% by weight) | Polymer | Melt viscosity (Pa · s) | Proportion (% by weight) | Order of kneading |
| Example 7 | N6 | 53 | 20 | Polymer soluble to hot water | 350 | 80 | In the spinning pack |
| Example 8 | N66 | 100 | 20 | Polymer soluble to hot water | 220 | 80 | In the spinning pack |
| Example 9 | Copolymerized PET | 300 | 20 | Polymer soluble to hot water | 350 | 80 | In the spinning pack |
| Example 10 | PET | 190 | 20 | Polymer soluble to hot water | 220 | 80 | In the spinning pack |
| Example 11 | PBT | 120 | 20 | Polymer soluble to hot water | 350 | 80 | In the spinning pack |
| Example 12 | PTT | 220 | 20 | Polymer soluble to hot water | 350 | 80 | In the spinning pack |
| Example 13 | PLA | 350 | 20 | Polymer soluble to hot water | 600 | 80 | In the spinning pack |

TABLE 8

| | Number-average diameter of island domains (nm) | Spread of island domains: Area ratio (%) | Range Range of diameters:Area ratio | Strength (cN/dtex) | U % (%) |
|---|---|---|---|---|---|
| Example 7 | 53 | 100 | 45-74 nm:72% | 3.8 | 1.7 |
| Example 8 | 58 | 100 | 55-84 nm:70% | 4.5 | 1.7 |
| Example 9 | 52 | 100 | 45-74 nm:72% | 3.0 | 1.6 |
| Example 10 | 62 | 97 | 55-84 nm:65% | 3.0 | 2.3 |
| Example 11 | 62 | 98 | 55-84 nm:68% | 3.0 | 2.0 |
| Example 12 | 62 | 98 | 55-84 nm:65% | 3.0 | 2.0 |
| Example 13 | 48 | 100 | 45-74 nm:75% | 2.5 | 1.2 |

Area ratio: Area ratio of island domains having diameters in a range from 1 to 100 nm.
Range: Area ratio in a section 30 nm wide in diameters.

TABLE 9

| | Number-average of nanofibers: Diameter (nm) | Fineness (dtex) | Spread of nanofibers: Fineness ratio (%) | Range Range of diameters:Fineness ratio | Strength of aggregate of nanofibers (cN/dtex) |
|---|---|---|---|---|---|
| Example 7 | 56 | $3\times10^{-5}$ | 99 | 55-84 nm:72% | 2.0 |
| Example 8 | 62 | $3\times10^{-5}$ | 98 | 55-84 nm:68% | 2.5 |
| Example 9 | 54 | $3\times10^{-5}$ | 99 | 55-84 nm:71% | 2.0 |
| Example 10 | 65 | $5\times10^{-5}$ | 98 | 55-84 nm:65% | 2.0 |
| Example 11 | 65 | $4\times10^{-5}$ | 98 | 55-84 nm:65% | 2.0 |
| Example 12 | 65 | $4\times10^{-5}$ | 98 | 55-84 nm:65% | 2.0 |
| Example 13 | 50 | $2\times10^{-4}$ | 100 | 45-74 nm:72% | 1.9 |

Fineness ratio: Fineness ratio of single fiber fineness in a range from $1\times10^{-7}$ to $1\times10^{-4}$ dtex
Range: Fineness ratio in a section 30 nm wide in diameters.

Example 14

Kneading and melt spinning operations were carried out similarly to Example 8, except for using a polycarbonate (PC) having a melt viscosity of 300 Pa·s (262° C. at a shear rate of 121.6 $sec^{-1}$) and a thermal deformation temperature of 140° C. instead of the N66. Proportions of the polymers were 20% by weight for the PC and 80% by weight for the polymer soluble to hot water. Discharge per orifice was set to 1.0 gram per minute. The polymer alloy fibers having 70 dtex, 36-filament, 2.2 cN/dtex in strength and 35% in elongation were obtained. Observation of a cross section of the polymer alloy fiber thus obtained under a TEM showed islands-in-sea structure where the polymer soluble to hot water formed the sea and the PC formed the islands. The diameter of the PC island domain by number average was 85 nm, indicating that the PC was uniformly dispersed on the nanometer order in the polymer alloy fiber.

A round braid was formed in a process similar to that of Example 1 using the polymer alloy fibers thus obtained. The round braid was treated in warm water of 40° C. for ten hours so as to dissolve 99% or more of the polymer soluble to hot water, thereby to obtain an aggregate of nanofibers. The nanofiber had such an unprecedented fineness as the single fiber diameter by number average was 88 nm ($8\times10^{-5}$ dtex), with very small spread of single fiber fineness values.

Example 15

Kneading and melt spinning operations were carried out similarly to Example 8, except for using polymethylpentene (PMP) having a melt viscosity of 300 Pa·s (262° C. at a shear rate of 121.6 $sec^{-1}$) and a melting point of 220° C. and a PS having a melt viscosity of 300 Pa·s (262° C. at a shear rate of 121.6 $sec^{-1}$) and a Vicat softening temperature of 105° C. instead of the N6 and the PET, and setting the spinning speed to 1500 meters per minute. Then drawing and annealing operations were carried out similarly to Example 1 by setting the drawing ratio to 1.5. Proportions of the polymers were 20% by weight for the PMP and 80% by weight for the PS, and discharge per orifice was set to 1.0 gram per minute. The polymer alloy fibers having 77 dtex, 36-filament, 3.0 cN/dtex in strength and 40% in elongation were obtained. Observation of a cross section of the polymer alloy fiber under a TEM showed islands-in-sea structure where the PS formed the sea and the PMP formed the islands. The diameter of the PMP island domain by number average was 70 nm, indicating that the PMP was uniformly dispersed on the nanometer order in the polymer alloy fiber.

The polymer alloy fibers thus obtained were formed into a round braid similarly to Example 1, and was treated with concentrated hydrochloric acid at 40° C. so as to embrittle the PS. Then the PS was removed by methyl ethyl ketone, thereby to obtain a round braid constituted from the aggregate of PMP nanofibers. The nanofiber had such an unprecedented fineness as the single fiber diameter by number average was 73 nm ($5\times10^{-5}$ dtex), with very small spread of single fiber fineness values.

Example 16

Kneading, melt spinning, drawing and annealing operations were carried out similarly to Example 15, except for using a PP having a melt viscosity of 300 Pa·s (220° C. at a shear rate of 121.6 $sec^{-1}$) and a melting point of 162° C. and the polymer soluble to hot water used in Example 7 instead of the PMP and the PS. Proportions of the polymers were set to 20% by weight for the PP and 80% by weight for the polymer soluble to hot water. Spinning temperature was set to 235° C., surface temperature of the spinneret was set to 220° C., and discharge per orifice was set to 1.0 gram per minute. The polymer alloy fibers having 77 dtex, 36-filament, 2.5 cN/dtex in strength and 50% in elongation were obtained. Observation of a cross section of the polymer alloy fiber under a TEM showed islands-in-sea structure where the polymer soluble to hot water formed the sea and the PP formed the islands. The diameter of the PP island domain by number average was 48 nm, indicating that the PP was uniformly dispersed on the nanometer order in the polymer alloy fiber.

The polymer alloy fibers thus obtained were formed into an aggregate of nanofibers similarly to Example 9. The nanofiber had such an unprecedented fineness as the single fiber diameter by number average was 50 nm ($2\times10^{-5}$ dtex), with very small spread of single fiber fineness values.

Example 17

Kneading, melt spinning, drawing and annealing operations were carried out similarly to Example 15, except for using a polyphenylene sulfide (PPS) having a melt viscosity of 200 Pa·s (300° C. at a shear rate of 121.6 $sec^{-1}$) and a melting point of 280° C. and a N6 having a melt viscosity of 200 Pa·s (300° C. at a shear rate of 121.6 $sec^{-1}$) instead of the PMP and the PS. Proportions of the polymers were set to 20% by weight for the PSP and 80% by weight for the N6. Melting point of the PPS was set to 320° C., melting point of the N6 was set to 270° C., spinning temperature was set to 320° C., surface temperature of the spinneret was set to 300° C., and discharge per orifice was set to 1.0 gram per minute. The polymer alloy fibers having 77 dtex, 36-filament, 5.2 cN/dtex in strength and 50% in elongation were obtained. Observation of a cross section of the polymer alloy fiber thus obtained under a TEM showed islands-in-sea structure where the N6 formed the sea and the PPS formed the islands. The diameter of the PPS island domain by number average was 65 nm, indicating that the PPS was uniformly dispersed on the nanometer order in the polymer alloy fiber.

A round braid was formed in a process similar to that of Example 1 using the polymer alloy fibers thus obtained. The round braid was treated with formic acid so as to dissolve the N6, thereby to obtain a round braid constituted from an aggregate of PPS nanofibers. The nanofiber had such an unprecedented fineness as the single fiber diameter by number average was 68 nm ($5\times10^{-5}$ dtex), with very small spread of single fiber fineness values.

TABLE 10

| | Island polymer | | | Sea polymer | | | |
|---|---|---|---|---|---|---|---|
| | Polymer | Melt viscosity (Pa · s) | Proportion (% by weight) | Polymer | Melt viscosity (Pa · s) | Proportion (% by weight) | Order of kneading |
| Example 14 | PC | 300 | 20 | Polymer soluble to hot water | 350 | 80 | In the spinning pack |
| Example 15 | PMP | 300 | 20 | PS | 300 | 80 | In the spinning pack |
| Example 16 | PP | 300 | 20 | Polymer soluble to hot water | 600 | 80 | In the spinning pack |
| Example 17 | PPS | 200 | 20 | N6 | 200 | 80 | In the spinning pack |

TABLE 11

| | Number-average diameter of | Spread of island domains | | | |
|---|---|---|---|---|---|
| | island domains (nm) | Area ratio (%) | Range Range of diameters: Area ratio | Strength (cN/dtex) | U % (%) |
| Example 14 | 85 | 73 | 75-104 nm: 70% | 2.2 | 5.1 |
| Example 15 | 70 | 95 | 65-94 nm: 73% | 3.0 | 2.0 |

TABLE 11-continued

| | Number-average diameter of island domains (nm) | Spread of island domains: Area ratio (%) | Spread of island domains: Range (Range of diameters: Area ratio) | Strength (cN/dtex) | U % (%) |
|---|---|---|---|---|---|
| Example 16 | 48 | 100 | 45-74 nm: 75% | 2.5 | 2.0 |
| Example 17 | 65 | 98 | 55-84 nm: 70% | 5.2 | 2.0 |

Area ratio: Area ratio of island domains having diameters in a range from 1 to 100 nm.
Range: Area ratio in a section 30 nm wide in diameters.

TABLE 12

| | Number-average of nanofibers: Diameter (nm) | Number-average of nanofibers: Fineness (dtex) | Spread of nanofibers: Fineness ratio (%) | Spread of nanofibers: Range (Range of diameters: Fineness ratio) | Strength (cN/dtex) |
|---|---|---|---|---|---|
| Example 14 | 88 | $8 \times 10^{-5}$ | 70 | 85-114 nm: 70% | 1.5 |
| Example 15 | 73 | $5 \times 10^{-5}$ | 94 | 65-94 nm: 72% | 1.7 |
| Example 16 | 50 | $2 \times 10^{-5}$ | 100 | 45-74 nm: 72% | 1.5 |
| Example 17 | 68 | $5 \times 10^{-5}$ | 92 | 65-94 nm: 68% | 3.0 |

Fineness ratio: Fineness ratio of single fiber fineness in a range from $1 \times 10^{-7}$ to $1 \times 10^{-4}$ dtex
Range: Fineness ratio in a section 30 nm wide in diameters.

Example 18

The polymer alloy fibers made in Examples 1 to 6 were woven into plain weaves. The weaves scoured in hot water at 100° C. (bath ratio 1:100) including a surfactant (GRANUP® manufactured by Sanyo Chemical Industries, Ltd.) and sodium carbonate each in concentration of 2 grams per litter. Duration of scouring was set to 40 minutes, followed by an intermediate heat-setting at 140° C. Then alkali treatment by means of 10% aqueous solution of sodium hydroxide (90° C., bath ratio 1:100) was applied for 90 minutes, thereby to remove 99% or more of the copolymerized PET, or the sea component. A final heat-setting at 140° C. was added thereto.

A woven fabric constituted from the aggregate of nanofibers was made as described above.

Cloths thus obtained were dyed by an ordinary method, and every one of the cloths made a beautifully dyed cloth without any dyeing unevenness. The woven fabric made from the aggregate of nanofibers had excellent hands such as sleekness of silk or dry feeling of rayon. They also showed a high ratio of moisture adsorption (ΔMR) of 6%, indicating the capability to produce comfortable clothes. Furthermore, when buffed, the woven fabric showed ultra-soft feeling like peach skin, or soft and moist touch like human skin which had never been realized with the conventional ultrafine fibers.

Comparative Example 6

The N6-blended fibers made in Comparative Examples 2 to 4 were woven into plain weaves similar to Example 18. Only poor woven fabrics with much fluff and low surface quality could be made because the yarn had thick-thin unevenness in the longitudinal direction of yarn and much fluff due to unstable spinning. These woven fabrics were scoured followed by intermediate heat-setting. The woven fabric formed from the yarn of Comparative Example 2 was subjected to alkali treatment followed by the final heat-setting similarly to Example 18, and was dyed by the ordinary method. The woven fabric formed from the yarns of Comparative Examples 3 and 4 were immersed in toluene at 85° C. for 60 minutes to remove 99% or more of the PE by dissolution. These woven fabrics were subjected to the final heat-setting and dyed by the ordinary method. The resulted cloths had poor quality with much dyeing unevenness and fluff. Hands of these woven fabrics were similar to those of the convention ultrafine yarn without sleekness and dry feeling, and had a ratio of moisture adsorption (ΔMR=2%) similar to that of the conventional N6 fiber.

Example 19

The polymer alloy fibers made in Example 4 were formed into a high-density woven fabric (5-ply back satin). A woven fabric having mass per unit area of 150 g/m$^2$ constituted from the aggregate of nanofibers was obtained similarly to Example 18. Analysis of spread of single fiber fineness values of the nanofibers similarly to Example 1 showed such an unprecedented fineness as the single fiber diameter by number average was 86 nm ($6\times10^{-5}$ dtex). Fineness ratio of single fibers having fineness in a range from $1\times10^{-7}$ to $1\times10^{-4}$ dtex was 78%, and particularly single fiber fineness ratio of those in a range from 75 to 104 nm in diameter was 64%, with very small spread of single fiber fineness values. This woven fabric showed specific stickiness when immersed in water. A wiping cloth was made by buffing this woven fabric. The wiping cloth had higher wiping performance than a wiping cloth made from the conventional ultrafine fibers. When washed and dewatered while being contained in a net in a home laundry machine, the wiping cloth showed high dimensional stability without deforming.

Example 20

The polymer alloy fibers made in Example 1 were conjoined into a tow of $4\times10^{-4}$ dtex, that was then mechanically crimped to obtain a crimped yarn having eight crimps per 25 mm. The crimped yarn was cut into fiber segments having a length of 51 mm, separated by means of carding, and was formed into a web with a cross-wrap webber. The web was subjected to needle punching with a density of 3000 points/cm$^2$, thereby to form a nonwoven fabric of entangled fibers having mass per unit area of 750 g/m$^2$. This nonwoven fabric was lined with an nonwoven fabric of PP that was bonded thereto as a support member. After soaking this laminated nonwoven fabric with polyvinyl alcohol, alkali treatment by means of 3% aqueous solution of sodium hydroxide (60° C., bath ratio 1:100) was applied for two hours, thereby to remove 99% or more of the copolymerized PET. Then the laminated nonwoven fabric was impregnated with a solution consisting of 13% by weight of a polyurethane compound (abbreviated as PU) including polyether-based polyurethane as the main component and 87% by weight of N,N'-dimethylformamide (abbreviated as DMF), and the PU was solidified in an aqueous solution having DMF content of 40% by weight. Then the fabric was washed in water, thereby to obtain an fibrous material made of the aggregate of N6 nanofibers and the PU having thickness of about 1 mm. The aggregate of nanofibers was drawn out of the fibrous material and spread of single fiber fineness values of the nanofibers was analyzed similarly to Example 1 with a result showing such an unprecedented fineness as the single fiber diameter by number average was 60 nm ($3\times10^{-5}$ dtex). Fineness ratio of single fibers having fineness in a range from $1\times10^{-7}$ to $1\times10^{-4}$ dtex was 97%, and particularly fineness ratio of single fibers having diameters in a range from 55 to 84 nm was 70%, with very small spread of single fiber fineness values. Then the PP nonwoven fabric was removed from the laminated nonwoven fabric, thereby to obtain an nonwoven fabric constituted from the N6 nanofibers. One side of the N6 nanofiber nonwoven fabric was buffed with a sand paper to reduce the thickness to 0.8 mm. The other side of this fabric was processed with an emery buffer machine, thereby to form an artificially raised surface of the aggregate of nanofibers that was then dyed and finished to produce a suede-like synthetic leather. The article thus obtained had excellent appearance with no dyeing unevenness nor a problem in the mechanical properties. It also provided softer and finer touch compared to a synthetic leather made by using the conventional ultrafine fibers. It also had good moisture adsorbing capability, resulting in soft and moist touch like human skin which could not be provided by the conventional synthetic leather.

Comparative Example 7

The N6/PE blended fiber made in Comparative Example 3 was mechanically crimped and was cut into fiber segments having a length of 51 mm, separated by means of carding, and was formed into a web with a cross-wrap webber. The web was subjected to needle punching, thereby to form an nonwoven fabric of entangled fibers having mass per unit area of 500 g/m$^2$. The nonwoven fabric of entangled fibers was impregnated with a solution consisting of 13% by weight of a polyurethane compound (PU) including polyether-based polyurethane as the main component and 87% by weight of N,N'-dimethylformamide (DMF), and the PU was solidified in an aqueous solution having DMF content of 40% by weight. Then the fabric was washed in water, thereby to obtain a fibrous material including the N6/PE blended fibers and the PU. The fibrous material was processed with tetrachloroethylene, thereby to obtain a fibrous material formed from the N6 ultrafine yarn and the PU having thickness of about 1 mm. One side of this fibrous material was buffed with a sand paper to reduce the thickness to 0.8 mm. The other side of the fibrous material was processed with an emery buffer machine, thereby to form an artificially raised surface of the aggregate of nanofibers that was then dyed and finished to produce a suede-like synthetic leather. The article thus obtained was nothing more than an imitation of suede, with hands no better than that of the synthetic leather made from the conventional ultrafine fibers.

Example 21

The polymer alloy fibers made in Example 1 were processed similarly to Example 20, thereby by obtain a fibrous material made of the aggregate of N6 nanofibers including 40% by weight of PU and the PU. The aggregate of nanofibers was drawn out of the fibrous material and spread of single fiber fineness values of the nanofibers was analyzed similarly to Example 1 with a result showing such an unprecedented fineness as the single fiber diameter by number average was 60 nm ($3\times10^{-5}$ dtex). Fineness ratio of single fibers having fineness in a range from $1\times10^{-7}$ to $1\times10^{-4}$ dtex was 97%, and particularly single fiber fineness ratio of those in a range from 55 to 84 nm in diameter was 70%, with very small spread of single fiber fineness values. The fibrous material was cut into two parts, and buffed on the surface with sand papers having grades of JIS #240, #350 and #500. The fibrous material was then nipped by heating rollers coated with fluorocarbon resin, that were disposed one upon another with a gap of 1.0 mm therebetween and kept at a temperature of 150° C., so as to press the fabric with a pressure of 0.7 kg/cm$^2$. Then the fabric was cooled quickly with a quenching roller of surface temperature 15° C., thereby to obtain a texturing cloth with smoothed surface. Results of evaluating this texturing cloth under the conditions described below are shown in Table 13. This texturing cloth made the textured surface smoother with less scratches than in the case of one made from the conventional ultrafine yarns, thus demonstrating excellent texturing performance.

<Evaluation of Texturing: Texturing of Hard Disk>

Work: A substrate made of a commercially available aluminum plate, coated with Ni—P plating and polished.

(Mean surface roughness was 0.28 nm)

Texturing conditions: The substrate was set on a texture apparatus and was textured under the following conditions.

Abrasive particles: Free abrasive particle slurry made of diamond having mean particle size of 0.1 μm.

Dripping rate: 4.5 ml per minute

Rotation speed: 1000 rpm

Tape speed: 6 cm/min.

Texturing cycle: 300 horizontal vibrations per minute with amplitude of 1 mm.

Number of samples: 30 substrates per trial

<Mean Surface Roughness Ra of Work>

Surface roughness of 30 substrates per trial was measured using an atomic force microscope (AFM) available from Veeco Inc. that was surrounded by a sound insulator and installed in a clean room controlled to a temperature of 20° C. and a relative humidity of 50%, to determine the mean surface roughness Ra. Measurement was made over an area of 5 μM by 5 μm around each of two points selected at symmetrical positions with respect to the center of the wafer, located at a distance of half the radius from the center.

<Number of Scratches>

Number of scratches (X) on the surface of each sample was counted by observing under an interference microscope available from ZYGO Inc. Scratches were counted when the size was not smaller than 0.1 μm by 100 μm. Based on the measurements of 30 substrates per trial, scratch count β is defined as follows using a point y determined from the number of scratches.

When $X\leqq4$: $y=X$

When $X\geqq5$: $y=5$ $\beta=\Sigma y_i (i=1 \text{ to } 30)$ $\Sigma y_i$ represents the total number of scratches for 30 samples.

Comparative Example 8

A fibrous material formed from a N6 ultrafine yarn and the PU was made by a process similar to that of Comparative Example 7. This fibrous material was processed similarly to Example 21, thereby to obtain a texturing cloth. Evaluation of this texturing cloth showed Ra=1.60 nm and β=32, indicating that this texturing cloth had poor texturing performance with lower smoothness of the textured surface and more scratches than in the case of the texturing cloth made from the aggregate of nanofibers.

TABLE 13

| | Raw yarn | Ra(nm) | β (counts/30 substrates) |
|---|---|---|---|
| Example 21 | Example 1 | 0.09 | 2 |
| Comparative Example 8 | Comparative Example 7 | 1.60 | 32 |

Example 22

The polymer alloy fiber made in Example 1 was used to form a nonwoven fabric of entangled fibers having mass per unit area of 350 g/m$^2$ similarly to Example 20. The nonwoven fabric was subjected to alkali treatment by means of 10% aqueous solution of sodium hydroxide (90° C., bath ratio 1:100) for two hours, thereby to remove 99% or more of the copolymerized PET and obtain a nonwoven fabric of N6 nanofibers. The aggregate of nanofibers was drawn out of this nonwoven fabric and spread of single fiber fineness values of the nanofibers was analyzed similarly to Example 1 with a result showing such an unprecedented fineness as the single fiber diameter by number average was 60 nm ($3\times10^{-5}$ dtex). Fineness ratio of single fibers having fineness in a range from $1\times10^{-7}$ to $1\times10^{-4}$ dtex was 97%, and particularly single fiber fineness ratio of those in a range from 55 to 84 nm in diameter was 70%, with very small spread of single fiber fineness values. Five disks 4.7 cm in diameter were cut out of the nonwoven fabric of N6 nanofibers and were placed one on another in a circular filter column, through which a bovine blood including while blood cells (5700 cells per microliter) was caused to flow at a rate of 2 milliliters per minute. Duration before the pressure loss reached 100 mmHg was 100 minutes, and spherical cell removal ratio at this time was 99% or higher and lymph cell removal ratio was 60%, thus proving a capability to select the spherical white blood cells related to inflammation. This is supposedly the effect of the voids existing between the nanofibers.

Example 23

A bovine blood serum including 15 milliliters of endotoxin was caused to flow through 0.5 g of the nonwoven fabric of nanofibers that had been made in Example 22 and sterilized in an autoclave, so as to evaluate the capability of adsorption (at 37° C., two hours). The concentration of endotoxin LPS decreased from 10.0 ng per milliliter to 1.5 ng per milliliter, indicating a high adsorption capability. This is supposedly because the active surface area of the nanofibers that is far greater than that of the conventional nylon fibers provides far more amino-terminals than in the conventional nylon fibers.

Example 24

Figure 18:
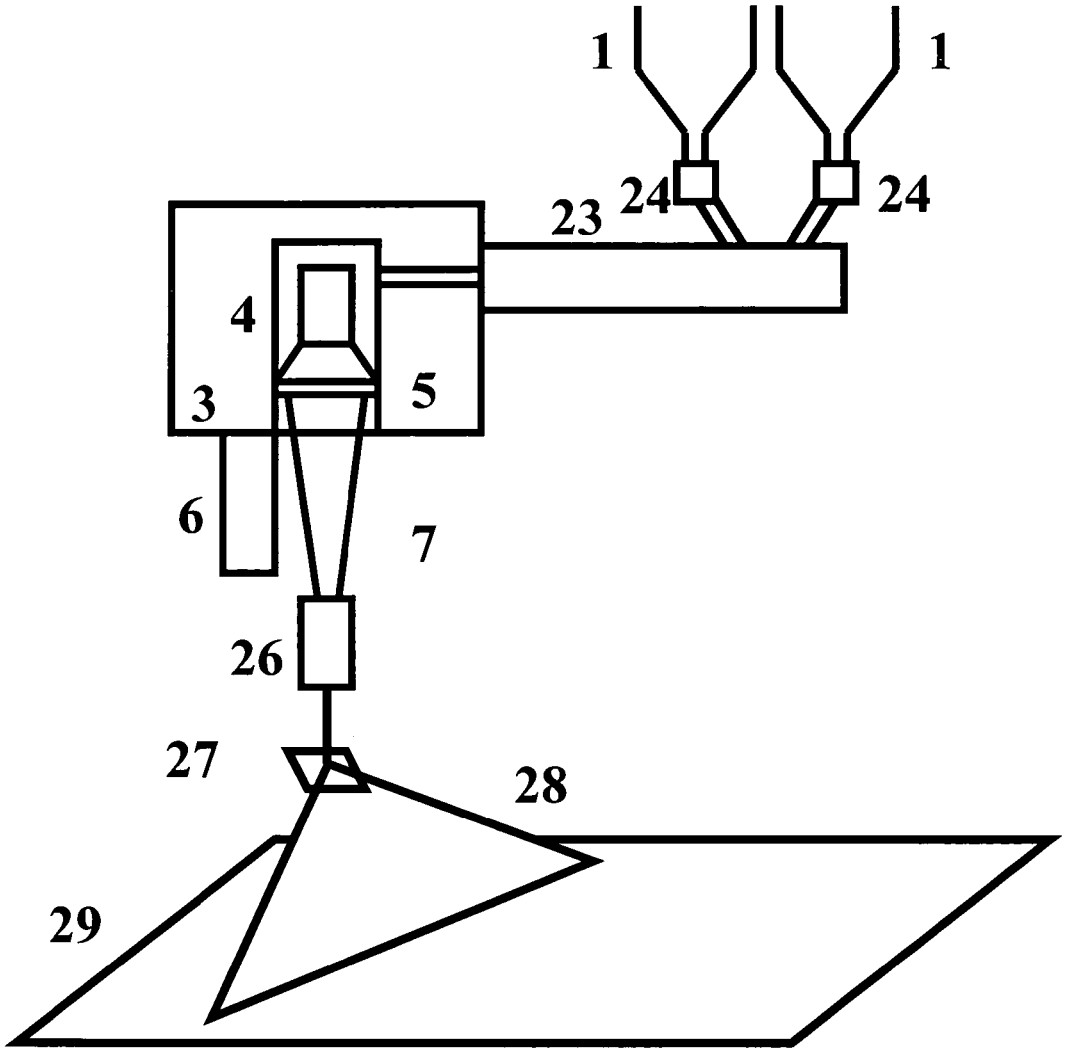
FIG. 18 is a diagram showing a spun bond spinning machine.
Figure 19:
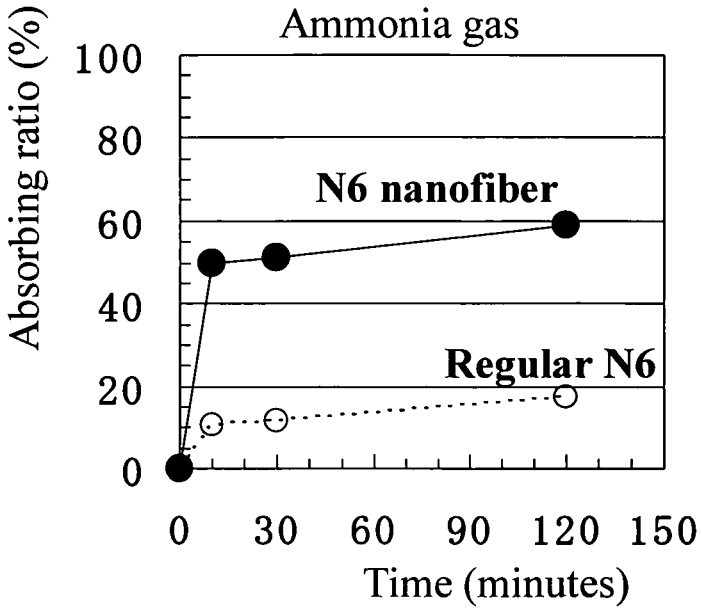
FIG. 19 is a graph showing an ammonia removing ratio.
Figure 20:
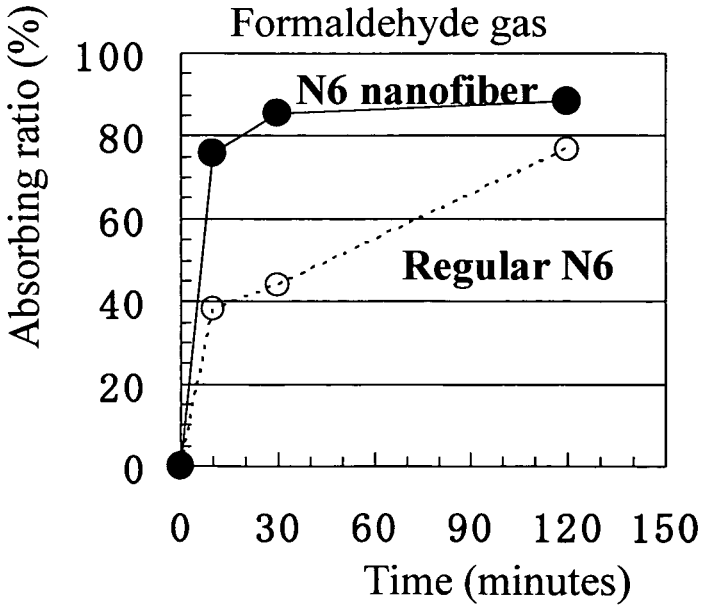
FIG. 20 is a graph showing a formaldehyde removing ratio.
Figure 21:
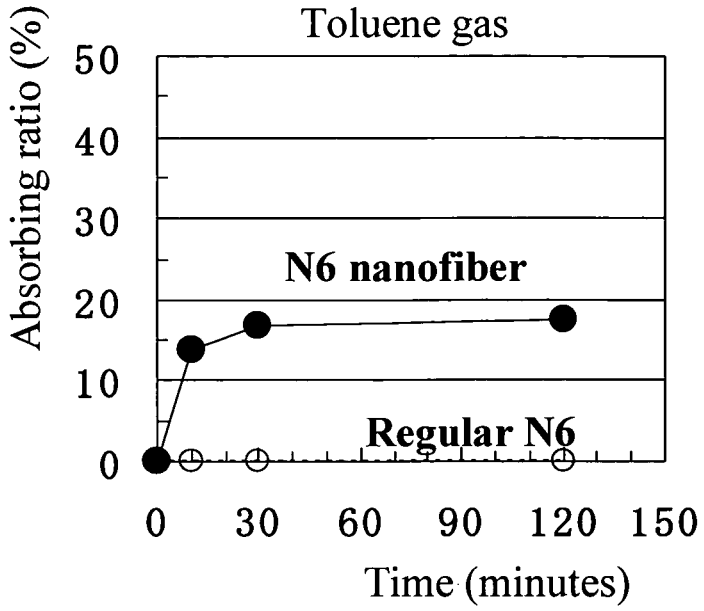
FIG. 21 is a graph showing a toluene removing ratio.
Figure 22:
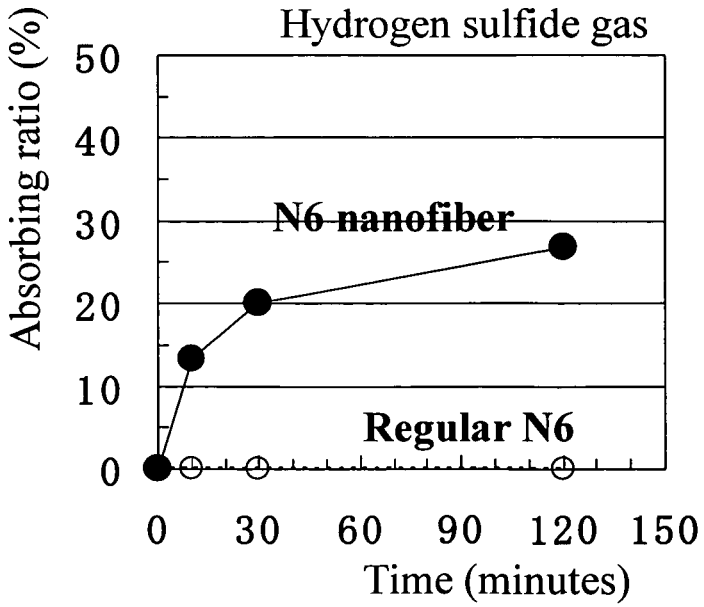
FIG. 22 is a graph showing a hydrogen sulfide removing ratio.

A spun-bonded nonwoven fabric was made using the same combination of polymers as in Example 13 and an apparatus shown in FIG. 18. Melting temperature was set to 225° C., spinning temperature was set to 230° C., and spinneret surface temperature was set to 217° C. in the twin-screw extrusion-kneader 23. The spinneret of the same specifications as in Example 1 was used with discharge per orifice of 0.8 gram per minute and the distance from the bottom surface of the spinneret to the cooling start point being set to 12 cm.

The nonwoven fabric of polymer alloy was treated in warm water of 60° C. for two hours so as to remove 99% or more of the polymer soluble to hot water by dissolution, thereby to obtain a nonwoven fabric made from the PLA nanofibers. The diameter of the nanofiber single fiber by number average was 50 nm ($2\times10^{-5}$ dtex). Fineness ratio of single fibers having fineness in a range from $1\times10^{-7}$ to $1\times10^{-4}$ dtex was 98% or more, and fineness ratio of single fiber having diameters that fall in a range from 45 to 74 nm was 70%.

Example 25

The round braids formed from the aggregate of nanofibers made in Examples 1 to 6 were immersed in 15% by weight aqueous solution of polyurethane prepolymer (molecular weight from 3000 to 4000) consisting of hexamethylene diisocyanate and hexamethylene polycarbonate having a molecular weight of 1000, for 30 minutes. The round braids were taken out of the solution and were processed for the linking of the polyurethane prepolymer at 120° C. for 20 minutes. This process caused the polyurethane prepolymer that infiltrated into the voids between the nanofibers to become insoluble through the linking reaction, thereby to form a multi-component material consisting of linked polyurethane and the N6 nanofibers. The multi-component material having a shape of round braid had high stretching capability and specific surface touch of sticking nature.

Example 26

The round braids of the aggregate of nanofibers made in Examples 1 to 6 were immersed in an ion exchange water, to which 1,2-bis(trimethoxysilyl)ethane was added and the solution was stirred for three hours. After being left to stand at the room temperature for 14 hours, the solution was stirred for 13 hours followed by another 14 hours of standing at the room temperature and seven hours of stirring thereby to polymerize silica. After washing in an ion exchange water, the round braids were dried in air. Through this process, a N6/silica composite material having the form of cloth with the N6 nanofibers acting as a template was obtained. It was an excellent material that showed both sufficient rigidity and resilience. It was also a hybrid material that had good flame retarding property.

Example 27

The N6/silica composite material obtained in Example 26 was fired at 600° C., so as to remove the N6 used as the template and obtain a silica sheet having numerous micropores of several tens of nanometers in diameter. The sheet showed excellent adsorbing and deodorizing capabilities.

Example 28

A knitted fabric formed from the aggregate of polyester nanofibers made in Examples 9 to 12 were caused to absorb a moisture adsorbent SR 1000 (10% water dispersion) available from TAKAMATSU OIL&FAT CO., LTD. Processing conditions were such that 20% owf of the moisture adsorbent was used as a solid component, bath ratio was set to 1:20, processing temperature was 130° C. and processing time was set to one hour. Absorbing ratio of this adsorbent by ordinary polyester fibers is substantially 0%. However, this aggregate of polyester nanofibers showed 10% or higher absorbing ratio, thus providing a knitted fabric of polyester having a high ratio of moisture adsorption of ΔMR=4% or more, which is comparable to or higher than that of cotton.

Example 29

Hybrid (Nanofiber/Organic Silicone)

A coating liquid of silicone polymer was prepared by dissolving methyltrimethoxysilane oligomer (n=3 or 4) in a solution of isopropyl alcohol and ethylene glycol mixed in 1:1 proportion and adding 4% by weight of dibutyltin diacetate as a polymerization catalyst to the silane oligomer. A woven fabric formed from the aggregate of N6 nanofibers made in Example 19 was immersed in the coating liquid at 30° C. for 20 minutes, so that the woven fabric was fully impregnated with the coating liquid. Then the woven fabric was taken out of the coating liquid and dried at 60° C. for 2 minutes, 80° C. for 2 minutes and 100° C. for 2 minutes, while accelerating the polymerization of silicone, thereby to obtain the woven fabric wherein the N6 nanofibers were coated with the silicon polymer. It showed excellent water repellant property and flame retarding property.

Example 30

Knitted fabrics formed from the aggregate of N6 nanofibers made in Examples 1 to 4 were tested to measure water content and water retention ratio thereof. This knitted fabric showed water content of 160% or more of its weight and water retention ratio of 80% or more of its weight. The water content and water retention ratio were calculated by the following equations. A sample immersed in a water tank for 60 minutes was weighed (Ag) after removing the water retained on the surface, then weighed (Bg) again after dewatered in a centrifugal dehydrator (dewatered for seven minutes at 3000 rpm), and weighed again (Cg) after being dried at 105° C. for 2 hours.

$$\text{Water content}(\%)=(A-C)/C\times 100(\%)$$

$$\text{Water retention ratio}(\%)=(B-C)/C\times 100(\%)$$

This knitted fabric formed from the aggregate of N6 nanofibers showed specific stickiness when 15% or more water was included therein.

Example 31

A base cloth for adhesive material was made by using the nonwoven fabric of the N6 nanofibers made in Example 22. When a medicine was applied to the base cloth, it showed a high absorbing capability and a high adhesiveness, thus making an excellent cataplasm.

Example 32

A bag was made from the knitted fabric formed from the aggregate of N6 nanofibers made in Example 1, and a cold insulator wrapped in an inner bag was put into the bag, thereby to make an ice pack. Dew drops of condensed moisture are adsorbed by the knitted fabric used in the ice pack bag that showed excellent adhesiveness. Accordingly, the ice pack bag does not likely to come off the body part where it is applied, and is easy to handle.

Example 33

Chemical contaminant removing capability of a round braid made from the aggregate of N6 nanofibers made in Example 1 was evaluated as follows. 1 gram of sample was put into a Tedlar bag having a capacity of 0.005 $m^3$ (5 liters), and air containing the chemical contaminant was introduced into the bag so that a predetermined concentration was attained. The contaminated air was successively sampled while monitoring the concentration of the chemical contaminant in the Tedlar bag with a gas chromatography.

Capability of removing ammonia, formaldehyde, toluene and hydrogen sulfide as the chemical contaminant was evaluated, and high removing capability was demonstrated (FIG. 19 to FIG. 22).

Comparative Example 9

A commercially available plain weave of N6 was tested to evaluate the chemical contaminant removing capability similarly to Example 33, and substantially no removing capability was shown.

Example 34

Pairs of socks were made from round braids formed from the N6 nanofibers made in Example 1, impregnated with "New Policain Liquid" available from TAIHO Pharmaceutical Co., Ltd. and was dried. The socks could deliver the medicine for athlete's foot, that was eluted by sweat. The socks were worn by ten subjects suffering athlete's foot, changing to new ones everyday. After repeating this for one month, seven subjects experienced a remission in the athlete's foot, supposedly due to the medicine released from the socks.

Thus the nanofibers of the present invention can be used in medical applications, because of the medicine releasing capability.

Example 35

The round braid made in Example 4 was immersed in 10% by weight aqueous solution of SILCOAT PP (a special modified silicone available from Matsumoto Yushi-Seiyaku Co., Ltd.), to give the treatment liquid to the round braid so that pickup ratio of the aqueous solution reached 150%. Then the round braid was dried in a relaxed state in an oven at 110° C. for three minutes. When crumpled after drying, the round braid showed delicate touch that was different from that obtained by buffing, and soft, moist and fresh hands like human skin. It also had cool feeling upon touch. When washed and dewatered while being contained in a net in a home laundering machine, the round braid showed high dimensional stability without deforming.

A T-shirt was made from a round braid formed from the N6 nanofibers having mass per unit area of 150 g/$m^2$ that was silicone-treated. The T-shirt was very comfortable due to a touch like human skin and had a healing effect. When washed and dewatered while being contained in a net in a home laundering machine, the T-shirt showed high dimensional stability without deforming.

Example 36

The polymer alloy fibers made in Example 4 were subjected to false twisting process by means of a friction disk twister, at a heat treatment temperature of 180° C. and a drawing ratio of 1.01. The false-twisted yarn thus obtained was subjected to alkali treatment similarly to Example 1, thereby to obtain a round braid having mass per unit area of 100 g/m$^2$ formed from the aggregate of nanofibers. Spread of single fiber fineness values of the nanofibers was analyzed similarly to Example 1 with a result showing such an unprecedented fineness as the single fiber diameter by number average was 84 nm ($6\times10^{-5}$ dtex). The fineness ratio of single fibers having fineness in a range from $1\times10^{-7}$ to $1\times10^{-4}$ dtex was 78%, and particularly fineness ratio of single fibers having diameters that fall in a range from 75 to 104 nm in diameter was 64%, with very small spread of single fiber fineness values. The false-twisted yarn made from the N6 nanofibers had a strength of 2.0 cN/dtex and an elongation of 45%.

When subjected to a silicone treatment similarly to Example 35, the round braid showed delicate touch and soft and moist hands like human skin. It also had cool feeling upon touch. When washed and dewatered while being contained in a net in a home laundering machine, the round braid showed high dimensional stability without deforming.

Example 37

Women's shorts were made from the round braid formed from the N6 nanofibers having mass per unit area of 100 g/m$^2$ that was silicone-treated, prepared in Example 36. The short panty was very comfortable due to a touch like human skin and had a healing effect. When washed and dewatered while being contained in a net in a home laundering machine, the short panty showed high dimensional stability without deforming.

Example 38

The false-twisted yarn made from the N6/copolymerized PET alloy prepared in Example 36 was used as a sheath yarn to cover "LYCRA®" available from OPELONTEX CO., LTD. The covering yarn was used to form a knitted fabric for tights, that was subjected to alkali treatment similarly to Example 36, thereby to prepare a knitted fabric for tights formed from nanofibers. The knitted fabric for tights had mass per unit area of 100 g/m$^2$. Weight proportions of the N6 nanofibers and the polyurethane fibers were 90% and 10%, respectively. The knitted fabric was immersed in 10% by weight aqueous solution of SILCOAT PP (a special modified silicone available from Matsumoto Yushi-Seiyaku Co., Ltd.), to give the treatment liquid to the knitted fabric so that pickup ratio of the aqueous solution reached 150%. Then the knitted fabric was dried in a relaxed state in an oven at 110° C. for three minutes. After drying and crumpling treatment, the knitted fabric was sewed into tights. The tights showed delicate touch and soft and moist hands like human skin. It provided very high wearing comfort.

Example 39

A N6/copolymerized PET polymer alloy fibers having 400 dtex and 96-filament were obtained by melt spinning similarly to Example 4 with a first take-up roller 9 to a speed (spinning speed) of 3500 meters per minute. The polymer alloy fibers had a strength of 2.5 cN/dtex, an elongation of 100% and U % of 1.9%. The polymer alloy fibers were drawn and false-twisted, thereby to obtain false-twisted yarn having 333 dtex and 96-filament. Heat treatment temperature was set to 180° C. and drawing ratio was set to 1.2. The false-twisted yarn thus obtained had a strength of 3.0 cN/dtex, elongation of 32%.

Soft twist of 300 turns per meter was applied to the false-twisted yarn that was then used as warp and weft in an S-twist/Z-twist two ply yarn, thereby to form a 2/2 twill woven fabric. The twill woven fabric was subjected to alkali treatment similarly to Example 1, thereby to prepare a cloth for curtain formed from N6 nanofibers having mass per unit area of 150 g/m$^2$. Spread of single fiber fineness values of the nanofibers was analyzed similarly to Example 1 with a result showing such an unprecedented fineness as the single fiber diameter by number average was 86 nm ($6\times10^{-5}$ dtex). Fineness ratio of single fibers having fineness in a range from $1\times10^{-7}$ to $1\times10^{-4}$ dtex was 78%, and particularly fineness ratio of the single fibers having diameters that fall in a range from 75 to 104 nm was 64%, with very small spread of single fiber fineness values. The false-twisted yarn made from the N6 nanofibers had a strength of 2.0 cN/dtex and an elongation of 40%.

When subjected to a silicone treatment similarly to Example 35, the curtain cloth showed delicate touch and soft and moist hands like human skin. It also had cool feeling upon touch. It also had sufficient ratio of moisture adsorption (ΔMR) of 6%. In a deodorization test using acetic acid, the concentration decreased from 100 ppm to 1 ppm in ten minutes, indicating that the curtain cloth had excellent deodorization performance. When curtains made from the cloth were hung in a room having an area of six Tatami mats, the air in the room was refreshed, and dew condensation was suppressed. When washed and dewatered while being contained in a washing net in a home washing machine, the curtain showed high dimensional stability without deforming.

Example 40

The N6/copolymerized PET polymer alloy used in Example 4 and the N6 having a melt viscosity of 500 Pa·s (262° C. at a shear rate of 121.6 sec$^{-1}$) and a melting point of 220° C. were melted separately and a core-in-sheath conjugated yarn was spun similarly to Example 4 using a spinneret having Y-shaped orifice. The core component was made of the N6/copolymerized PET polymer alloy and the sheath component was made of the N6, with the proportion of the core component set to 50% by weight. The spun yarn was taken up at a speed of 800 meters per minute, and was then drawn in two steps where the drawing ratio was set to 1.3 in the first step and the total drawing ratio was set to 3.5. The yarn was then taken up after crimping by means of a jet nozzle, thereby to obtain a bulky yarn of 500 dtex and 90-filament. The bulky yarn had a strength of 5.2 cN/dtex and an elongation of 25%.

Two strings of the bulky yarn were aligned and doubled, and were subjected to first twisting (200 T/m), with two strings of the yarn being subjected to secondary twisting (200 T/m). After applying twist setting treatment by drying at 170° C., the yarn was tufted to form a cut pile carpet by a known method. Tufting was carried out by controlling the stitches so as to obtain 1/10 gauge and mass per unit area of 1500 g/m$^2$ by ordinary level cut. Then a backing was applied. When tufting, such a backing fabric was used that was woven from a mixed yarn of acrylic fibers and polyester fibers. Only the cut-pile portion was subjected to alkali treatment, thereby to make such a structure as the N6 nanofiber was wrapped by the N6 in the cut-pile portion. The N6 nanofiber had a single fiber diameter by number average of 86 nm ($6\times10^{-4}$ dtex). Fineness ratio of single fibers having fineness in a range from $1\times10^{-7}$ to $1\times10^{-4}$ dtex was 78%, and particularly fineness ratio of single fibers having diameters that fall in a range from 75 to 104 nm was 64%, with very small spread of single fiber fineness values. The cut-pile portion had mass per unit area of 1200 g/m$^2$ and weight proportion of the N6 was 33% of the cut-pile portion and 15% of the entire carpet. Since the cut-pile portion supports the N6 nanofibers by means of the sheath component N6, the carpet did not have a problem of flattening of pile. Since content of the N6 nanofibers was 15% by weight, the carpet had sufficient hygroscopic performance and deodorization performance, and was capable of refreshing the room environment and suppressing the dew condensation.

Example 41

Four strings of the false-twisted yarn of the N6/copolymerized PET polymer alloy obtained in Example 36 were conjoined and used as warp and weft, to form a 2/2 twill woven fabric. The twill woven fabric was subjected to alkali treatment similarly to Example 36, thereby to prepare a cover for interior seat formed from the false-twisted yarn of the N6 nanofibers having mass per unit area of 200 g/m$^2$. Spread of single fiber fineness values of the N6 nanofibers was analyzed similarly to Example 1 with a result showing such an unprecedented fineness as the single fiber diameter by number average was 86 nm ($6\times10^{-5}$ dtex). Fineness ratio of single fibers having fineness in a range from $1\times10^{-7}$ to $1\times10^{-4}$ dtex was 78%, and particularly fineness ratio of the single fibers having diameters that fall in a range from 75 to 104 nm was 64%, with very small spread of single fiber fineness values. When this fabric was used in the upholstery of a chair, it showed soft hands and comfortable feeling. It also showed sufficient hygroscopic performance and deodorization performance, and was capable of refreshing the room environment.

Example 42

The N6/copolymerized PET polymer alloy used in Example 4 and the N6 having a melt viscosity of 500 Pa·s (262° C. at a shear rate of 121.6 sec$^{-1}$) and a melting point of 220° C. used in Example 4 were melted separately and a core-in-sheath conjugated yarn was spun similarly to Example 4 using a spinneret having circular orifices. The core component was made of the N6/copolymerized PET polymer alloy and the sheath component was made of the N6, with the proportion of the core component set to 30% by weight. The spun yarn was taken up at a speed of 1600 meter per minute and was then drawn with the temperature of the first hot roller 17 being set to 90° C., the temperature of the second hot roller 18 being set to 130° C., and the drawing ratio set to 2.7. The polymer alloy fibers thus obtained had 220 dtex and 144-filament, a strength of 4.8 cN/dtex, an elongation of 35% and U % of 1.9%. This was subjected to soft twist of 300 turns per meter and was used as a warp and a weft to form a plain weave. This weave was subjected to alkali treatment similarly to Example 4, thereby to obtain a weave having mass per unit area of 220 g/m$^2$ formed from fibers consisting of the N6 nanofiber covered by the sheath component N6. Single fiber diameter by number average of the N6 nanofibers thus obtained was 86 nm ($6\times10^{-4}$ dtex). Fineness ratio of single fibers having diameters that fall in a range from $1\times10^{-7}$ to $1\times10^{-4}$ dtex was 78%, and particularly fineness ratio of single fibers having diameters that fall in a range from 75 to 104 nm in diameter was 64%, with very small spread of single fiber fineness values. When subjected to a silicone treatment similarly to Example 36, the fabric showed delicate touch and soft and moist hands like human skin. This fabric was used to make a quilt cover and a bed sheet, that were very comfortable due to excellent hands and moisture adsorbing capability. It also had high deodorizing capability and, even when wetted by incontinence, could suppress the odor. When washed and dewatered while being contained in a net in a home laundering machine, these bedding articles showed high dimensional stability without deforming.

Example 43

A N6/copolymerized PET polymer alloy fibers having 264 dtex and 144-filament were obtained by core-in-sheath multicomponent spinning similarly to Example 40 with speed of the first take-up roller 9 set to 3500 meters per minute. The polymer alloy fibers had a strength of 3.5 cN/dtex, an elongation of 110% and U % of 1.9%. The polymer alloy fibers were drawn and false-twisted, thereby to obtain a false-twisted yarn having 220 dtex and 144-filament. Heat treatment temperature was set to 180° C. and drawing ratio was set to 1.2. The false-twisted yarn thus obtained had a strength of 4.1 cN/dtex and an elongation of 32%.

Soft twist of 300 turns per meter was applied to the false-twisted yarn that was then used as warp and weft, to form a plain weave. The plain weave was subjected to alkali treatment similarly to Example 1, thereby to prepare a woven fabric where the N6 nanofibers having mass per unit area of 100 g/m$^2$ were covered by the sheath component N6. Spread of single fiber fineness values of the nanofibers was analyzed similarly to Example 1 with a result showing such an unprecedented fineness as the single fiber diameter by number average was 86 nm ($6\times10^{-5}$ dtex). Fineness ratio of single fibers having diameters that fall in a range from $1\times10^{-7}$ to $1\times10^{-4}$ dtex was 78%, and particularly fineness ratio of single fibers having diameters that fall in a range from 75 to 104 nm in diameter was 64%, with very small spread of single fiber fineness values. This fabric had such a structure as the N6 nanofibers were encapsulated in hollow fibers of the N6, and showed soft and resilient hands like marsh mallow. The false-twisted yarn made from the N6 nanofibers had a strength of 2.9 cN/dtex and an elongation of 41%.

When subjected to a silicone treatment similarly to Example 35, this woven fabric showed delicate touch and soft and moist hands like human skin. It also had cool feeling upon touch. It also had a sufficient ratio of moisture adsorption (ΔMR) of 6%. This woven fabric was used to make a shirt for women, that was very comfortable to wear and had a healing effect. When washed and dewatered in a home laundering machine without being contained in a net, the shirt did not deform and showed higher dimensional stability because the N6 nanofibers were encapsulated in the hollow fibers of N6.

Example 44

The false-twisted yarn of the N6/copolymerized PET polymer alloy fibers prepared in Example 39 were used as a base structure to form a tricot knitted fabric having a raised pile section formed from a polybutylene terephthalate (PBT) yarn of 100 dtex, 36-filament, with a knitting density of 64 courses using a 28-gauge knitting machine. The tricot knitted fabric was immersed in a 10% aqueous solution of sodium hydroxide (90° C., bath ratio 1:100) for one hour, thereby to remove 99% or more of the copolymerized PET through hydrolysis and obtain a cloth for vehicle interior. The cloth for vehicle interior thus obtained had mass per unit area of 130 g/m$^2$ and N6 nanofiber content of 40% by weight. The N6 nanofiber section had mass per unit area of 120 g/m$^2$. The nanofibers had such an unprecedented fineness as the single fiber diameter by number average was 84 nm ($6\times10^{-5}$ dtex). Fineness ratio of single fibers having diameters that fall in a range from $1\times10^{-7}$ to $1\times10^{-4}$ dtex was 78%, and particularly fineness ratio of single fibers having diameters that fall in a range from 75 to 104 nm in diameter was 64%, with very small spread of single fiber fineness values. The cloth was immersed in a 3% aqueous solution of diethylenetriamine at 50° C. for one minute, thereby to let diethylenetriamine supported by the N6 nanofibers. In a test to evaluate the capability to remove acetaldehyde of this cloth, the concentration decreased from 30 ppm to 1 ppm in ten minutes, indicating that the cloth had excellent capability to remove the chemical.

Example 45

The N6/copolymerized PET polymer alloy and the PBT having a melt viscosity of 240 Pa·s (262° C. at a shear rate of 121.6 $sec^{-1}$) and a melting point of 220° C. used in Example 4 were melted separately and spinning of a islands-in-sea multi-component yarn was carried out similarly to Example 4 using a spinneret having 24 holes, an orifice diameter of 1.0 mm and an orifice length of 1.0 mm. The sea component was made of the N6/copolymerized PET polymer alloy and the island component was made of the PBT, with the proportion of the island component set to 35% by weight and the number of islands per hole was set to 36. The spun yarn was taken up at a speed of 900 meters per minute, and was then drawn with the temperature of the first hot roller 17 being set to 85° C., the temperature of the second hot roller 18 being set to 130° C., and the drawing ratio set to 3.0. An islands-in-sea multi-component yarn obtained after heat treatment had 240 dtex and 24-filament, a strength of 3.0 cN/dtex, an elongation of 40% and U % of 2.0%, with the polymer alloy forming the sea component and the PBT forming the island component. This was subjected to soft twist of 300 turns per meter and was used as a warp and a weft to form a 2/2 twill woven fabric. This woven fabric was immersed in a 10% aqueous solution of sodium hydroxide (90° C., bath ratio 1:100), thereby to remove 99% or more of the copolymerized PET from the polymer alloy fibers by hydrolysis. As a result, a woven fabric having mass per unit area of 200 $g/m^2$ was formed from a mixed yarn of the N6 nanofibers and the PBT ultrafine yarn (0.08 dtex), wherein contents of the N6 nanofibers and the PBT were 48% and 52% by weight, respectively. The N6 nanofibers had such an unprecedented fineness as the single fiber diameter by number average was 84 nm ($6\times10^{-5}$ dtex). Fineness ratio of single fibers having diameters that fall in a range from $1\times10^{-7}$ to $1\times10^{-4}$ dtex was 78%, and particularly fineness ratio of sing fibers having diameters in a range from 75 to 104 nm was 64%, with very small spread of single fiber fineness values.

In this woven fabric, the N6 nanofibers were separated by the electrostatic repulsion due to the difference in electrification between the N6 and the PBT, so that the woven fabric showed ultra-soft feeling like peach skin and excellent hands like human skin without applying burring or silicone treatment. Moreover, since the PBT supports the woven fabric as skeleton, it has not only an improved dimensional stability but also a high resilience. A windbreaker made using this woven fabric not only had excellent wind shielding performance due to the N6 nanofibers being separated but also did not generate rustling sound even when the wearer moved violently in a sport activity, due to the ultra-soft hands. Moreover, it provided an excellent wearing comfort due to high moisture adsorbing capability developed by the N6 nanofibers. When washed and dewatered in a home laundering machine without being contained in a net, the weave showed high dimensional stability without deforming.

Example 46

The aggregate of nanofibers obtained in Example 1 was separated by beating in water, to which 0.1% by weight of a nonionic dispersant including polyoxyethylenestyrene-sulfonated ether as a main component was added thereby to obtain N6 nanofibers-dispersed water. Content of the N6 nanofibers in water was 1% by weight. The N6 nanofibers-dispersed water was poured onto a composite including carbon fibers and caused to flow, dry and solidify, thereby to coat the surface of the carbon fiber composite with a thin film of the N6 nanofibers. This improved the hydrophilicity of the carbon fiber composite.

Example 47

The polymer alloy fibers made in Example 1 were formed into a tow of $10\times10^{-4}$ dtex, that was then cut into small fibers having length of 2 mm. These fiber pieces were subjected to alkali treatment similarly to Example 1, thereby to obtain an aggregate of nanofibers. The alkaline aqueous solution including the aggregate of nanofibers dispersed therein was neutralized with dilute hydrochloric acid, to which 0.1% by weight of a nonionic dispersant including polyoxyethylenestyrene-sulfonated ether as a main component was added. Then the fibers dispersed in the solution was assembled into a sheet, thereby to obtain an nonwoven fabric. The nonwoven fabric thus obtained included the aggregate of nanofibers dispersed therein having sizes of 300 nm or less, unlike the nonwoven fabric that was subjected to needle punching in which the aggregate of nanofibers coagulated to sizes of 10 μm or less. The aggregate of nanofibers was drawn out of the nonwoven fabric and spread of single fiber fineness values of the nanofibers was analyzed similarly to Example 1 with a result showing such an unprecedented fineness as the single fiber diameter by number average was 60 nm ($3\times10^{-5}$ dtex). Fineness ratio of single fibers having diameters that fall in a range from $1\times10^{-7}$ to $1\times10^{-4}$ dtex was 99%, and particularly fineness ratio of single fibers having diameters that fall in a range from 55 to 84 nm in diameter was 70%, with very small spread of single fiber fineness values.

Example 48

Melting and kneading operations were carried out similarly to Example 1, except for using a poly-L lactic acid (optical purity 99.5% or higher) having mean molecular weight of $1.2\times10^5$, a melt viscosity of 30 Pa·s (240° C. at a shear rate of 2432 $sec^{-1}$) and a melting point of 170° C. instead of the copolymerized PET and setting the kneading temperature to 220° C., thereby to obtain polymer alloy chips having a b* value of 3. Mean molecular weight of the poly-lactic acid was determined in the following manner. Tetrahydrofuran (hereinafter abbreviated as THF) was added to a chloroform solution of a sample to prepare a measurement solution. The solution was analyzed at 25° C. with a gel permeation chromatography (GPC) Waters 2690 available from Waters Inc. and mean molecular weight was determined as an equivalent value of corresponding polystyrene. The N6 used in Example 1 had a melt viscosity of 57 Pa·s at 240° C. at a shear rate of 2432 $sec^{-1}$. The poly-L lactic acid had a melt viscosity of 86 Pa·s at 215° C. at a shear rate of 1216 $sec^{-1}$.

The polymer alloy chips were subjected to melt spinning similarly to Example 1, except for setting the melting temperature to 230° C., spinning temperature to 230° C. (spinneret surface temperature 215° C.) and the spinning speed to 3500 meters per minute. While an ordinary spinneret having an orifice diameter of 0.3 mm and an orifice length of 0.55 mm was used, substantially no Barus phenomenon occurred. Spinnability was improved significantly even when compared to Example 1, and no yarn breakage occurred during spinning of 1*t*. Discharge per orifice was set to 0.94 grams per minute. Highly oriented undrawn yarn of 92 dtex and 36-filament was obtained, that was an excellent highly oriented undrawn yarn having a strength of 2.4 cN/dtex, an elongation of 90%, boiling water shrinkage of 43% and U % of 0.7%. Particularly as the Barus was greatly reduced, yarn unevenness was greatly improved.

The highly oriented undrawn yarn was subjected to drawing and annealing similarly to Example 1 except for setting the drawing temperature to 90° C., drawing ratio to 1.39 and thermal set temperature to 130° C. The drawn yarn had 67 dtex and 36-filament, and showed such very good properties as a strength of 3.6 cN/dtex, an elongation of 40%, boiling water shrinkage of 9% and U % of 0.7%.

Observation of a cross section of the polymer alloy fiber under a TEM showed islands-in-sea structure where the PLA formed the sea (light portion) and the N6 formed the islands (dark portion). The diameter of the N6 island domain by number average was 55 nm, indicating that the N6 was uniformly dispersed on the nanometer order in the polymer alloy fiber.

The polymer alloy fibers thus obtained were formed into a round braid and then subjected to alkali treatment similarly to Example 1, thereby to remove 99% or more of the PLA from the polymer alloy fibers by hydrolysis. Spread of single fiber fineness values of the nanofibers in the aggregate of nanofibers obtained as described above was analyzed similarly, to Example 1 with a result showing such an unprecedented fineness as the single fiber diameter by number average was 60 nm ($3\times10^{-5}$ dtex), with very small spread of single fiber fineness values.

The ratio of moisture adsorption (ΔMR) of the round braid formed from the aggregate of nanofibers was 6%, and the rate of elongation in the longitudinal direction of yarn at absorbing water was 7%. A yarn comprising the aggregate of N6 nanofibers showed a strength of 2.0 cN/dtex and an elongation of 45%. 140° C. dry heat shrinkage ratio was 3%. When the round braid was buffed, it showed fresh hands providing ultra-soft feeling like peach skin, or soft and moist touch like human skin which have never been realized by the ultrafine fibers of the prior art.

Example 49

Melting and kneading operations were carried out similarly to Example 1, except for using a copolymerized polystyrene (co-PS) containing 22% of 2-ethylhexylacrylate unit and the copolymerized PET used in Example 9 and setting the content of the copolymerized PET to 20% by weight and the kneading temperature to 235° C., thereby to obtain polymer alloy chips having a b* value of 2. The co-PS had a melt viscosity of 140 Pa·s at 262° C. at a shear rate of 121.6 $sec^{-1}$ and a melt viscosity of 60 Pa·s at 245° C. at a shear rate of 1216 $sec^{-1}$.

The polymer alloy chips were subjected to melt spinning similarly to Example 1, except for setting the melting temperature to 260° C., spinning temperature to 260° C. (spinneret surface temperature 245° C.) and the spinning speed to 1200 meters per minute. A spinneret similar to that used in Example 1 was used. In this procedure, the fiber showed good spinnability and was broken only once during the spinning of 1*t*. Discharge per orifice was set to 1.15 grams per minute. The undrawn yarn thus obtained was subjected to drawing and annealing similarly to Example 1, by setting the drawing temperature to 100° C., drawing ratio to 2.49, using a heating plate having an effective length of 15 cm instead of the hot roller as the thermal setting device and annealing temperature to 115° C. A drawn yarn of 166 dtex and 36-filament was obtained, that had a strength of 1.2 cN/dtex, an elongation of 27% and U % of 2.0%.

Observation of a cross section of the polymer alloy fiber under a TEM showed islands-in-sea structure where the co-PS formed the sea (light portion) and the copolymerized PET formed the islands (dark portion). The diameter of the copolymerized PET island domain by number average was 50 nm, indicating that the copolymerized PET was uniformly dispersed on the nanometer order in the polymer alloy fiber.

The polymer alloy fibers thus obtained were formed into a round braid similarly to Example 1 and was immersed in

TABLE 14

| | Number-average diameter of island domains (nm) | Spread of island domains: Area ratio (%) | Spread of island domains: Range (Range of diameters: Area ratio) | Strength (cN/dtex) | U % (%) |
|---|---|---|---|---|---|
| Example 48 | 55 | 100 | 45-74 nm: 73% | 3.6 | 0.7 |
| Example 49 | 50 | 100 | 45-74 nm: 70% | 1.2 | 2.0 |
| Example 50 | 45 | 100 | 35-64 nm: 70% | 1.4 | 2.0 |
| Example 51 | 50 | 100 | 45-74 nm: 70% | 1.3 | 2.0 |
| Example 52 | 40 | 100 | 35-64 nm: 70% | 1.3 | 2.0 |

Area ratio: Area ratio of island domains having diameters in a range from 1 to 100 nm.

Range: Area ratio in a section 30 nm wide in diameters.

TABLE 15

| | Number-average of nanofibers: Diameter (nm) | Number-average of nanofibers: Fineness (dtex) | Spread of nanofibers: Fineness ratio (%) | Spread of nanofibers: Range (Range of diameters: Fineness ratio) | Strength of aggregate of nanofibers (cN/dtex) |
|---|---|---|---|---|---|
| Example 48 | 60 | $3\times10^{-5}$ | 99 | 55-84 nm: 70% | 2.0 |
| Example 49 | 55 | $3\times10^{-5}$ | 100 | 45-74 nm: 70% | 2.0 |
| Example 50 | 50 | $2\times10^{-5}$ | 100 | 45-74 nm: 70% | 2.0 |
| Example 51 | 55 | $3\times10^{-5}$ | 100 | 45-74 nm: 70% | 2.0 |
| Example 52 | 40 | $1\times10^{-5}$ | 100 | 35-64 nm: 70% | 2.0 |

Fineness ratio: Fineness ratio of single fiber fineness in a range from $1\times10^{-7}$ to $1\times10^{-4}$ dtex Range: Area ratio in a section 30 nm wide in diameters.

tetrahydrofuran (THF), thereby to elute 99% or more of the co-PS, the sea component. Spread of single fiber fineness values of the nanofibers in the aggregate of nanofibers obtained as described above was analyzed similarly to Example 1 with a result showing such an unprecedented fineness as the single fiber diameter by number average was 55 nm ($3\times10^{-5}$ dtex), with very small spread of single fiber fineness values.

The polymer alloy fibers were conjoined into a tow of $10\times10^{-4}$ dtex, that was cut into small fibers having length of 2 mm. These fiber pieces were subjected to THF treatment so as to elute the co-PS and obtain nanofibers. The THF liquid including the nanofibers dispersed therein was subjected to solvent substitution of alcohol, then water, and was subjected to separation by beating. The fibers dispersed therein were then assembled into a sheet, thereby to obtain a nonwoven fabric. The nonwoven fabric thus obtained was constituted from the nanofibers dispersed to the level of single fibers.

Example 50

Melting and kneading operations were carried out similarly to Example 1, except for using the PBT used in Example 11 and the co-PS used in Example 49, and setting the content of the PBT to 20% by weight and the kneading temperature to 240° C., thereby to obtain polymer alloy chips having a b* value of 2.

The polymer alloy chips were subjected to melt spinning similarly to Example 1, except for setting the melting temperature to 260° C., spinning temperature to 260° C. (spinneret surface temperature 245° C.) and the spinning speed to 1200 meters per minute. A spinneret similar to that used in Example 1 was used. In this procedure, the fiber showed good spinnability and was broken only once during the spinning of 1*t*. Discharge per orifice was set to 1.0 gram per minute. The undrawn yarn thus obtained was subjected to drawing and annealing similarly to Example 49. A drawn yarn of 161 dtex and 36-filament was obtained, that had a strength of 1.4 cN/dtex, an elongation of 33% and U % of 2.0%.

Observation of a cross section of the polymer alloy fiber under a TEM showed islands-in-sea structure where the co-PS formed the sea (light portion) and the copolymerized PET formed the islands (dark portion). The diameter of the copolymerized PET island domain by number average was 45 nm, indicating that the copolymerized PET was uniformly dispersed on the nanometer order in the polymer alloy fiber.

The polymer alloy fibers thus obtained were formed into a round braid similarly to Example 1 and was immersed in trichloroethylene, thereby to remove 99% or more of the co-PS, the sea component. Spread of single fiber fineness values of the nanofibers in the aggregate of nanofibers obtained as described above was analyzed similarly to Example 1 with a result showing such an unprecedented fineness as the single fiber diameter by number average was 50 nm ($2\times10^{-5}$ dtex), with very small spread of single fiber fineness values.

Example 51

Melting and kneading operations were carried out similarly to Example 1, except for using the PTT used in Example 12 and a copolymerized PS available from Nippon Steel Chemical Co., Ltd. (ESTYRENE® KS-18, copolymerization of methyl methacrylate, melt viscosity of 110 Pa·s at 262° C. at a shear rate of 121.6 $sec^{-1}$) and setting the PTT content to 20% by weight and the kneading temperature to 240° C., thereby to obtain polymer alloy chips having a b* value of 2. The copolymerized PS had a melt viscosity of 76 Pa·s at 245° C. at a shear rate of 1216 $sec^{-1}$.

The polymer alloy chips were subjected to melt spinning similarly to Example 1, except for setting the melting temperature to 260° C., the spinning temperature to 260° C. (spinneret surface temperature 245° C.) and the spinning speed to 1200 meters per minute. Such a spinneret similar to that used in Example 1 was used as the weighing section 12 having a diameter of 0.23 mm was provided above the orifice, orifice diameter 14 was 2 mm and orifice length 13 was 3 mm, as shown in FIG. 13. In this procedure, the fiber showed good spinnability and was broken only once during the spinning of 1*t*. Discharge per orifice was set to 1.0 gram per minute. The undrawn yarns thus obtained were conjoined into a tow that was drawn with a drawing ratio of 2.6 in a warm water bath at 90° C., and mechanically crimped. Then the crimped yarn was cut into fibers having length of 51 mm, separated by means of carding, and was formed into a web with a cross-wrap webber. The web was turned into a nonwoven fabric of entangled fibers of 300 g/$m^2$. The nonwoven fabric was impregnated with a solution consisting of 13% by weight of a polyurethane compound (PU) including polyether-based polyurethane as a main component and 87% by weight of N,N'-dimethylformamide (DMF), and the PU was solidified in an aqueous solution having DMF content of 40% by weight. Then the fabric was washed in water. The nonwoven fabric was subjected to trichloroethylene treatment so as to elute the copolymerized PS, thereby to obtain a nanofiber structure constituted from PTT nanofibers and the PU having thickness of about 1 mm. One side of the nanofiber structure was buffed with a sand paper to reduce the thickness to 0.8 mm. The other side of this fabric was processed with an emery buffer machine, thereby to form an artificially raised surface of the aggregate of nanofibers that was then dyed and finished to produce a suede-like synthetic leather. The article thus obtained had excellent hands with not only higher softness and fineness than the conventional synthetic leather but also high resilience.

Observation of a cross section of the cut fiber under a TEM showed islands-in-sea structure where the copolymerized PS formed the sea (light portion) and the copolymerized PET formed the islands (dark portion). The diameter of the copolymerized PET island domain by number average was 50 nm, indicating that the copolymerized PET was uniformly dispersed on the nanometer order in the polymer alloy fiber. The polymer alloy fibers had a single fiber fineness of 3.9 dtex, a strength of 1.3 cN/dtex, and an elongation of 25%.

The yarn before being cut into cut fibers was sampled, and the polymer alloy fibers thus obtained were formed into a round braid similarly to Example 1 and was immersed in trichloroethylene, thereby to remove 99% or more of the copolymerized PS, or the sea component. Spread of single fiber fineness values of the nanofibers in the aggregate of nanofibers obtained as described above was analyzed similarly to Example 1 with a result showing such an unprecedented fineness as the single fiber diameter by number average was 55 nm ($3\times10^{-5}$ dtex), with very small spread of single fiber fineness values.

Example 52

Melting and kneading operations were carried out similarly to Example 49, except for using the PLA used in Example 48 and the co-PS used in Example 49, and setting the content of the PLA to 20% by weight and the kneading temperature to 215° C., thereby to obtain polymer alloy chips having a b* value of 2.

The polymer alloy chips were subjected to melt spinning operation similarly to Example 1, except for setting the melting temperature to 230° C., the spinning temperature to 230° C. (spinneret surface temperature 215° C.) and the spinning speed to 1200 meters per minute. A spinneret having an orifice diameter of 2 mm and a weighing section of a diameter 0.23 mm provided above the orifice was used. In this procedure, the fiber showed good spinnability and was broken only once during the spinning of 1*t*. Discharge per orifice was set to 0.7 grams per minute. The undrawn yarn thus obtained was subjected to drawing and annealing similarly to Example 49. A drawn yarn of 111 dtex and 36-filament was obtained, that had a strength of 1.3 cN/dtex, an elongation of 35% and U % of 2.0%.

Observation of a cross section of the polymer alloy fiber under a TEM showed islands-in-sea structure where the co-PS formed the sea (light portion) and the PLA formed the islands (dark portion). The diameter of the PLA island domain by number average was 40 nm, indicating that the PLA was uniformly dispersed on the nanometer order in the polymer alloy fiber.

The polymer alloy fibers thus obtained were formed into a round braid similarly to Example 49 and was immersed in trichloroethylene, thereby to elute 99% or more of the co-PS, or the sea component. Spread of single fiber fineness values of the nanofibers in the aggregate of nanofibers obtained as described above was analyzed similarly to Example 1 with a result showing such a sufficient fineness as the single fiber diameter by number average was 40 nm ($1\times10^{-5}$ dtex), with very small spread of single fiber fineness values.

Example 53

5 grams of a round braid formed from the aggregate of nanofibers prepared in Example 48 was dried at 110° C. for one hour, and was immersed in a treatment liquid of the composition shown below, so as to fully impregnate the aggregate of nanofibers with diphenyldimethoxysilane. The treated cloth was washed carefully in pure water, followed by curing at 140° C. for three minutes, so that diphenyldimethoxysilane was polymerized within the aggregate of nanofibers. The cloth was then washed ten times in a home laundering machine and dried at 110° C. for one hour. When weighed, the cloth showed an increase of 38% in weight compared to that before treatment. Thus it was proved that a hybrid material can be made by supporting diphenyl silicone on the aggregate of nanofibers. Diphenyl silicone showed sufficient durability against laundering.

<Composition of Treatment Liquid>

Diphenyldimethoxysilane: 100 ml

Pure water: 100 ml

Ethanol: 300 ml

10% hydrochloric acid: 50 drops

Example 54

The knitted fabric formed from the aggregate of PBT nanofibers prepared in Example 50 was caused to absorb squalene, a natural oil component extracted from shark liver that has skin care effect by keeping the skin moist. This process was carried out under such conditions as a mixture of 60% of squalene and 40% of emulsifying dispersant was dispersed in water with a concentration of 7.5 grams per liter, while setting the bath ratio to 1:40, temperature to 130° C. and treatment time to 60 minutes. After the treatment, the cloth was washed at 80° C. for two hours. Quantity of squalene deposited at this time was 21% by weight of the cloth. After washing 20 times in a home laundering machine, remaining quantity of squalene deposited on the cloth was 12% by weight of the cloth, indicating sufficient durability against washing.

Socks were made from the round braid formed from the aggregate of PBT nanofibers processed with squalene. Ten subjects who complained severe drying of their heels were asked to wear the socks for one week. Eight of the subjects reported that the dry skin was improved. This is supposedly because squalene that had been trapped in the aggregate of nanofibers was gradually extracted by the wear's sweat and made contact with the skin.

Example 55

A highly oriented undrawn yarn of N6/PLA polymer alloy having 400 dtex and 144-filament was obtained by melt spinning similarly to Example 48, except for setting the N6 content to 35%. The highly oriented undrawn yarn was subjected to drawing and annealing similarly to Example 48. A drawn yarn thus obtained was 288 dtex, 96-filament yarn and showed good properties of a strength of 3.6 cN/dtex, an elongation of 40%, boiling water shrinkage of 9% and U % of 0.7%.

Observation of a cross section of the polymer alloy fiber under a TEM showed islands-in-sea structure where the PLA formed the sea (light portion) and the N6 formed the islands (dark portion). The diameter of the N6 island domain by number average was 62 nm, indicating that the N6 was uniformly dispersed on the nanometer order in the polymer alloy fiber. The polymer alloy fibers were mixed by air with a false-twisted yarn of N6 having 165 dtex and 96-filament that was prepared separately, while applying 15% over feed, so as to make a mixed yarn. Soft twist of 300 turns per meter was applied to the mixed yarn that was then used as warp and weft in an S-twist/Z-twist two ply yarn, thereby to form a 2/2 twill woven fabric. The twill woven fabric was subjected to alkali treatment similarly to Example 48, thereby to prepare a cloth for curtain formed from N6 nanofibers having mass per unit area of 150 g/m$^2$. The N6 nanofibers were located so as to cover the false-twisted yarn of N6 in the curtain cloth, and most of the nanofibers were exposed on the surface of the woven fabric. Spread of single fiber fineness values of the nanofibers was analyzed similarly to Example 1 with a result showing such an unprecedented fineness as the single fiber diameter by number average was 67 nm ($4\times10^{-5}$ dtex). Fineness ratio of single fibers having diameters that fall in a range from $1\times10^{-7}$ to $1\times10^{-4}$ dtex was 82%, and particularly fineness ratio of the single fibers having diameters that fall in a range from 55 to 84 nm was 60%, with very small spread of single fiber fineness values. The N6 nanofibers had a strength of 2.0 cN/dtex and an elongation of 40%.

When subjected to a silicone treatment similarly to Example 35, the curtain cloth showed delicate touch and soft and moist hands like human skin. It also had cool feeling upon touch. It also showed a sufficient ratio of moisture adsorption (ΔMR) of 4%. In a deodorization test using acetic acid, the concentration decreased from 100 ppm to 1 ppm in ten minutes, indicating that the curtain cloth had excellent deodorization performance. When curtains made from the cloth were hung in a room having an area of six Tatami mats, the air in the room was refreshed, and dew condensation was suppressed. When washed and dewatered while being contained in a washing net in a home laundering machine, the curtain showed high dimensional stability without deforming.

INDUSTRIAL APPLICABILITY

The aggregate of nanofibers of the present invention allows it to make a cloth having excellent hands and a high-performance texturing cloth that could not be achieved with the conventional ultrafine yarns.

The fibrous material that includes the aggregate of nanofibers of the present invention may be used as intermediate articles such as yarn, a wad of cut fibers, package, woven fabric, knitted fabric, felt, nonwoven fabric, synthetic leather and sheet. It can also be preferably used in civil life applications such as clothing, clothing materials, products for interior, products for vehicle interior, livingwares (wiping cloth, cosmetics and goods for beauty treatment, health-care products, toys, etc.), environment-related and industrial materials (building materials, texturing cloth, filter, hazardous material removing device, etc.), IT components (sensor components, battery components, robot components, etc.), medical devices (blood filter, extrasomatic circulation column, scaffold, wound dressing, artificial blood vessel, medicine releaser, etc.) and other fibrous articles.

The invention claimed is:

1. An aggregate of nanofibers made of a thermoplastic polymer selected from the group consisting of polyethylene terephthalate, polybutylene terephthalate, poly(lactic acid), polytrimethylene terephthalate, nylon 6, nylon 66, polyolefin and polyphenylene sulfide, wherein single fiber fineness by number average is in a range from $1\times10^{-7}$ to $6\times10^{-5}$ dtex and 60%, in fineness ratio, or more of single fibers are in a range from $1\times10^{-7}$ to $6\times10^{-5}$ dtex in single fiber fineness and 50% or more, defined in terms of fineness ratio, of single fibers that constitute the aggregate of nanofibers have a diameter within a range of 30 nm in the spread of diameters of the single fibers, said aggregate of nanofibers having a morphology of a filament-yarn and/or a morphology of a spun yarn and an orientation that extends in one dimension over a definite length.

2. The aggregate of nanofibers according to claim 1, that has a strength of 1 cN/dtex or higher.

3. The aggregate of nanofibers according to claim 1, that has a rate of elongation at absorbing water of 5% or higher in the longitudinal direction of the yarn.

4. The aggregate of nanofibers according to claim 1, that contains a functional chemical agent.

5. A fibrous material that includes the aggregate of nanofibers according to claim 1.

6. The fibrous material according to claim 5, that contains a functional chemical agent.

7. The fibrous material according to claim 5, wherein the fibrous material is selected from among yarns, a wad of cut fibers, package, woven fabric, knitted fabric, felt, nonwoven fabric, synthetic leather and sheet.

8. The fibrous material according to claim 7, wherein the fibrous material is a laminated nonwoven fabric made by stacking a sheet of nonwoven fabric that includes the aggregate of nanofibers and a sheet of other nonwoven fabric.

9. The fibrous material according to claim 5, wherein the fibrous material is a fibrous article selected from among clothing, clothing materials, products for interior, products for vehicle interior, livingwares, environment-related materials, industrial materials, IT components and medical devices.

10. The fibrous material according to claim 5, wherein mass per unit area of the fiber is in a range from 20 to 2000 $g/m^2$.

11. The aggregate of nanofibers according to claim 1, wherein the thermoplastic polymer comprises polyphenylene sulfide.

12. The aggregate of nanofibers according to claim 1, wherein the aggregate of nanofibers has an orientation that extends in one dimension for at least several meters.

* * * * *